US010138720B2

(12) United States Patent
Kemick

(10) Patent No.: US 10,138,720 B2
(45) Date of Patent: Nov. 27, 2018

(54) METHOD AND SYSTEM FOR PERFORATING AND FRAGMENTING SEDIMENTS USING BLASTING MATERIAL

(71) Applicant: Energy Technologies Group, LLC, Houston, TX (US)

(72) Inventor: Jerome Kemick, Houston, TX (US)

(73) Assignee: ENERGY TECHNOLOGY GROUP, Houston, TX (US)

( * ) Notice: Subject to any disclaimer, the term of this patent is extended or adjusted under 35 U.S.C. 154(b) by 0 days.

(21) Appl. No.: 15/706,396

(22) Filed: Sep. 15, 2017

(65) Prior Publication Data

US 2018/0266225 A1 Sep. 20, 2018

Related U.S. Application Data

(60) Provisional application No. 62/601,278, filed on Mar. 17, 2017.

(51) Int. Cl.

| | |
|---|---|
| ***E21B 43/263*** | (2006.01) |
| ***E21B 43/248*** | (2006.01) |
| ***E21B 43/26*** | (2006.01) |

(52) U.S. Cl.

CPC ..... *E21B 43/263* (2013.01); *E21B 43/248* (2013.01); *E21B 43/261* (2013.01)

(58) Field of Classification Search

CPC ..... E21B 43/248; E21B 43/261; E21B 43/263
See application file for complete search history.

(56) References Cited

U.S. PATENT DOCUMENTS 2,708,876 A * 5/1955 Nowak ..... C09K 8/60 102/313
2,867,172 A * 1/1959 Hradel ..... F42D 1/00 102/310

(Continued)

FOREIGN PATENT DOCUMENTS

CA 2127302 7/1994
CA 2842822 1/2013

(Continued)

OTHER PUBLICATIONS

Schlumberger Oilfield Glossary entries for "casing", "casing string", and "production casing", accessed May 21, 2018 via www.glossary.oilfield.slb.com.*

(Continued)

*Primary Examiner* — Blake E Michener
(74) *Attorney, Agent, or Firm* — Duane Morris LLP

(57) ABSTRACT

A method for treating a hydrocarbon bearing formation bounded by at least one nonbearing formation comprises inserting a tubular into a wellbore formed in the hydrocarbon bearing formation. The tubular defines proximal and distal ends and further has a sidewall defining inner and outer surfaces and a tubular bore, where an annulus is defined between the outer surface of the sidewall and the inner surface of the wellbore. A detonator is disposed in the annulus through at least a portion of the hydrocarbon bearing formation. A first fluid including a first explosive is pumped through the tubular bore into a selected portion of the annulus. An isolation material is inserted in the annulus between an entrance of the wellbore and the first explosive fluid. The explosive fluid is detonated with the detonator.

66 Claims, 50 Drawing Sheets

(56) References Cited

U.S. PATENT DOCUMENTS 2,892,406 A * 6/1959 Hradel ..... F42D 1/00 102/313
3,075,463 A * 1/1963 Eilers ..... C06B 47/00 102/313
3,336,982 A * 8/1967 Woodward ..... E21B 43/263 166/299
3,361,023 A 1/1968 Collins et al.
3,409,082 A * 11/1968 Bray ..... E21B 43/2635 166/247
3,456,589 A * 7/1969 Slykhouse ..... C06B 47/14 102/313
3,561,532 A 2/1971 Fletcher et al.
3,630,281 A 12/1971 Fast et al.
3,659,652 A * 5/1972 Roberts ..... C09K 8/80 166/299
3,718,088 A 2/1973 Bearden et al.
3,747,679 A 7/1973 Roberts
3,971,317 A * 7/1976 Gemmell ..... E21B 43/263 102/313
4,037,657 A 7/1977 Lekas
4,057,780 A 11/1977 Shuck
4,078,612 A * 3/1978 Gallus ..... E21B 43/263 102/301
4,230,368 A 10/1980 Cleary, Jr.
4,380,265 A 4/1983 Mohaupt
4,441,556 A 4/1984 Powers et al.
5,071,496 A 12/1991 Coursen et al.
5,099,763 A 3/1992 Coursen et al.
5,894,888 A 4/1999 Wiemers et al.
5,920,030 A 7/1999 Day
5,945,627 A 8/1999 Arpin et al.
5,996,709 A 12/1999 Norris
6,000,479 A 12/1999 Ambs
6,035,784 A 3/2000 Watson
6,148,730 A 11/2000 Watson
6,330,860 B1 12/2001 Kang
6,755,249 B2 6/2004 Robison et al.
7,896,104 B2 3/2011 Becker et al.
8,104,536 B2 1/2012 Looney et al.
8,127,832 B1 3/2012 Bond
8,132,628 B2 3/2012 Sanders et al.
8,172,449 B2 5/2012 Sanders et al.
8,485,257 B2 7/2013 Bali et al.
8,538,698 B2 9/2013 Heck, Sr.
8,820,242 B2 9/2014 Alexander
8,991,499 B2 3/2015 Nevison
9,109,415 B2 8/2015 Coles
9,127,544 B2 9/2015 Dombrowski et al.
9,181,789 B2 11/2015 Nevison
9,309,759 B2 4/2016 Vandor
9,316,098 B2 4/2016 Vandor
9,334,719 B2 * 5/2016 Rytlewski ..... F42B 3/117
9,488,456 B2 11/2016 Mace et al.
9,593,924 B2 3/2017 Mace et al.
2006/0070740 A1 4/2006 Surjaatmadja et al.
2008/0164030 A1 * 7/2008 Young ..... E21B 43/2405 166/299
2013/0032337 A1 * 2/2013 Rytlewski ..... E21B 43/263 166/250.1
2013/0126163 A1 5/2013 Gupta et al.
2013/0211807 A1 8/2013 Templeton-Barrett et al.
2013/0327529 A1 12/2013 Sprouse
2014/0326453 A1 11/2014 Moeller et al.
2015/0247395 A1 * 9/2015 Stehle ..... C06B 47/14 166/300
2015/0252663 A1 * 9/2015 Stehle ..... C06B 47/14 166/299
2016/0009984 A1 1/2016 Thompson et al.
2016/0084058 A1 3/2016 Nevison
2016/0177694 A1 6/2016 Kashafutdinov et al.

FOREIGN PATENT DOCUMENTS

EP 84377 A4 12/1985
WO WO 2013013272 1/2013

OTHER PUBLICATIONS

Dictionary Definition of "pump", accessed May 21, 2018 via thefreedictionary.com.*
Schlumberger Oilfield Glossary entries for "drilling fluid" and "completion fluid", accessed Jul. 19, 2018 via www.glossary.oilfield.slb.com.*
Melvin A. Cook, The Science of High Explosives. The American Chemical Society. 1958. 7 pages. Published by Reinhold Publishing Corporation. Published in USA.
Marc Andre Meyers, Dynamic Behavior of Materials. University of California. 1994. 5 Pages. Published by John Wiley & Sons, Inc. Published in India.
Cement Plug Placement and Integrity—Mechanical Cementing Service. www.weatherford.com—Published 2014

* cited by examiner

METHOD AND SYSTEM FOR PERFORATING AND FRAGMENTING SEDIMENTS USING BLASTING MATERIAL

CROSS-REFERENCE TO RELATED APPLICATIONS

This application claims priority to U.S. Provisional Patent Application No. 62/601,278, filed on Mar. 17, 2017, the entirety of which is incorporated herein by reference.

FIELD

This disclosure relates to the use of blasting materials for perforating and fragmenting hydrocarbon bearing formations.

BACKGROUND

In the oil and gas production industry, it is desired to increase the rate of production of a given producing interval. The production rate is dependent on the permeability of the producing interval, the surface area of the producing interval, the pressure drop of the producing interval, and the viscosity of the hydrocarbon fluid. One way to increase the production rate is to increase the surface area of the producing interval. Various methods have been used to increase the surface area of hydrocarbon bearing formations. For example, the diameter or length of the well bore can be increased. Alternatively, hydraulic fracturing (commonly known as "fracking") hydraulically fractures the hydrocarbon bearing formation, using pressurized fluids, to increase the effective surface area of the interval. An improved method of increasing the production rate and cumulative recoveries of hydrocarbon and other reserves of the formations is desired.

SUMMARY

In one example, a method for treating a hydrocarbon bearing formation bounded by at least one nonbearing formation comprises inserting a tubular into a wellbore formed in the hydrocarbon bearing formation. The tubular defines proximal and distal ends and further has a sidewall defining inner and outer surfaces and a tubular bore, where an annulus is defined between the outer surface of the sidewall and the inner surface of the wellbore. A detonation means is disposed in the annulus through at least a portion of the hydrocarbon bearing formation. A first fluid including a first explosive is pumped through the tubular bore into a selected portion of the annulus. An isolation material is inserted in the annulus between an entrance of the wellbore and the first explosive fluid. The explosive fluid is detonated with the detonation means.

In another example, a method for treating a selected subterranean formation comprises inserting a tubular into a wellbore formed in said selected formation. The tubular includes a sidewall defining an inner and outer surface and an axial bore such that an annulus is formed between the outer surface of the sidewall and an inner surface of the wellbore. One or more detonators are placed in the annulus along at least a portion of the subterranean formation. A first explosive fluid is isolated in the annulus along at least a portion of the selected formation. The first explosive fluid is detonated using one or more of the detonators.

In another example, a method for treating a hydrocarbon bearing formation comprises inserting a casing into a wellbore formed in said hydrocarbon bearing formation. The casing has a sidewall having an inner and an outer surface and defining a casing bore. The outer surface of the sidewall and the inner surface of the wellbore define an annulus. The outer surface of the casing includes one or more detonators disposed along a selected portion of its length. A fluid seal is formed in the annulus so as to define a first and second annular zone, where the first annular zone is located substantially adjacent the hydrocarbon bearing formation. An isolation material is inserted in the second annular zone. A tubular is positioned in the casing bore, such that a distal end of the tubular is located adjacent to a first set of perforations formed in the casing, where the perforations are located in the first annular zone. A first fluid including a first explosive is pumped through the tubular to enable the fluid to be injected through the one or more first sets of perforations such that the explosive fluid hydraulically fractures the hydrocarbon bearing formation in the first annular zone. The first explosive fluid is detonated using the one or more detonators.

In another example, a system for treating a hydrocarbon bearing formation comprises a tubular comprising a sidewall having an inner surface and an outer surface. The inner surface defines an axial bore, where the tubular is configured to be disposed in a wellbore formed in the formation such that the outer surface of the tubular and the inner surface of the wellbore define an annulus. One or more housings are disposed along and engaged with a portion of the outer surface of the sidewall so as to define one or more cavities therein. A material capable of undergoing an exothermic reaction is disposed in each of one or more the cavities. Means are provided to detonate the material.

In another example, a method for treating a hydrocarbon bearing formation comprises inserting a tubular into a wellbore in the hydrocarbon bearing formation. The tubular has a sidewall defining inner and outer surfaces and a tubular bore. The outer surface of the sidewall and the inner surface of the wellbore define an annulus therebetween. A boundary is formed in the annulus so as to create a first and second region, where the first region is situated substantially proximate the hydrocarbon bearing formation. One or more detonators are situated along an axial direction in the first region of the annulus. A material is inserted in the second region so as to isolate the first region. A first fluid including a first explosive is pumped into the first region in the annulus. The first explosive fluid is detonated with the one or more of the detonators so as to create fractures in the hydrocarbon bearing formation. A second fluid including a second explosive is pumped into the first region and into the fractures now created in the hydrocarbon bearing formation. The second explosive is detonated so as to fragment the formation.

In another example, a method for enhancing the surface area in a given formation comprising the steps of: inserting a sleeve into a wellbore in the given formation, where the wellbore defines an entrance and a terminus, where the sleeve includes a sidewall and defines an inner bore and a longitudinal axis therethrough, the sleeve having an explosive therein, and the sleeve having one or more means to detonate the explosive proximate the sleeve so as to enable detonation of the explosive; at least partially inserting a tubular axially into the sleeve, where the tubular includes a sidewall defining an inner and outer surface and a tubular bore, where the outer surface of the sidewall and the sleeve define an annulus therebetween; inserting an isolation material between the wellbore entrance and the explosive within the annulus; and detonating the explosive using the detonation means.

In another example, a system for treating a hydrocarbon bearing formation comprises a tubular including a sidewall defining an inner surface and an outer surface. The inner surface defines a tubular bore. A sleeve is axially disposed about the outer surface of the sidewall so as to define an annulus therebetween. An explosive is disposed in the annulus. A detonation means is provided for detonating the explosive. A detonator controller is operable to activate the detonation means.

In another example, a method for treating a selected, subterranean formation comprises inserting a tubular into a bore hole formed in the formation so as to define an annulus around the tubular. A flow boundary is provided in the annulus proximate the selected formation. An isolation material is inserted into the annulus at the proximal end of the flow boundary. A first fluid including a first explosive is pumped into the annulus proximate the selected subterranean formation at the distal end of the flow boundary. The first explosive is detonated. The tubular is perforated at a region where it extends through the selected formation.

In another example, a method of improving the extraction of a fluid or gas from a given subterranean formation increases the surface area of the portion of that formation accessible from a borehole formed in the subterranean formation. From the borehole, a first fluid including a first explosive is injected under pressure into the formation to result in a hydraulic fracturing of that formation. The first explosive is detonated. The fluid or gas is extracted through the borehole.

BRIEF DESCRIPTION OF THE DRAWINGS

The features shown in the referenced drawings are illustrated schematically and are not intended to be drawn to scale nor are they intended to be shown in precise positional relationship. Like reference numbers indicate like elements.

DETAILED DESCRIPTION

Figure 1:
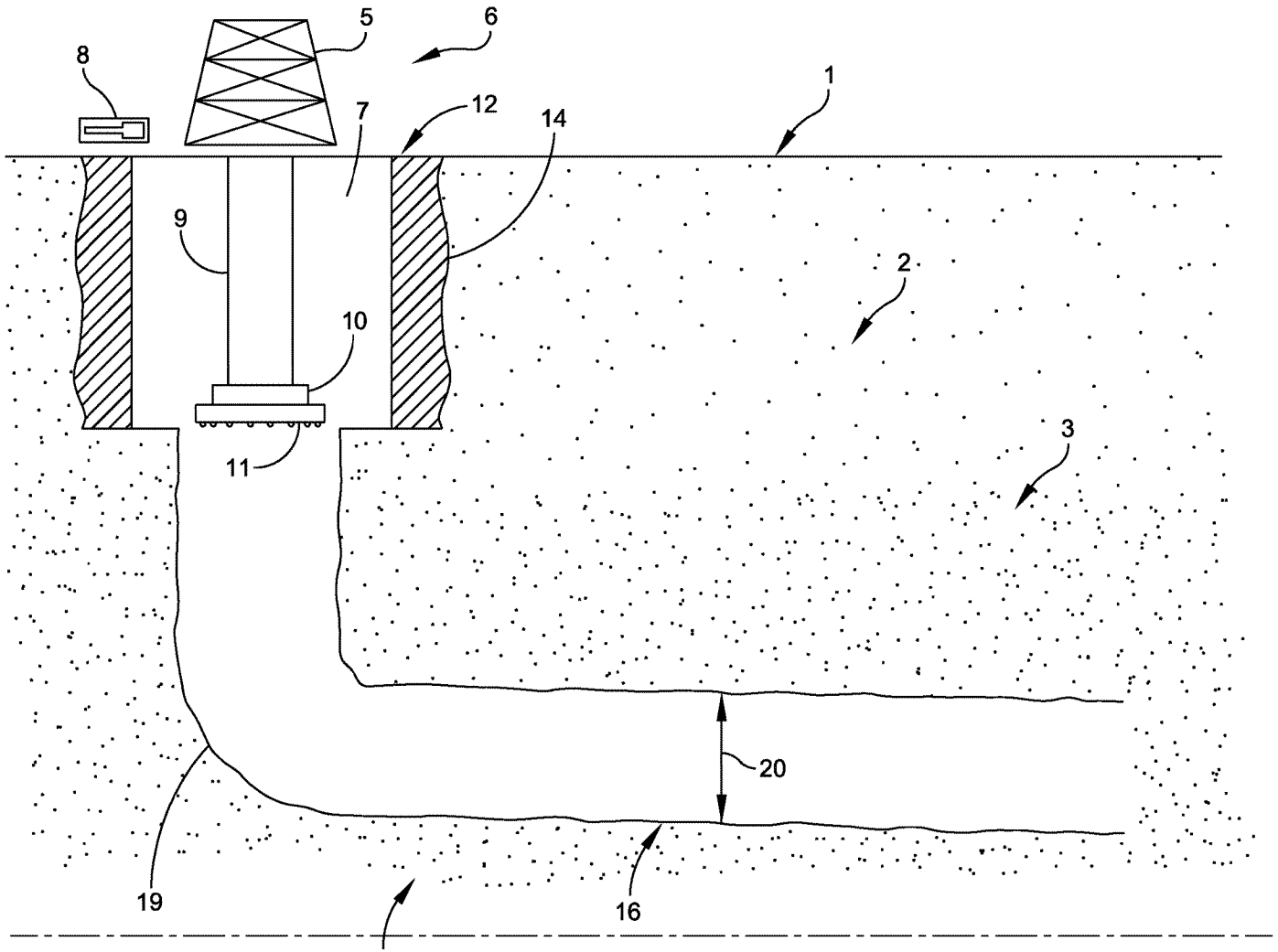
FIG. 1 shows a longitudinal cross-section of a horizontal well formed in a subsurface sedimentary formation.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Explosive Outside Casing

FIGS. 1-9 show a non-limiting example of a method for treating a subterranean formation. Devices and methods are described herein for perforating and fragmenting a producing interval of a subterranean formation (such as a hydrocarbon bearing formation, a water bearing formation, or a geothermal formation bearing steam). The producing interval includes the portion of the formation to be prepared for extraction. The method includes inserting a tubular 22 into a well bore 12, 16 to form an annulus 18, and inserting a material containing an explosive 33 or material capable of an exothermic chemical reaction (e.g., an oxidation-reduction reaction), and a detonation means 23 into the annulus 18 via the tubular 22. The material can be in liquid, slurry, solid form or aggregate form.

FIG. 1 illustrates a surface 1 above a subterranean geologic formation 2. The subterranean geologic formation 2 overlies a hydrocarbon bearing formation 3, which can contain petroleum and/or natural gas, for example. The hydrocarbon bearing formation 3 is bounded by at least one non-hydrocarbon bearing ("nonbearing") formation 4. Also shown is a drilling rig 5 with associated tools 6. The associated tools 6 can include drilling fluid 7, a pump 8, a drill pipe 9, a motor 10, and a drill bit assembly 11. Additional connecting elements, such as wiring, external pipes, fittings, valves, sealing elements, fasteners and the like are omitted for brevity.

A surface hole having a selected well diameter is drilled. A surface casing 12 is encased by pumping a surface casing cement 14 in the surface hole to the surface 1.

A well bore 16 is drilled out of the surface casing 12 and penetrates a hydrocarbon bearing formation 3. The well bore has a horizontal portion 16 The well bore 12 has a horizontal portion 16, a bend 19, and a distal end 21. Although FIGS. 1-9 show a sharp bend for ease of illustration, the bend 19 can have a large radius of curvature, of the same order of magnitude as the total depth of the vertical well bore 12. The horizontal portion of wellbore 16 may be substantially perpendicular to the vertical well bore 12. For example, the horizontal portion of the wellbore 16 may form an angle with the vertical well bore 12 of from 70 degrees to 110 degrees. Although the examples described herein have horizontal or vertical wellbores, other embodiments can have a variety of wellbore geometries, and can include combinations of vertical, horizontal, and slanted (directional) sections and one or more bends, deviations or curvatures.

The tubular has a sidewall defining inner and outer surfaces and an axial bore, also referred to herein as a tubular bore. The tubular can be a tube, a pipe, a casing or a liner inside the well bore. In some embodiments, the tubular is a production casing. An annulus is defined between the tubular and the inner surface of the well bore. The devices and methods described herein can include one or more detonation means disposed in the annulus between the well bore and the perimeter of a tubular inside the well bore. In some embodiments, the detonators within the annulus can be positioned adjacent the outer surface of the tubular.

In some embodiments, the tubular is a production casing. In some embodiments, the tubular comprises a steel alloy, such as American Petroleum Institute (API) 5L alloy steel pipe. Although specific examples described below include production casings, other embodiments substitute other tubular products (e.g., drill pipe or drill collars) for the exemplary production casing.

The detonation means can include one or more detonators disposed in the annulus along a selected portion of the length the casing, through at least a portion of the hydrocarbon bearing formation. In some embodiments, the detonators can be electrical detonators (also known as blasting caps) having a fuse that burns when a predetermined ignition voltage is applied to initiate a primary high explosive material in the device. A high explosive can detonate with an explosion time on the order of microseconds, an explosion pressure of greater than 50,000 psi and/or a flame front velocity of 1 to 6 miles per second (faster than the speed of sound), causing an explosive shock front that can move at a supersonic speed. A primary high explosive is a sensitive, easily detonated explosive material, for example, a material which can be detonated by an n. 8 detonator on the Sellier-Bellot scale, where the charge corresponds to 2 grams of mercury fulminate. The primary high-explosive material in the detonator is used to initiate an explosive sequence. In other embodiments, the detonation means can include one or more percussion detonators (also known as percussion caps), which contain a primary high explosive activated by a firing pin. In some embodiments, the detonation means can include a detonator string 23 having a plurality of detonators 24 and corresponding insulated electrical cables 25 interconnecting the plurality of detonators 24.

In some embodiments, the detonation means can include one or more detonators arranged and configured to cause the detonation of an explosive (a blasting material) disposed adjacent to the detonators and within the annulus, to cause the subterranean formation to fracture, perforate, crack and fragment. This process may increase the effective surface area of the producing interval of the subterranean formation by one or more orders of magnitude and allow a corresponding increase in the production rate of the interval. In several examples described below, the subterranean formation is a hydrocarbon bearing formation, in other embodiments, the subterranean formation is a water-bearing formation, a superheated water bearing formation, a steam-bearing formation, or a formation containing another fluid. The detonators can be spaced apart by distances ranging from 50 feet to 1000 feet. For example, the detonators can be spaced apart by distances between 250 feet and 500 feet.

Figure 2:
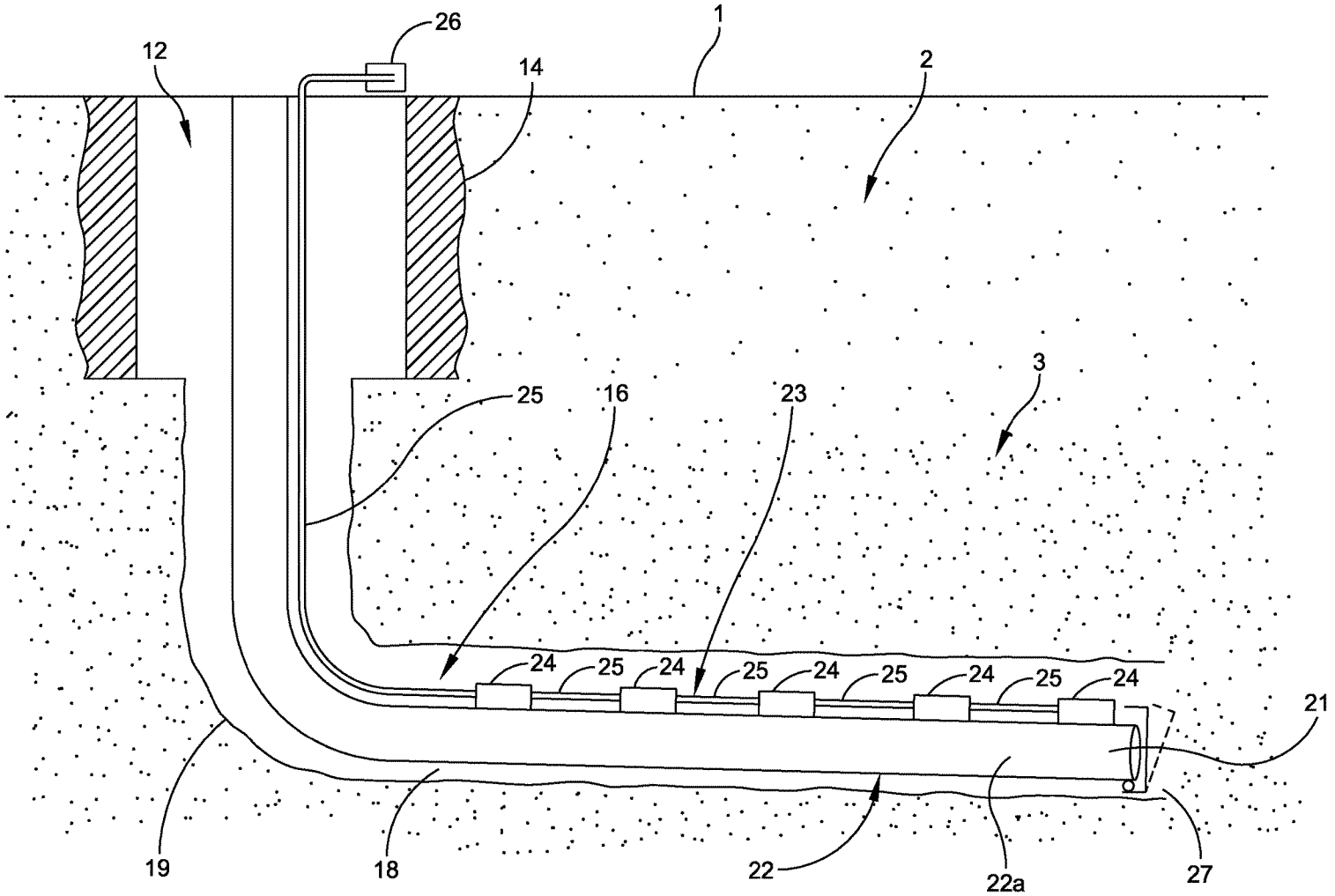
FIG. 2 shows a string of tubular and a plurality of detonators/boosters within the well of FIG. 1.

As shown in FIG. 2, a tubular, such as a production casing 22, is placed within the horizontal portion 16 of the wellbore, forming the annulus 18 between the casing 22 and the horizontal wellbore. The horizontal portion 16 of the wellbore and the casing 22 can be circular, but as used herein, the term "annulus" is not limited to a space between a circular wellbore and a circular tubular. The wellbore and/or the tubular can deviate from a circular cross-section (e.g., an eccentricity). The casing 22 extends from the surface 1, through the vertical well bore 12, the bend 19, and the horizontal portion 16 of the wellbore to the distal end (terminus) 21 and defines a tubular bore within the tubular; in this example, a casing bore 22*a* within the casing 22. Additionally, detonator means, such as a detonator string 23 is attached to, or positioned adjacent to, the outer surface of the sidewall of the casing 22. The detonator string 23 can include multiple detonators 24 and corresponding insulated electrical cables 25 interconnecting the multiple detonators 24. The electrical cables 25 extend to a master control 26, which can be located on surface 1 or at a remote site (not shown) above surface 1. The detonator string 23 is positioned outside of the tubular bore 22*a* of the casing 22. For example, the detonator string 23 can be secured to the outer surface of the sidewall of tubular 22 at least a portion of its length, and arranged along an axial direction (parallel to a central longitudinal axis of the casing 22). A one-way check valve 27 is disposed at the distal end 21. FIG. 2 shows detonator string 23 including a single longitudinal row of detonators 24 aligned along the length of casing 22, but in other embodiments, the plurality of detonators 24 can be arranged in one or more circumferential rings at varying longitudinal positions around the casing 22.

Figure 3A:
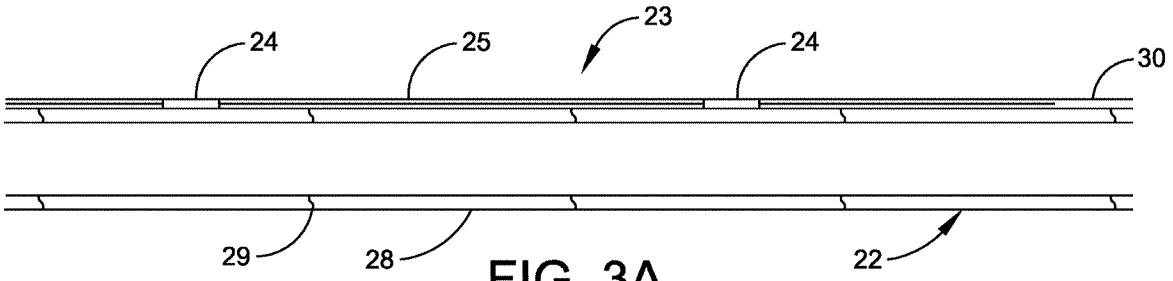
FIG. 3A is a detailed longitudinal cross-sectional view of a tubular (a production casing) and detonator string.
Figure 3C:
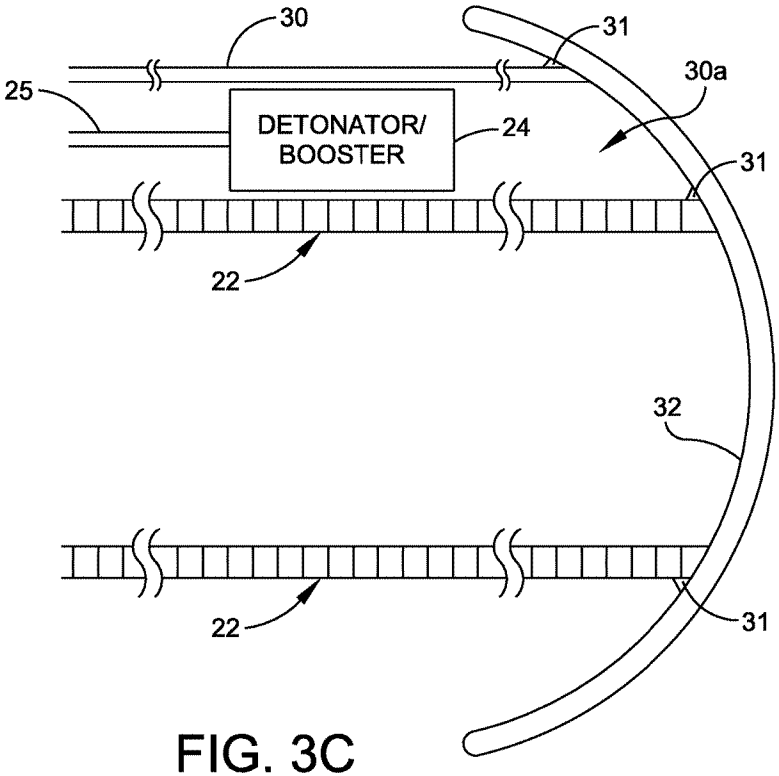
FIG. 3C is a longitudinal cross-sectional view of an end of a tubular.
Figure 3B:
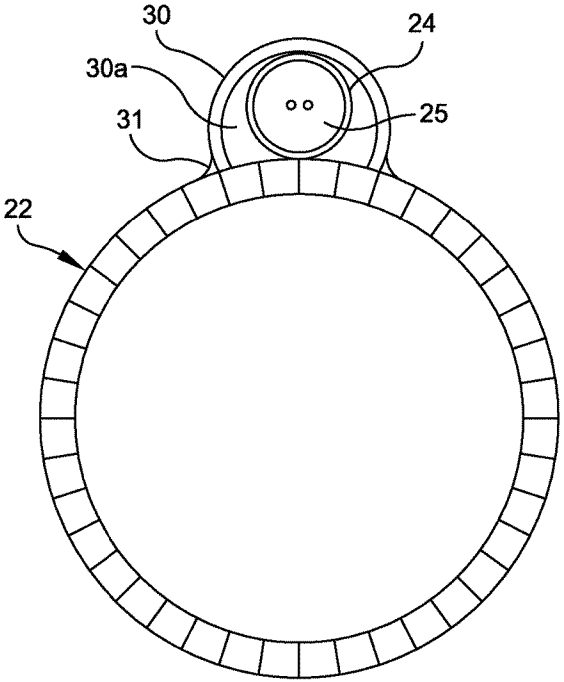
FIG. 3B is a cross-sectional view of the tubular and detonator string of FIG. 3A.

FIGS. 3A-3C are detailed views of the casing 22. As seen in FIG. 3A, casing 22 can comprise a plurality of casing sections 28, connected together at fittings (e.g., threaded couplings or sockets) 29 to form a string of production casing 22. The outer surface of the casing 22 can include an integral tubing protector 30 having an inner surface defining a channel 30*a* for enclosing the detonator string 23 therein. The tubing protector 30 can extend along the casing 22, from the distal end 21 of the casing 22 to the surface 1 and may terminate near the master control 26. In some embodiments, the tubing protector 30 protects the detonator string 23 and maintains the position of the detonator string 23 with respect to the casing 22. In some embodiments, the tubing protector 30 is semi-circular in cross-section, or has the shape of an arc (e.g., a major or minor arc) connected to casing 22 at two points along the circumference of the casing 22. Tubing protector 30 can be welded to the casing 22 at weld joints 31, as shown in FIG. 3B. Alternatively, the tubing protector 30 can be attached to the casing 22 using other joining means, such as sintering, resin bonding, fasteners, or the like. The tubing protector 30 can be attached to the casing 22 as the casing sections 28 are being joined by the fittings (e.g., threaded couplings or sockets) 29 prior to the running of the casing 22 in the wellbore 16. As shown in FIG. 3C, a bull plug 32 or cap (not shown) may be positioned at the distal end of the production casing 22 to assist with insertion of the production casing in the well. The bull plug 32 can be welded to the casing 22 and/or the tubing protector 30.

Figure 4:
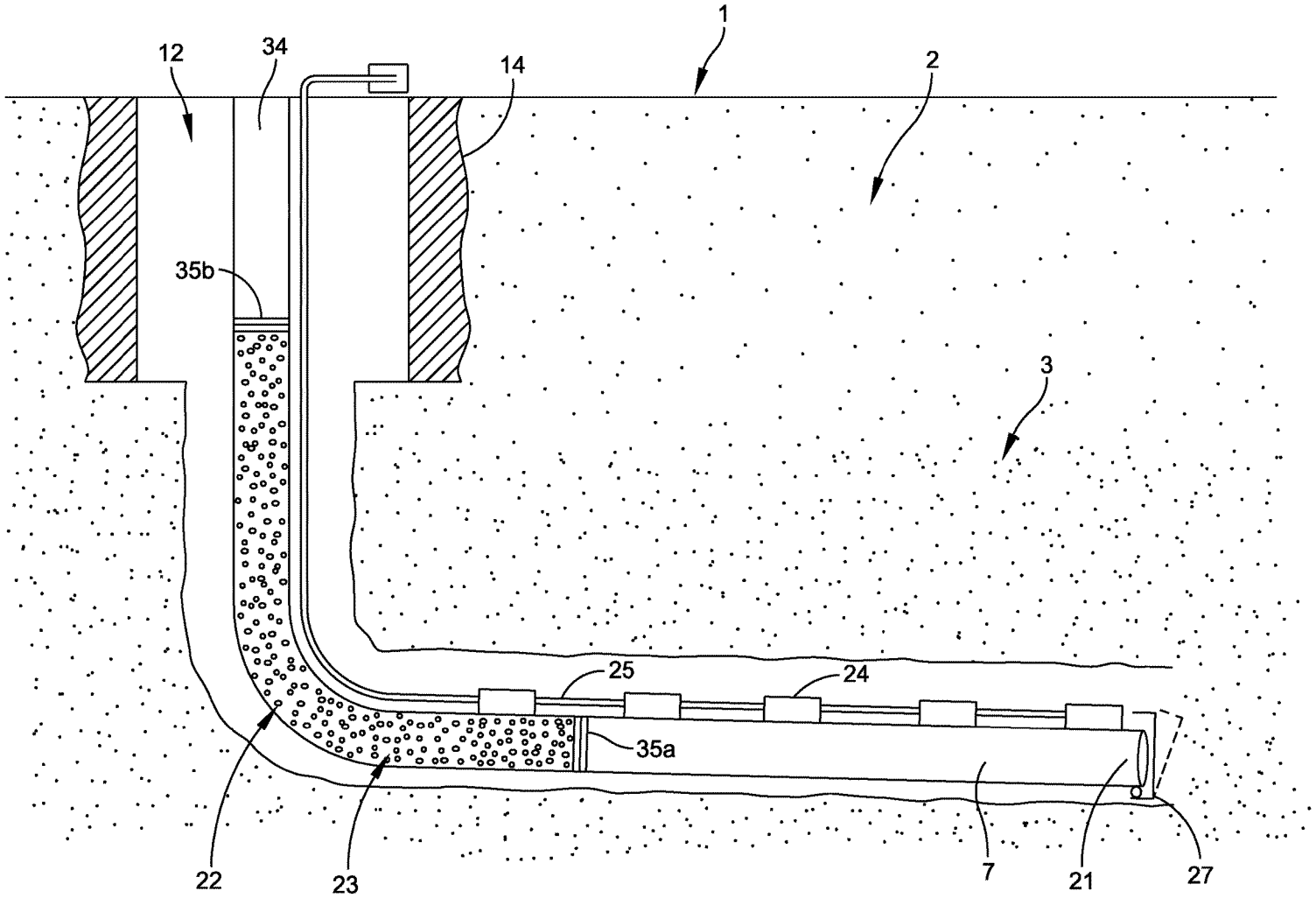
FIG. 4 shows a slurried blasting material within the tubular of FIG. 2.

FIG. 4 shows the casing 22 after insertion of a predetermined amount of a first fluid having a first explosive 33 (also referred to herein as a slurried blasting material). As shown in FIG. 4, a drilling fluid 7 is inserted into the casing 22. Then a first spacer 35*a* is inserted into the tubular bore 22*a* of the casing 22. A predetermined amount of explosive material 33 is placed within the tubular bore 22*a* of the casing 22, with the first spacer 35*a* separating the drilling fluid 7 from the first fluid containing the first explosive 33. A second spacer 35*b* can then be inserted into tubular bore 22*a*, followed by additional drilling fluid 7. At the proximal end of the casing 22, the second spacer 35*b* provides a flow boundary in the annulus, that separates the explosive material 33 from pressurized drilling fluid 34. The second spacer 35*b* forms a fluid seal in the annulus 18 so as to define a first annular zone and a second annular zone within the annulus. The first annular zone is located substantially adjacent the hydrocarbon bearing formation 3, between the spacer 35*b* and the distal end 21 of the casing. The second annular zone extends between the surface 1 and the spacer 35*b*.

The first fluid can include a carrier. The carrier can be a petroleum based carrier fluid (e.g., fuel oil, diesel fuel), acetone, an alcohol, or another organic solvent. In some embodiments, the first fluid further includes a secondary high explosive (or tertiary high explosive), a proppant, and a gelling agent. The gelling agent can include a thickener such as locust bean gum, guar gum, hydroxypropyl guar gum, sodium alginate, and heteropolysaccharides, or any combination of these thickeners. In some embodiments, the thickener constitutes from 0 to about 5% of the first fluid. In some embodiments, the thickener constitutes from 0 to about 2% of the first fluid.

The first fluid containing the explosive 33 has a carrier fluid or solvent selected so that the viscosity of the first explosive fluid as a function of the depth of the formation 3 and the wellbore temperature of that formation 3. In some embodiments, the first fluid has a viscosity in a range from 10 Pascal-seconds to 50 Pascal-seconds. The first fluid containing the first explosive 33 can be, for example, a water based slurry, an oil based slurry, an oil-in-water slurry, a water-in-oil slurry or a fluid containing a powder.

In some embodiments, the first fluid includes a fuel such as fuel oil, diesel oil, distillate, kerosene, naphtha, waxes, paraffin oils, benzene, toluene, xylenes, asphaltic materials, low molecular weight polymers of olefins, animal oils, fish oils, other mineral, hydrocarbon or fatty oils, or any combination thereof. In some embodiments, the fluid is a slurry comprising fuel oil and an explosive material 33 (e.g., a secondary high explosive), which can be ammonium nitrate, referred to as ANFO. The explosive material 33 can be gelled using a gelling agent to enable the explosive material 33 to carry proppants of selected amounts and keep the proppants distributed throughout the explosive material 33. In one example, the spacers 35*a*, 35*b* comprise a hydrogel material, the first fluid containing the first explosive 33 comprises an oil-based slurry, the first explosive comprises ammonium nitrate, and fuel oil or diesel fuel.

In other embodiments, the first fluid comprises a water-based slurry, the spacers 35*a*, 35*b* comprise an organogel, and the drilling fluid 7, 34 comprises a water-based system, containing bentonite (absorbent aluminium phyllosilicate clay containing montmorillonite) or other clay suspended in the fluid. If the first fluid is a water-based slurry, the slurry can contain a carrier fluid include water and 25 wt-% to 80 wt-% oxidizer such as hydrogen peroxide, nitrate salts, perchlorate salts, sodium, potassium peroxide and combinations thereof.

The first explosive 33 can include other secondary high explosives. Secondary high explosives generally rely on a detonator and detonation may also involve a booster. Examples of alternative secondary high explosives for the system include explosives such as trinitrotoluene (TNT), tetryl (trinitrophenyl-methylnitramine), cyclotrimethyl-enetrinitramine (RDX), pentaerythri-tol tetranitrate (PETN), Ammonium picrate, Picric acid, clinitrotoluene (DNT), ethyleneclia-minedinitrate (EDNA), nitroglycerine (NG), or Nitrostarch. In some embodiments, the first explosive constitutes from 5 wt-% to 25 wt-% of the first fluid. In some embodiments, the first explosive constitutes from 7 wt-% to 12 wt-% of the first fluid.

The first fluid may also contain an emulsifier, such as polyisobutylene succinic acid (PIBSA) reacted with amines, RB-lactone and its amino derivatives, alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkyl-sulfonates, alkylarylsulfonates, alkylsulfosuccinates, alkyl phosphates, alkenyl phosphates, phosphate esters, lecithin, copolymers of poly(oxyalkylene) glycols and poly(12-hydroxystearic acid), or any combination of the above emulsifiers. In some embodiments, the emulsifier constitutes from 0 wt-% to 5 wt-% of the first fluid.

One of ordinary skill in the art can tailor the amount of the first explosive 33 per barrel of slurry for a particular geological formation and well geometry. In some embodiments, approximately two to three pounds of first explosive 33 per are added per gallon of the first fluid. For example, 300 pounds of first explosive 33 per barrel of first fluid. In one example, a particular subterranean formation is to be treated using 70 barrels of the first fluid including the first explosive 33 per 1000 foot length of lateral bore (350 barrels of the first fluid per 5000 feet). In some embodiments, the total amount of explosive 33 can range from hundreds of pounds to thousands of pounds.

The proppants can include quartz, silica, carborundum granules, ceramics, or any other suitable material. The proppants may be of any appropriate size and geometry used for hydraulic fracturing. The proppants maintain the width of the fractures or reduce decline in fracture width so as to prevent the fractures from closing after detonation of the explosive. In some embodiments, the proppants comprise grains of silica (e.g., sand), aluminum oxide, ceramic, or other particulate. The proppant keeps the interstitial spaces in the fractures sufficiently permeable to allow the flow of hydrocarbons and fracturing fluid to the proximal end of the well bore. In some embodiments the proppants are between 8 mesh and 140 mesh (105 μm to 2.38 mm).

The spacers 35*a*, 35*b* are configured to translate within the casing 22, and form a fluid seal over the first explosive fluid, to prevent any mixing of the drilling fluid 7 and/or the pressurized drilling fluid 34 with the explosive material 33. The spacers 35*a*, 35*b* can be formed of a gel or a solid material. For example, the spacers 35*a*, 35*b* can formed of a material that behaves as a solid exhibiting no flow in steady-state, and undergoes plastic deformation under shear loading. To maintain their integrity while in contact with organic materials (e.g., petroleum, fuel oil or oil-based drilling fluid), the spacers 35*a*, 35*b* can comprise materials with low solubility in oil. For example, the spacers 35*a*, 35*b* can comprise a hydrogel having a network of hydrophilic polymer chains, e.g., a colloidal gel in which water is the dispersion medium. Alternatively, the gel or polymer can be a substantially dilute cross-linked system.

Figure 5:
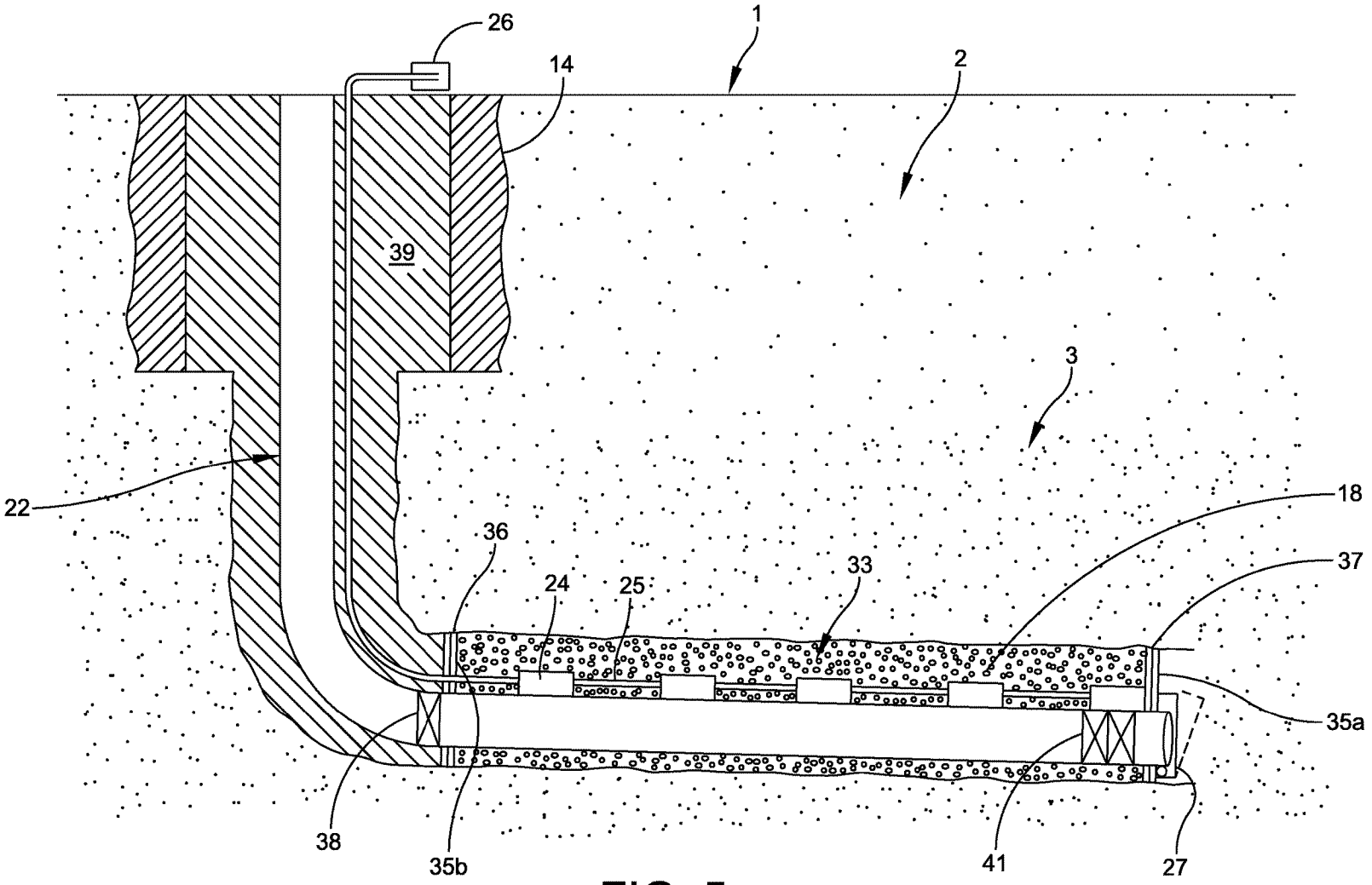
FIG. 5 shows a diverter tool and bridge plug disposed within the casing of FIG. 2 and concrete disposed within the well and outside of the tubular.

Next, a predetermined volume of drilling fluid 34 is pumped into the casing 22, where the predetermined volume is sufficient to displace the first fluid and spacers 35*a*, 35*b* in the casing 22. FIG. 5 shows the system after the first fluid carrying the first explosive 33 is advanced to the first (distal) region of the annulus 18, and the second (proximal) region of the annulus is filled with a production isolation material, such as cement 39. The isolation material 39 extends from the surface 1 to the flow boundary (e.g. at spacer 35*b*). As shown in FIG. 5, the pump 8 pumps pressurized drilling fluid 34 into the casing 22, thereby advancing the spacer 35*a* and explosive material 33 into the annulus 18 surrounding the casing 22. The explosive material 33 moves out of the casing 22 through the distal end 21 and into the annulus 18. In the embodiment shown, the explosive material 33 exits the tubular bore 22*a* of the casing 22 through the one-way valve 27 at the distal end 21 (terminus) of the casing 22. The spacers 35*a*, 35*b* are advanced to the proximal end 36 and distal end 37 of the explosive material 33. Using spacers 35*a*, 35*b* formed of a gel, the spacers 35*a*, 35*b* can reflow from a disc shape (shown in FIG. 4) to an annular shape, as shown in FIG. 5. For example, in some embodiments, the spacers 35*a*, 35*b* comprise a drilling fluid to which extra bentonite has been added to provide extra thickening action.

A diverter tool 38 is positioned inside the casing 22, adjacent to the proximal end 36 of the first fluid with the first explosive 33 in the annulus 18, proximate the boundary between the hydrocarbon bearing formation 3 and non-bearing formations. The diverter tool injects isolation material 39 (e.g., cement) from inside the casing through perforations in the casing 22 and into the second annular zone of the annulus 18, between the surface 1 and the spacer 35*b* (the seal between the isolation material and the explosive fluid). The diverter tool 38 is energized and the isolation material 39 is inserted into the wellbore, outside of the casing 22. The isolation material 39 fills the first (proximal) region of the annulus. The isolation material 39 has a high compressive strength for containing the gasses resulting from the subsequent detonation of the explosive material 33.

In some embodiments, the isolation material 39 is production casing cement. The production casing cement encapsulates the casing 22. The isolation material 39 provides a seal at the proximal end 36 for containing the gas from detonation of the explosive material 33. A bridge plug 41 is positioned within the casing 22 at the distal end 21. Thus, the explosive material 33 is isolated within the annulus between the isolation material (production casing cement) 39 and the distal side of the bridge plug 41 placing the explosive material 33 in contact with (or close to) the hydrocarbon bearing formation 3. The isolation or sealing of the explosive material 33 in the annulus 18 between the casing 22 and the hydrocarbon bearing formation 3 ensures that all of the chemical energy released upon detonation of the explosive material 33 is directed to fracturing the hydrocarbon bearing formation 3. After isolation of the explosive material 33, the diverter tool 38 is removed from the casing 22.

The drilling fluid 34 contained within the tubular bore (e.g., casing bore) of casing 22 can be pressurized by the pump 8 to a selected high pressure which approaches, but remains below, the burst pressure of the tubular 22. The valves 43 on wellhead 42 can be closed to seal the pressurized drilling fluid 34 in the casing 22. The pressure of the drilling fluid 7 within the tubular bore 22*a* of the casing 22 acts to support the casing 22 and increase the collapse pressure of the portion of the casing 22 that is not encased and protected by the isolation material 39. This ensures that the casing 22 does not collapse during the detonation of the explosive material 33.

Figure 6:
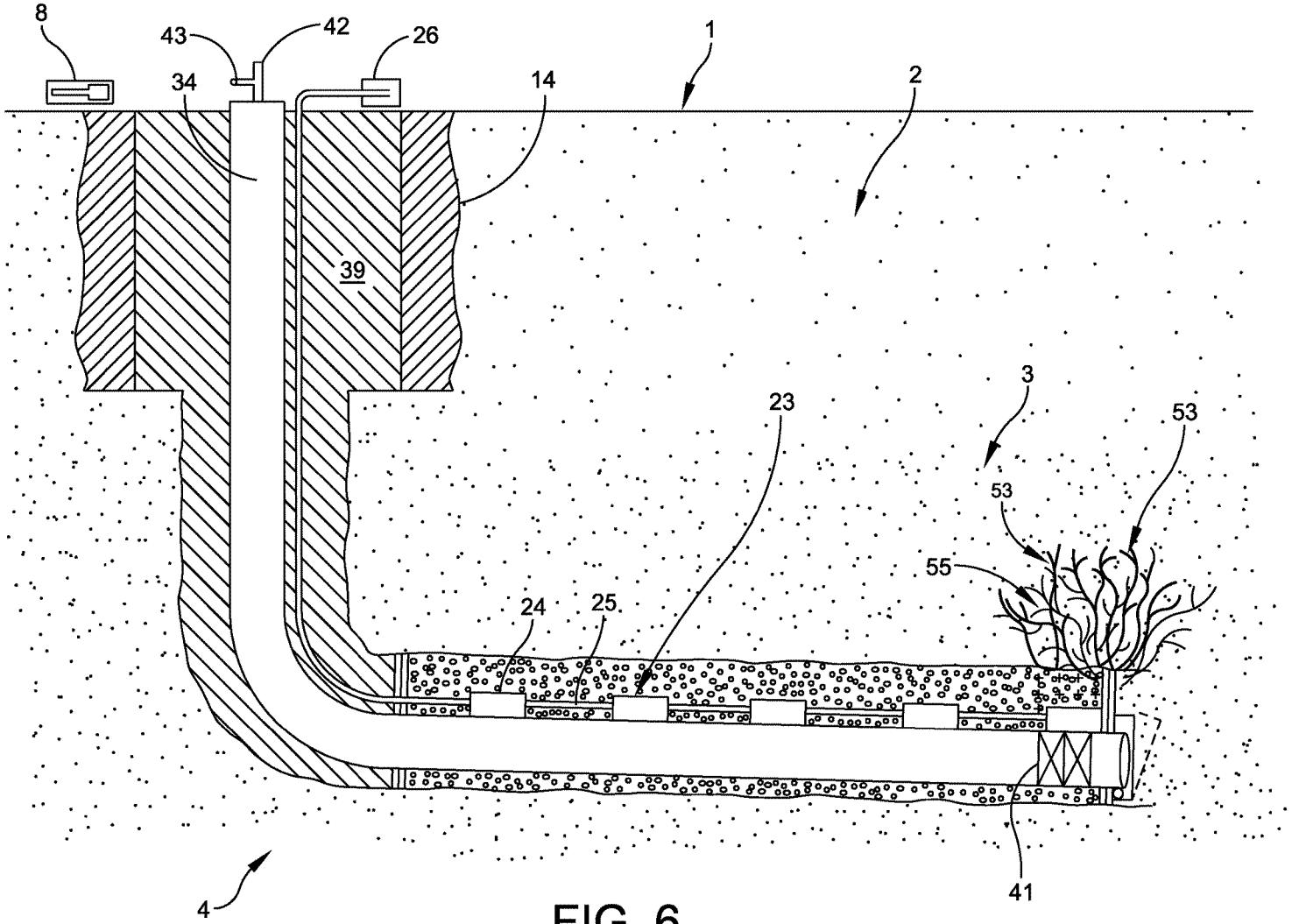
FIG. 6 shows a cross-section of the subsurface sedimentary formation after detonation of a first detonator.

FIGS. 6-9 show the effect of sequentially detonating the explosive material 33. As shown in FIG. 6, a wellhead 42 (also referred to as a "Christmas tree") is secured to the casing 22 at the surface 1. The wellhead 42 can include one or more valves 43. The valves 43 can be connected to one or more pipelines (not shown) to transport the extracted hydrocarbon.

With the explosive material 33 isolated, the explosive material 33 can be detonated. As shown in FIG. 6, a selected detonator 24*a* can be detonated to initiate a chemical reaction in the isolated explosive material 33. The chemical reaction produces high energy gases with a compressive wave front and a refracted wave front that creates cracks 52, crack patterns 53, fragments 54, and fragmentation patterns 55 in the hydrocarbon bearing formation 3.

Figure 7:
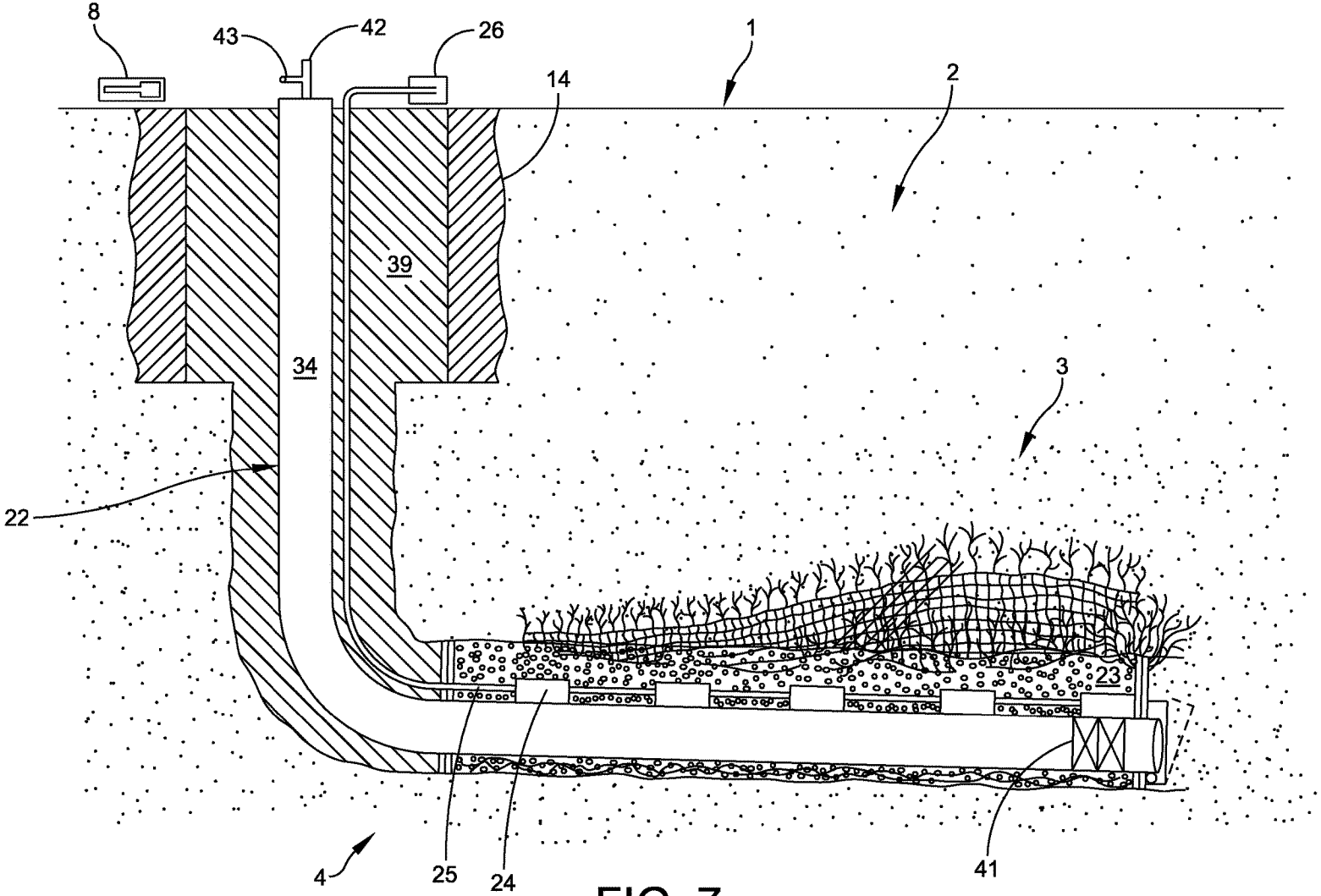
FIG. 7 shows a cross-section of the subsurface sedimentary formation after detonation of additional detonators.
Figure 8:
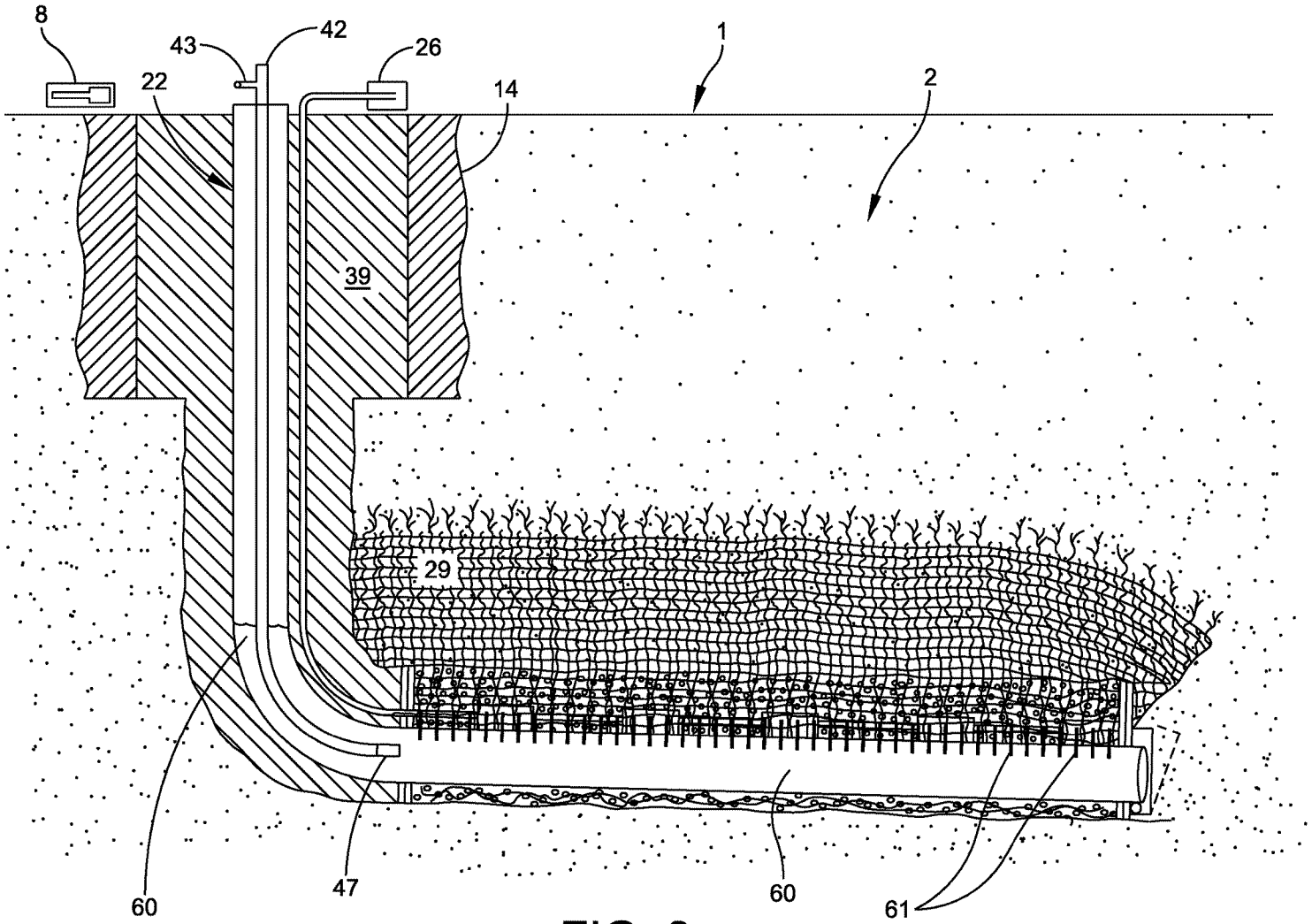
FIG. 8 shows a cross-section of the subsurface sedimentary formation after detonation of each of the detonators and the use of a perforation tool to perforate the tubular.

Following isolation of the explosive material 33 in the annulus, the master control 26 transmits signals to the detonator string to detonate the individual detonators 24 according to a desired sequence. FIGS. 7 and 8 show the progression of the crack and fragmentation pattern 53 in the hydrocarbon bearing formation 3 after detonation of all of the detonators 24. The detonators 24 can be detonated in a predetermined sequence in order to optimize the growth of the crack and fragmentation pattern 53. In some embodiments, the detonators 24 in the center of the string are detonated first, and successive detonators on each side of the center detonator are detonated, continuing outwards towards the proximal and distal ends. In other embodiments, the outermost detonators 24 at the proximal and distal ends are detonated first, and successive detonators are detonation, proceeding inward from the proximal and distal ends towards the center.

In another example, the detonators 24 can be detonated sequentially from the terminal end 21 to the proximal end 36 (i.e., in the order 24*a*, 24*b*, 24*c*, 24*d*, 24*e*). In other embodiments, alternative sequences can be used. For example, the detonator 24 nearest a weak point in the sedimentary formation 3 can be detonated first, followed by subsequent detonation of the detonators 24 progressing away from the first detonator. In other embodiments, the most proximal detonator 24*e* is detonated first, followed by sequential detonation of the detonators 24 extending toward the terminal end 21.

The master control 26 controls the timing of successive detonations so the shock wave fronts from detonation of the explosive material 33 at the locations of each detonator add constructively, to maximize the fracturing work performed by the amount of explosive material 33 in the annulus 18 without causing seismic disruption. The elapsed time between sequential detonations of the detonators 24 can be chosen to optimize the fracturing of the sedimentary formation. The detonation can be controlled by the control 26 and may proceed at a pre-defined sequence or be determined by an operator at the time of detonation. The timing of the detonation is determined based on factors including the distance between detonators and the calculated propagation speed of the compressive wave front from the high energy explosion gases. Given time, the continuous or substantially continuous mass of the first fluid and first explosive 33 within the annulus 18 can support complete detonation of all the first explosive even with a single detonator. Thus, a plurality of detonators are used to enhance the explosion pressure by generating multiple wave fronts in phase with each other, to increase fragmentation and increase surface area. After completion of the detonation process, the pressure in the production casing is bled off.

The increase in surface area from the detonation of a given amount of explosive material 33 may be on the order of $10^2$ to $10^3$ times that created by hydraulic fracturing of a similar well without use of explosives. This increase in surface area will lead to an increase in the (hydrocarbon or water) production rate and cumulative recovery of the hydrocarbon reserves in the hydrocarbon bearing formation.

As shown in FIG. 8, after completion of the detonation process, a perforation tool 47 (e.g., a perforating gun) is used to perforate a portion of the casing 22 to establish communication with the freed hydrocarbon reserves of the hydrocarbon bearing formation.

In some embodiments, the perforation tool 47 is a perforating tool of the water blast type. In other embodiments, the perforation tool 47 is a perforating gun, including a string of shaped charges placed at the desired perforation locations within the casing 22. These charges are fired to perforate the casing 22. The perforation tool 47 (e.g., perforating gun) can carry any desired number of explosive charges. In some embodiments, the perforating gun is run on a wire line (not shown), which can transmit electrical signals from the master control 26 to fire the perforating gun, as well as convey tools. In other embodiments, coiled tubing (not shown) may be used. In further embodiments, the perforation tool 47 (e.g., perforating gun) is run on slickline, using fiber optic lines to convey tools and transmit two-way data.

Figure 9:
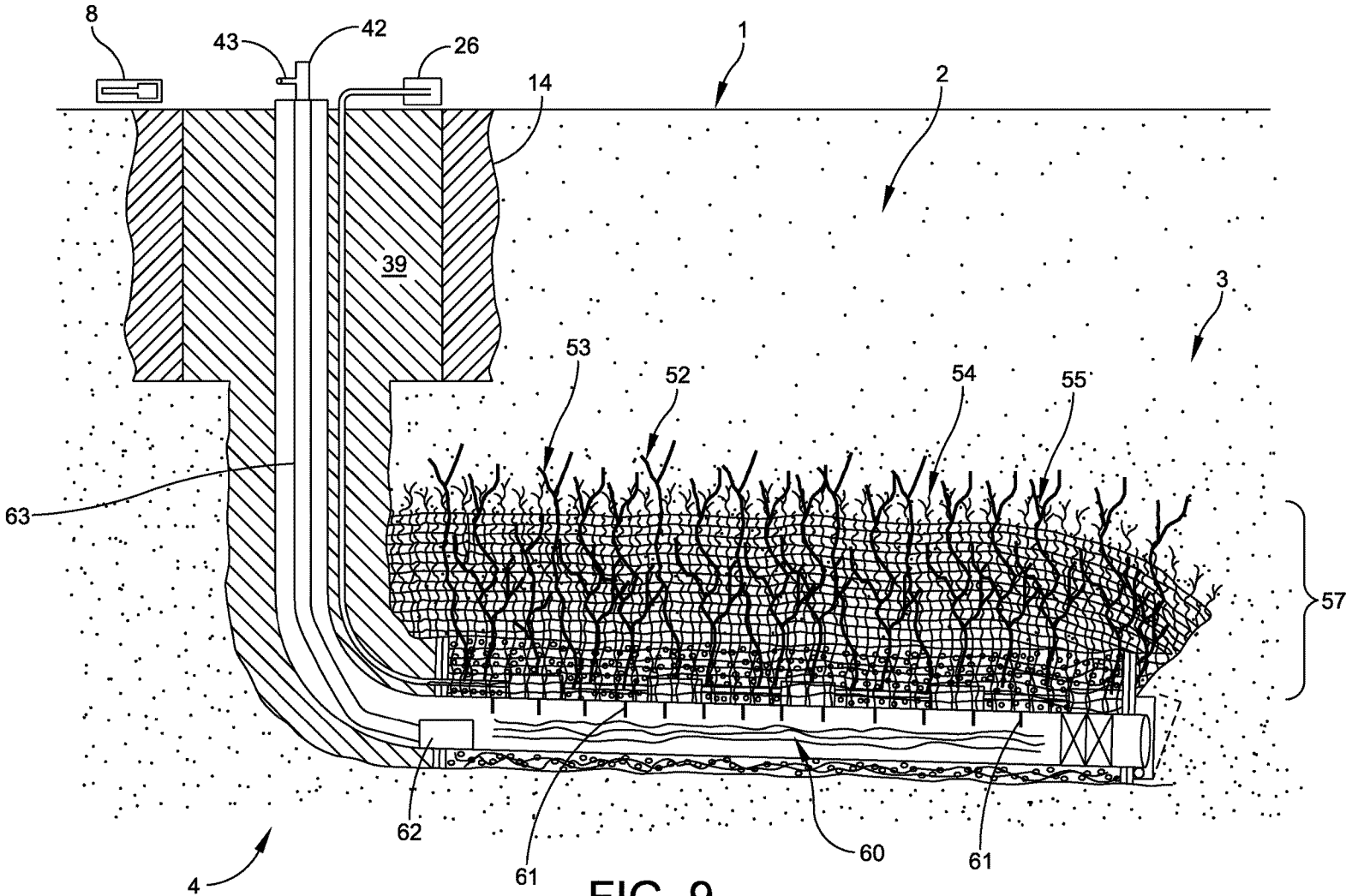
FIG. 9 shows a submersible pump within the tubular to extract a hydrocarbon.

Following perforation, the hydrocarbon can pass through the fractured formation and into the tubular bore 22*a* of the casing through perforations 61. As shown in FIG. 9, a pump 62 can then be placed within the casing 22 to extract the drilling fluid 34, 7 and the free hydrocarbon 60. The pump 62 is connected to wellhead 42 by conduit 63.

Using the methods described herein, a tubular, such as a production casing, is placed in the well bore before detonating explosives or hydraulic fracturing is performed. There is no need to drill or insert a production casing after detonating the explosive. In the event that the over burden collapses in any portion of the well bore, it could otherwise be difficult to drill in or into the fractured zone to place a production pipe after detonation, because of lost circulations problems of the drilling fluid system.

In another embodiment, as shown in FIGS. 10-13, the method is used in a vertical well bore 12. The application of the method in a vertical well bore 12 is substantially similar to that of the horizontal well bore 16 described above, except that the vertical well does not have a bend or a horizontal section. The drilling rig 5, tools 6, pump 8, drill pipe 9, motor 10, drill bit assembly 11, detonators 24, electrical cables 25, control 26, check valve 27, spacers 35*a*, 35*b*, diverter tool 38, isolation material 39, bridge plug 41, well head 42, valve 43, and other components and features can be the same as (substantially the same as) the corresponding elements described above with respect to the embodiment of FIGS. 1-9, and like reference numerals indicate like structures. Additionally, the vertical casing 22 of FIGS. 10-13 can include a bull plug 32 and tubing protector 30 as shown in FIGS. 3A-3B. Also, the vertical casing 22 can be constructed from individual casing sections 28 connected together using fittings 29 as described with reference to FIG. 3A. For the purpose of brevity, a detailed description of each of these components and features is not repeated with respect to FIGS. 10-13.

Figure 10:
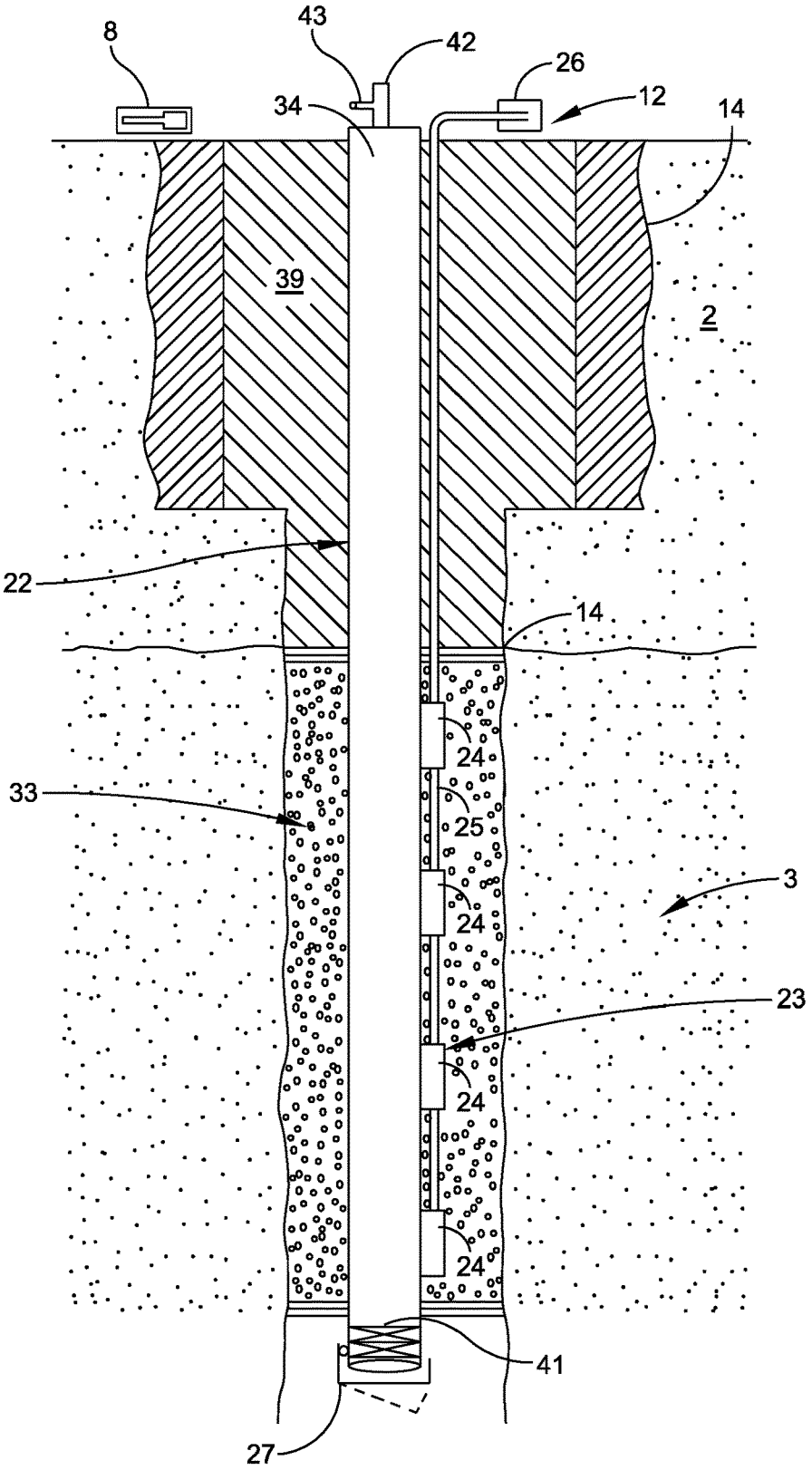
FIG. 10 shows a cross-section of a vertical well, tubular, and detonators in a subsurface sedimentary formation after disposition of the blasting material outside of the tubular and placement of isolation material in the form of cement.

As shown in FIG. 10, after the first fluid containing the first explosive material 33 is positioned in the annulus 18 between the well bore 12 and the casing 22, a diverter tool 38 is placed within the casing 22, near the proximal end of the explosive 33. The diverter tool 38 is energized, and the isolation material 39 is pumped and placed to enclose the casing 22 from the proximal end 36 of the first fluid containing the first explosive 33 to the surface 1. The first explosive 33 is enclosed and isolated axially between the isolation material 39 (at the proximal end) and the bridge plug 41 (at the distal end 21 or terminus) of the casing 22. The predetermined amount of explosive material 33 is contained in the annulus 18 between the outer surface of the casing 22 and the vertical well bore 12, contacting or closely adjacent to the hydrocarbon bearing formation 3. This isolation of the first fluid explosive material 33 ensures that all of the chemical energy released upon detonation of the first explosive material 33 is converted to work done in the hydrocarbon bearing formation 3.

Figure 11:
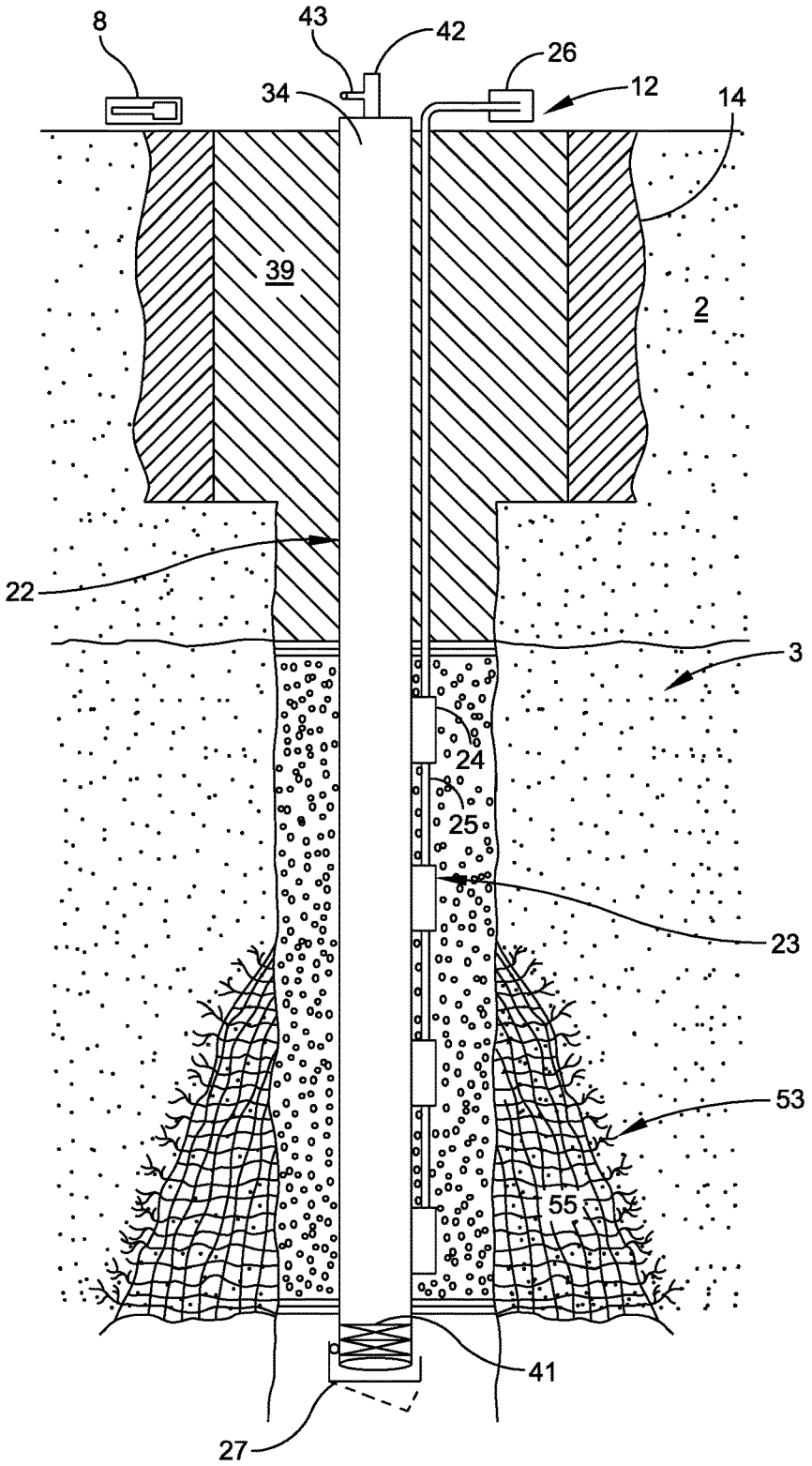
FIG. 11 shows a cross-sectional view of the vertical well and subsurface sedimentary formation of FIG. 10 after detonation of a portion of the detonators.
Figure 12:
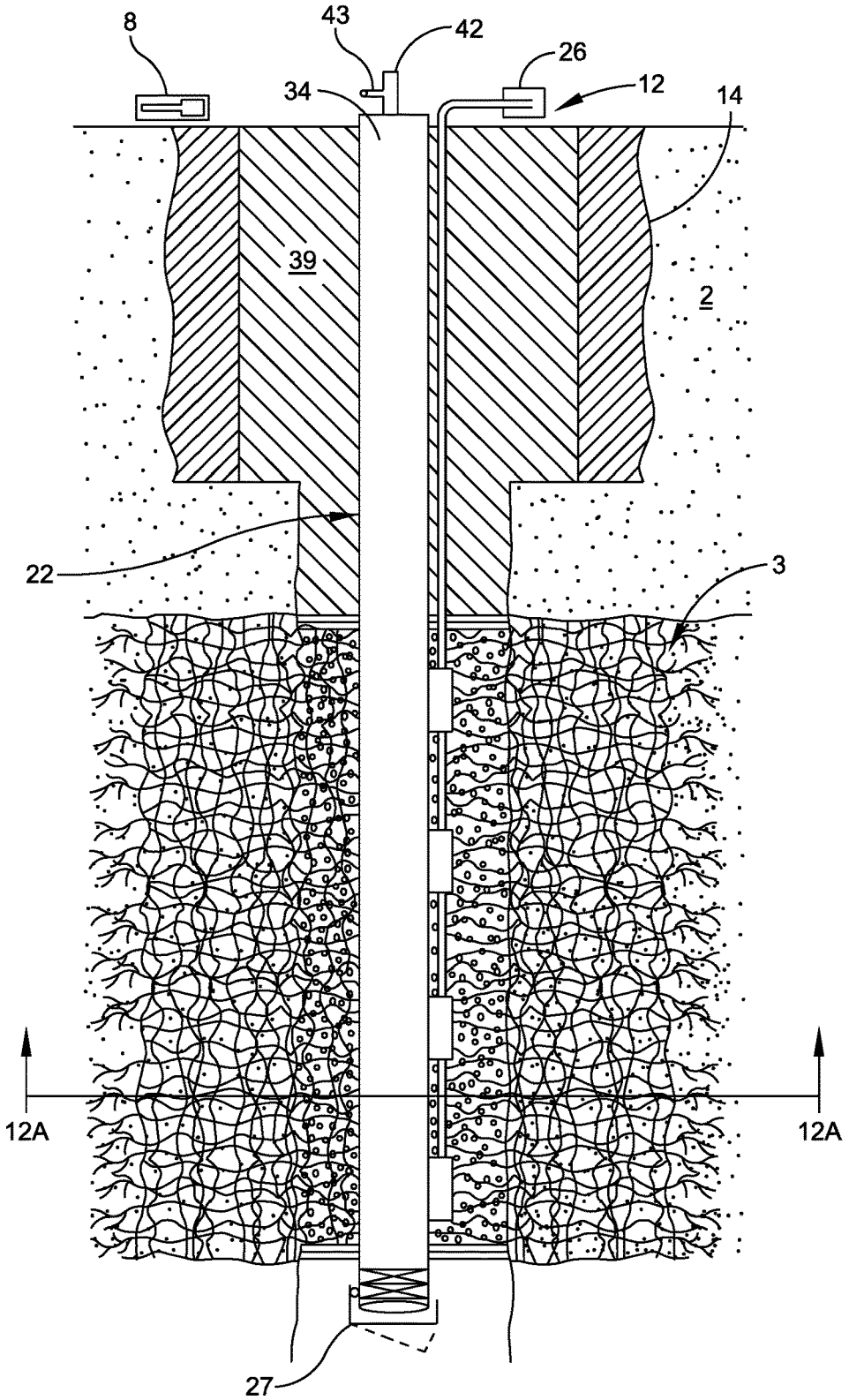
FIG. 12 shows a cross-sectional view of the vertical well and subsurface sedimentary formation of FIG. 10 after detonation of each of the detonators.
Figure 12A:
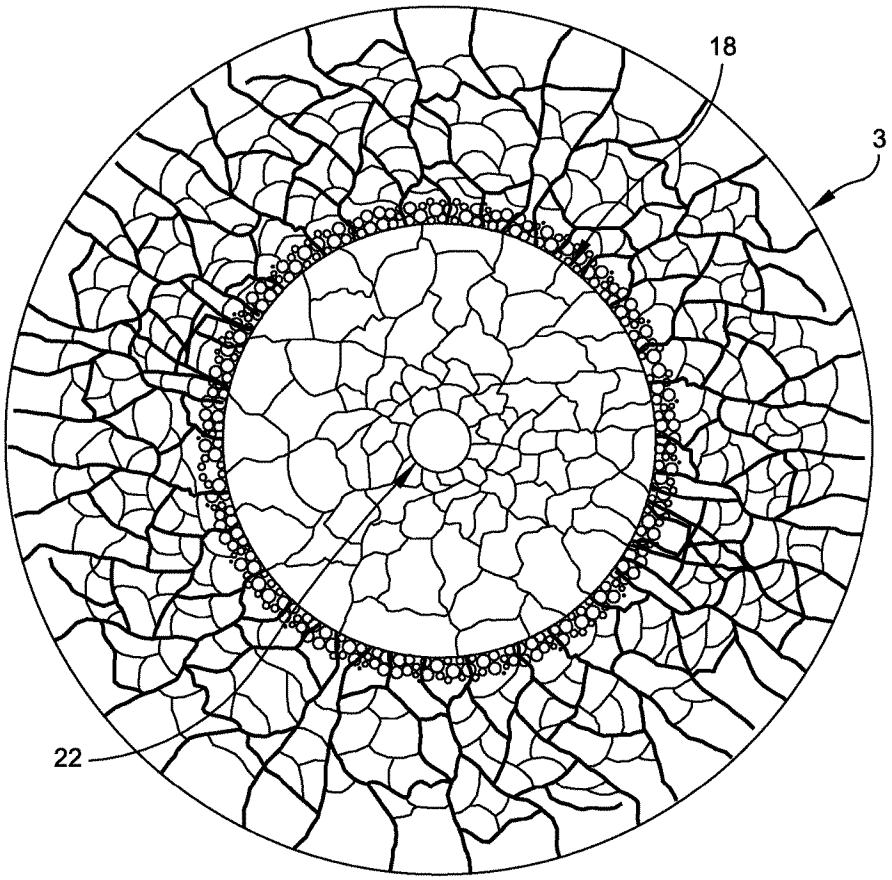
FIG. 12A shows a cross-section taken along section line 12A-12A of FIG. 12 showing the fracture, perforations, crack and crack patterns, fragments and fragment patterns formed by the detonation of the blasting material.

FIGS. 11 and 12 show the progression of the crack and fragmentation pattern 53 in the subterranean (e.g., hydrocarbon bearing) formation 3 after detonation of the detonators 24. FIG. 11 shows the state at an intermediate time by which some, but not all, of the detonators 24 have been detonated. FIG. 12 shows the crack and fragmentation pattern 53 after each of the detonators have been detonated. This process is substantially similar to that described above with respect to the FIGS. 1-9, the details of which are not repeated, for purpose of brevity. FIG. 12A shows a cross-section along section line 12A-12A of FIG. 12 and illustrates the crack 52 and crack pattern 53, fragments 54, and fragmentation pattern 55 after detonation of the explosive material.

Figure 13:
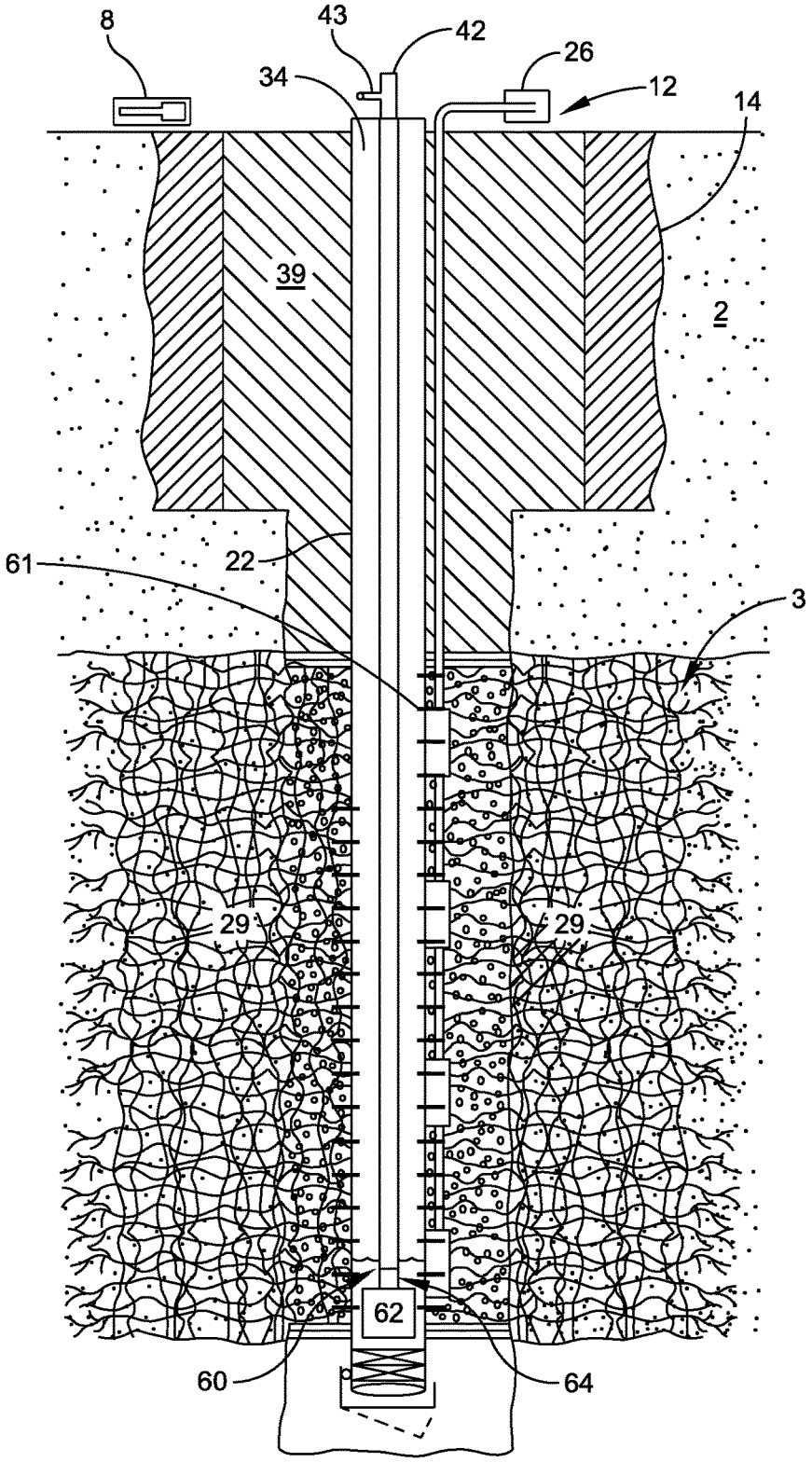
FIG. 13 shows a cross-sectional view of the vertical well and subsurface sedimentary formation of FIG. 10 after perforation of the tubular and submersible pump to produce free hydrocarbon reserves.

FIG. 13 shows the vertical well after perforation of the casing 22. A submersible pump 62 has been positioned within the casing 22 to extract the freed hydrocarbons in the hydrocarbon bearing formation 3.

FIGS. 1-13 show horizontal and vertical well bore configurations. These are exemplary, and do not limit the range of well bore configurations. Also, the specific configurations of the apparatus shown in FIGS. 1-13 are only exemplary and not limiting. For example, some embodiments use more than one detonator string arranged parallel to the central longitudinal axis of the well bore, at various circumferential positions around the tubular. A circumferential distribution of detonators can ensure that the explosive material surrounding the tubular is evenly detonated, so that the longitudinal compression waves are in phase with each other around the circumference, and do not destructively interfere with each other.

Hydraulic Fracturing Outside Casing

Figure 14:
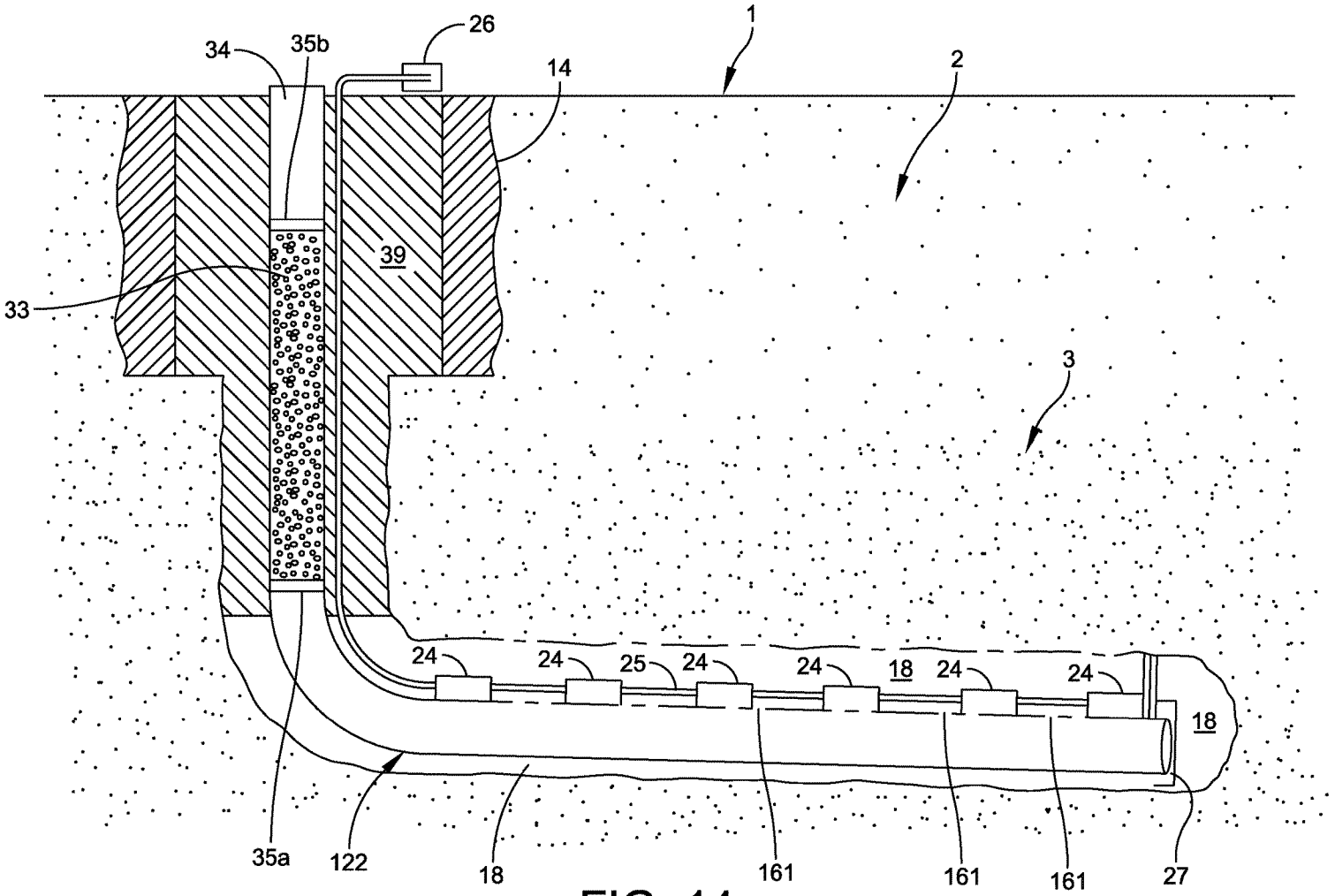
FIG. 14 shows a cross-sectional view of a pre-perforated production casing disposed in a horizontal well.
Figure 15:
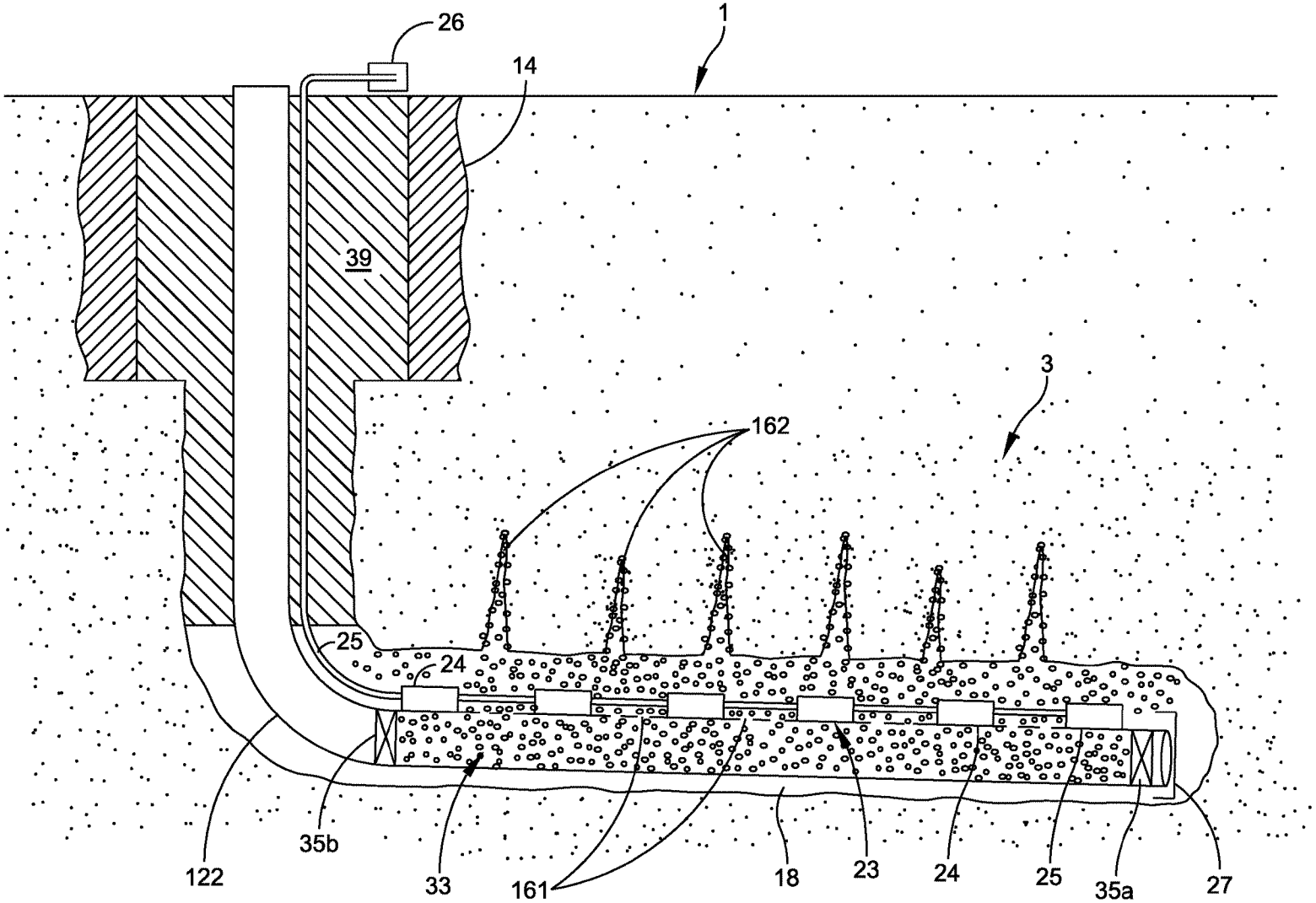
FIG. 15 shows a cross-sectional view of the well and production casing of FIG. 14 after the hydraulic fracturing of the hydrocarbon bearing formation with the slurried blasting material.
Figure 16:
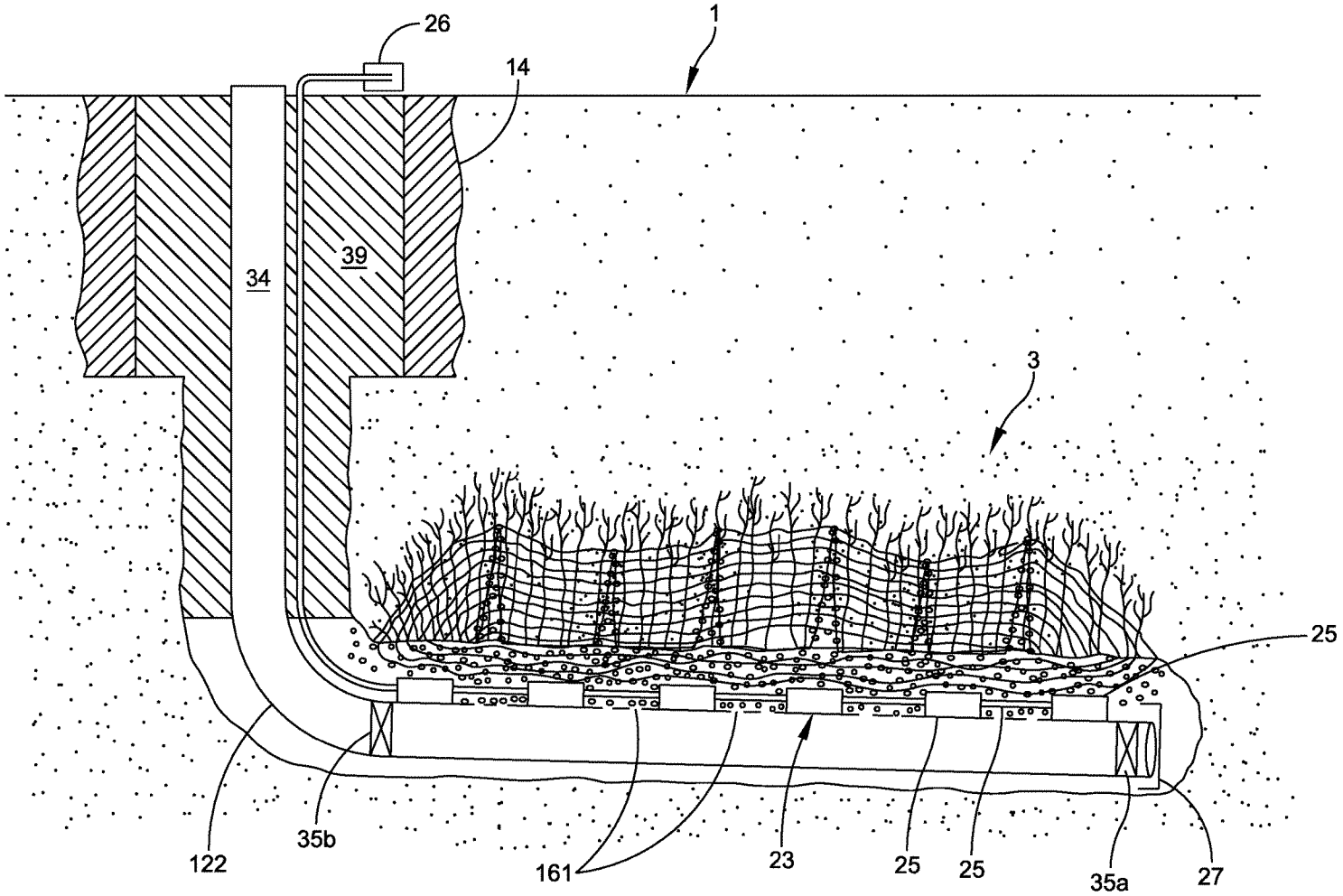
FIG. 16 shows a cross-sectional view of the well and production casing of FIG. 14 after detonation of the slurried blasting material.

FIG. 14-16 show an embodiment in which the first fluid including the first explosive is first pumped into the annulus along at least a portion of the selected formation at a pressure sufficient for hydraulic fracturing of the formation, and then the explosive fluid is detonated to increase surface area further. As shown in FIGS. 14-16, in some embodiments, a pre-perforated casing 122 having perforations 161 is inserted into the wellbore. Alternatively, the casing 122 can be inserted and the wall of the casing can be perforated using a perforating tool (not shown). The drilling rig 5, tools 6, pump 8, drill pipe 9, motor 10, drill bit assembly 11, detonators 24, electrical cables 25, control 26, bull plug 32 or bridge plug 41, spacers 35*a*, 35*b*, diverter tool 38, isolation material 39, bridge plug 41, well head 42, valve 43, and other components and features of FIGS. 14-16 can be the same as (or substantially the same as) the corresponding elements described above with respect to the embodiment of FIGS. 1-9. Additionally, casing 22 can include a tubing protector 30 as shown in FIGS. 3A-3C and can be constructed from a plurality of individual casing sections 28 connected together using fittings 29 as described above with reference to FIG. 3A. For the purpose of brevity, a detailed description of each of these components and features is not repeated with respect to FIGS. 14-16.

In the embodiment of FIGS. 14-16, the first fluid comprises a carrier (e.g., a solvent), a secondary high explosive and a proppant. The first fluid may also contain a gelling agent. The solvent and explosive 33 can be any of the examples described above with respect to FIGS. 1-13. In some embodiments, the first fluid includes a combination of fuel oil (or diesel oil) and ammonium nitrate. In some embodiments, the combination includes from 60 wt-% to 90 wt-% ammonium nitrate and from 5 wt-% to 40% fuel oil or diesel fuel. In some embodiments, the combination includes from 70 wt-% to 90 wt-% ammonium nitrate and from 10 wt-% to 30% fuel oil or diesel fuel. In some embodiments, the combination includes from 84 to 96 wt-% wt-% ammonium nitrate and from 4 wt-% to 16% fuel oil or diesel fuel. The ammonium nitrate may be in prill form. In some embodiments, a portion of the ammonium nitrate is replaced by other oxidizing salts, such as sodium nitrate or calcium nitrate or the like.

The proppant can include quartz, silica, carborundum granules, ceramics, aluminum oxide, ceramic, or other suitable particulate. The proppants can be of any appropriate size and geometry for hydraulic fracturing. The proppants maintain the width of the fractures or reduce decline in fracture width so as to prevent the fractures from closing after injection is stopped and pressure removed. In some embodiments the proppants are between 8 mesh and 140 mesh (105 μm to 2.38 mm).

Drilling fluid 7 is pumped into the casing 22. A first spacer 35*a* (shown in FIG. 14) is inserted into the tubular bore 22*a* of the casing 22, behind the drilling fluid 7. A predetermined amount of the first fluid including the first explosive 33 is inserted behind spacer 35*a*, followed by the second spacer 35*b*, and drilling fluid 34. In FIG. 14, the spacer 35*a*, the first fluid including the first explosive 33 and the spacer 35*b* are in a section of the casing adjacent to the isolation material 39, prior to the section of the casing having the detonators 24, In FIG. 15, additional drilling fluid 7 is pumped into the casing 22, pushing the first fluid including the first explosive 33 through the perforations 161 and into the annulus 18. FIG. 15 shows the result of pressurizing the first fluid including the first explosive 33 to flow out of the casing through the perforations 161 and introducing hydraulic fractures 162 in the formation 3 adjacent the locations of the perforations 161. The proppant in the first fluid keep the fractures 162 open, permitting the first explosive 33 in the first fluid to enter and remain in the fractures.

As shown in FIG. 15, hydraulic fractures can be formed in the subterranean formation 3 by pressurized pumping of the explosive material 33 through the perforations in the casing 22 (the explosive 33 is a secondary high explosive material having sufficiently low sensitivity that explosive 33 is not detonated during this pressurizing step). In addition to forming these hydraulic fractures, the explosive material 33 is deposited within these fractures. This allows the detonation of the explosive material to perforate and fragment the formation at a greater distance from the casing, as compared to hydraulic fracturing or explosion alone.

After hydraulic fracturing using the first fluid including the first explosive 33 and the proppant, the explosive material 33 is detonated to release high energy gases to more fully fragment the sedimentary formation, as shown in FIG. 16. The freed hydrocarbon, water, superheated water, or steam is extracted from the subterranean formation 3.

Fracturing/Exploding Material Outside Perforated Casing

Figure 17:
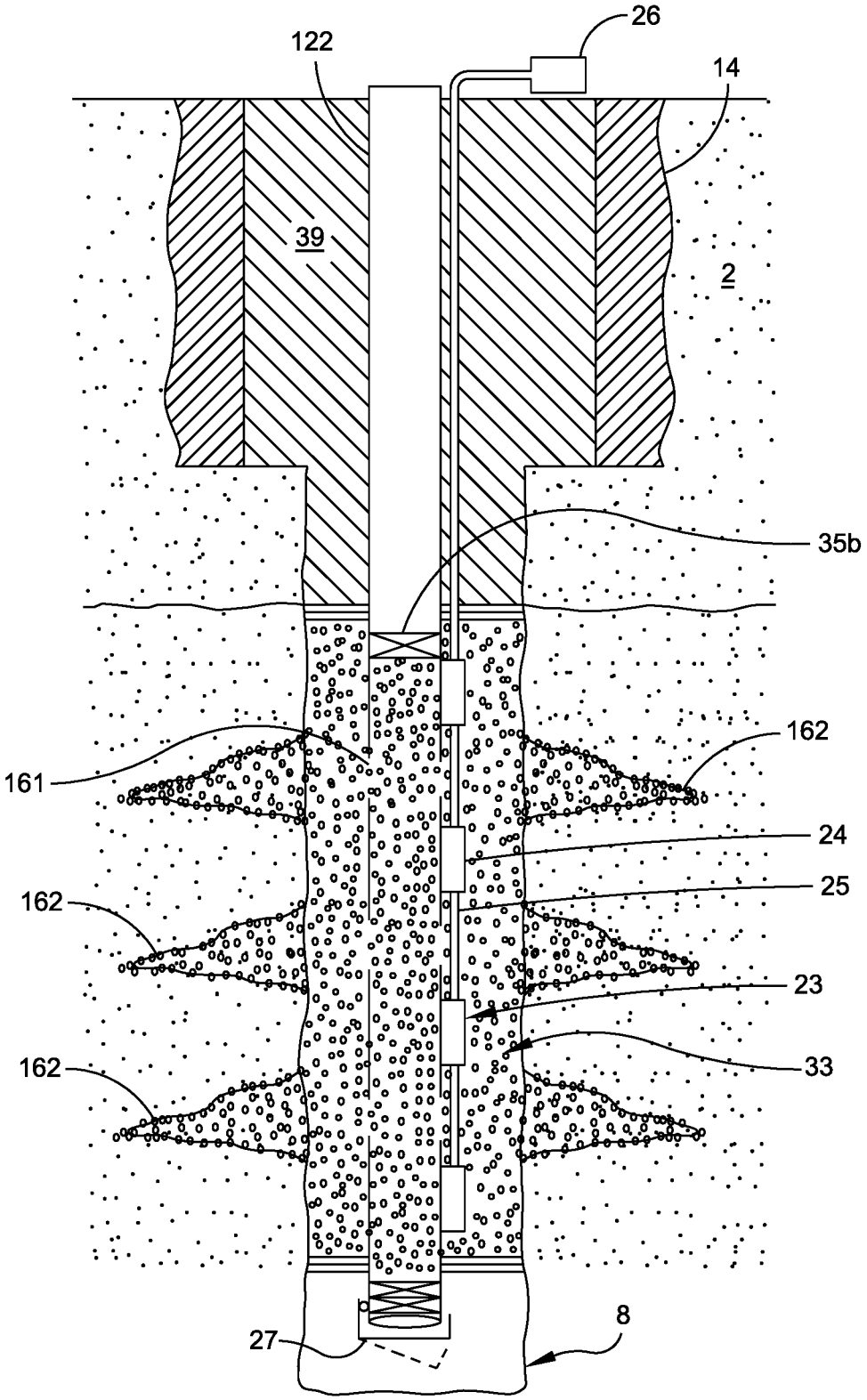
FIG. 17 shows a cross-sectional view of a pre-perforated production casing disposed in a vertical well after the hydraulic fracturing of the hydrocarbon bearing formation with the slurried blasting material.
Figure 18:
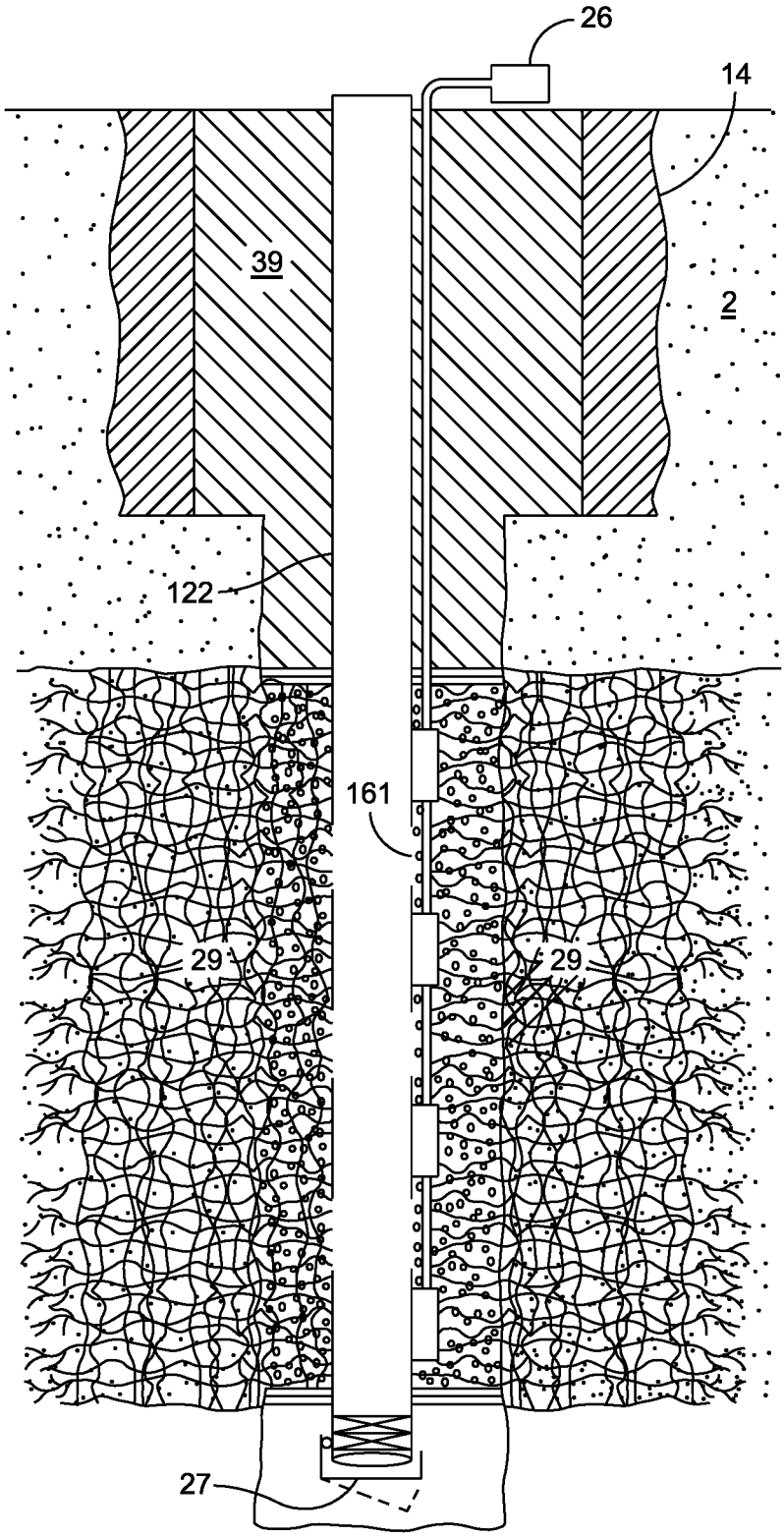
FIG. 18 shows a cross-sectional view of the pre-perforated production casing and vertical well of FIG. 17 after detonation of the slurried blasting material.

FIGS. 17-18 show an embodiment including hydraulic fracturing in a vertical well using a fracturing fluid containing explosive and proppant, followed by detonation of the explosive. The drilling rig 5, tools 6, pump 8, drill pipe 9, motor 10, drill bit assembly 11, detonators 24, electrical cables 25, control 26, bull plug 32 or bridge plug 41, spacers 35*a*, 35*b*, diverter tool 38, isolation material 39, well head 42, valve 43, and other components and features can be the same as, or substantially the same as, the corresponding elements described above with respect to the embodiment of FIGS. 1-9. For the purpose of brevity, a detailed description of each of these components and features is not repeated with respect to FIGS. 17-18.

As shown in FIG. 17, the pumping of pressurized explosive material 33 through the perforations 161 of the casing 122 causes the hydraulic fracturing of the hydrocarbon bearing formation 3 and, thereby forms cracks 162, increasing the surface area of the producing interval. After pumping of the explosive material 33, and hydraulic fracturing of the hydrocarbon bearing formation 3, the explosive material 33 can be detonated as described above to further increase the surface area of the producing interval. As shown in FIG. 18, after detonation of the explosive material 33, in the hydraulic fractures in the hydrocarbon bearing formation substantially increases the surface area of the hydrocarbon bearing formation, for increased production rates and cumulative recoveries of the hydrocarbon reserves.

Two Stage Detonation Process

In some embodiments, as shown in FIGS. 19A-19D, a two-step detonation procedure is used. The drilling rig 5, tools 6, pump 8, drill pipe 9, motor 10, drill bit assembly 11, detonators 24, electrical cables 25, control 26, one-way check valve 27, bridge plug 41, spacers 35*a*, 35*b*, diverter tool 38, isolation material 39, well head 42, valve 43, and other components and features can be the same as, or substantially the same as, the corresponding elements described above with respect to the embodiment of FIGS. 1-9. For the purpose of brevity, a detailed description of each of these components and features is not repeated with respect to FIGS. 19A-19D. Additionally, casings 22 can include two separate tubing protectors 30*a*, 30*b* of the type shown in FIGS. 3A-3B. A separate detonator string 23*a*, 23*b* is placed in each of the tubing protectors 30*a*, 30*b*, respectively. The master control 26 is capable of detonating each detonator string 23*a*, 23*b* independently from the other, to permit two separate detonation steps.

Figure 19A:
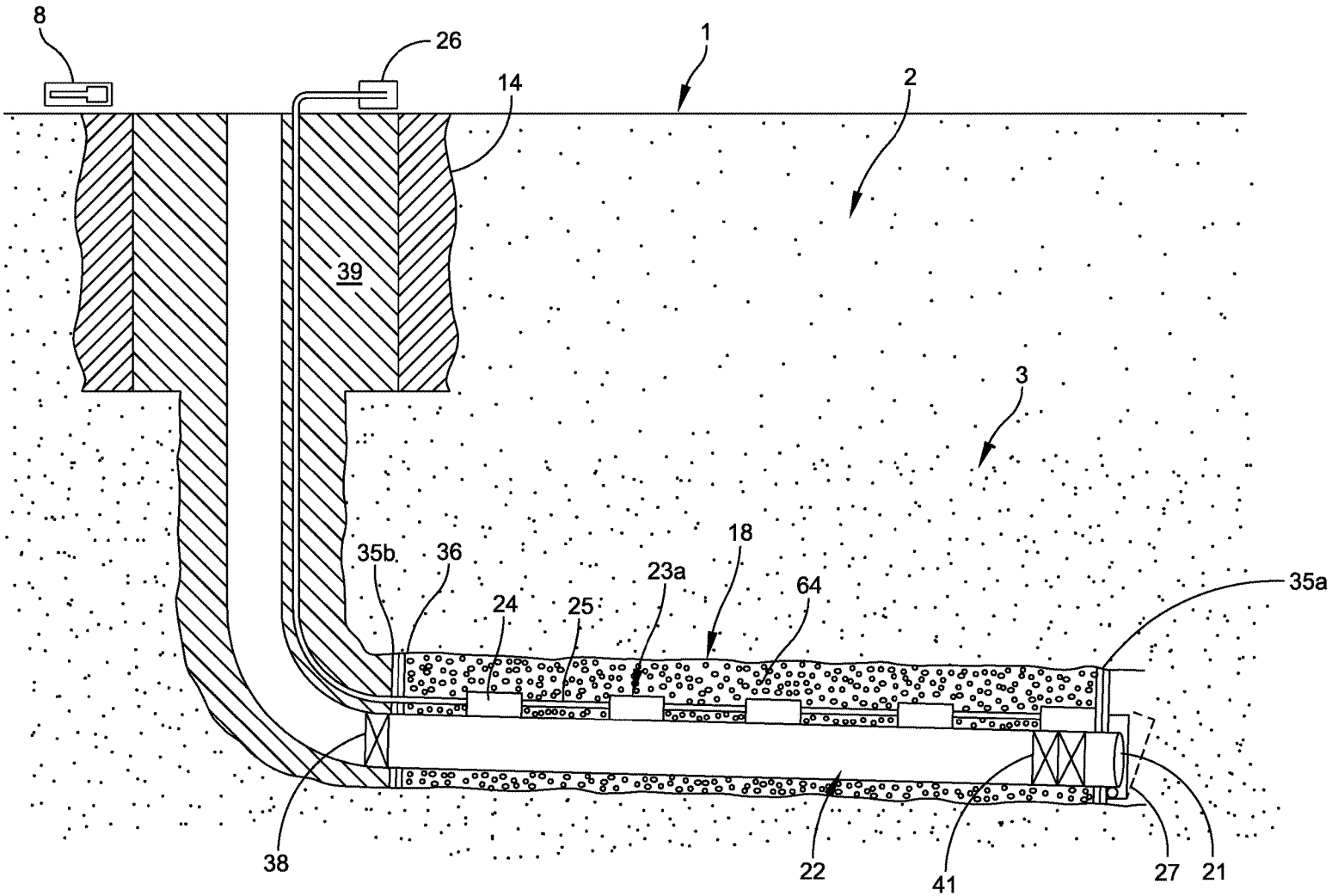
FIG. 19A is a cross-sectional view of a well bore loaded with a low explosive for the first detonation stage of a two stage method.

As shown in FIG. 19A, a tubular 22 is inserted in the well bore 16. A predetermined amount of the first fluid containing a low (first) explosive 64 is inserted in the tubular 22, followed by a spacer 34*b*. (In the discussion of FIGS. 19A-19D, the terms "first" and "second" as applied to explosives refer to chronological order, and not to the explosive characteristics of the explosive.) A low explosive 64 can detonate with an explosion time on the order of milliseconds, an explosion pressure of less than 50,000 psi and/or a flame front velocity on the order of 2000 to 5000 feet per second (lower than the speed of sound). The first explosive 64 can be smokeless powder, nitrocellulose, nitrocotton, NG, Black powder (potassium nitrate, sulfur, charcoal), or DNT (dinitrotoluene ingredient) for example. Up to this step, the procedure and arrangement can be the same as shown in FIG. 5, except that in FIG. 19A, a low explosive 64 is substituted for the secondary high explosive 33 of FIG. 5. The low explosive 64 can be included in a first fluid containing a solvent, the first explosive 64 and a proppant. The solvent of the first fluid can be water based or organic.

Figure 19B:
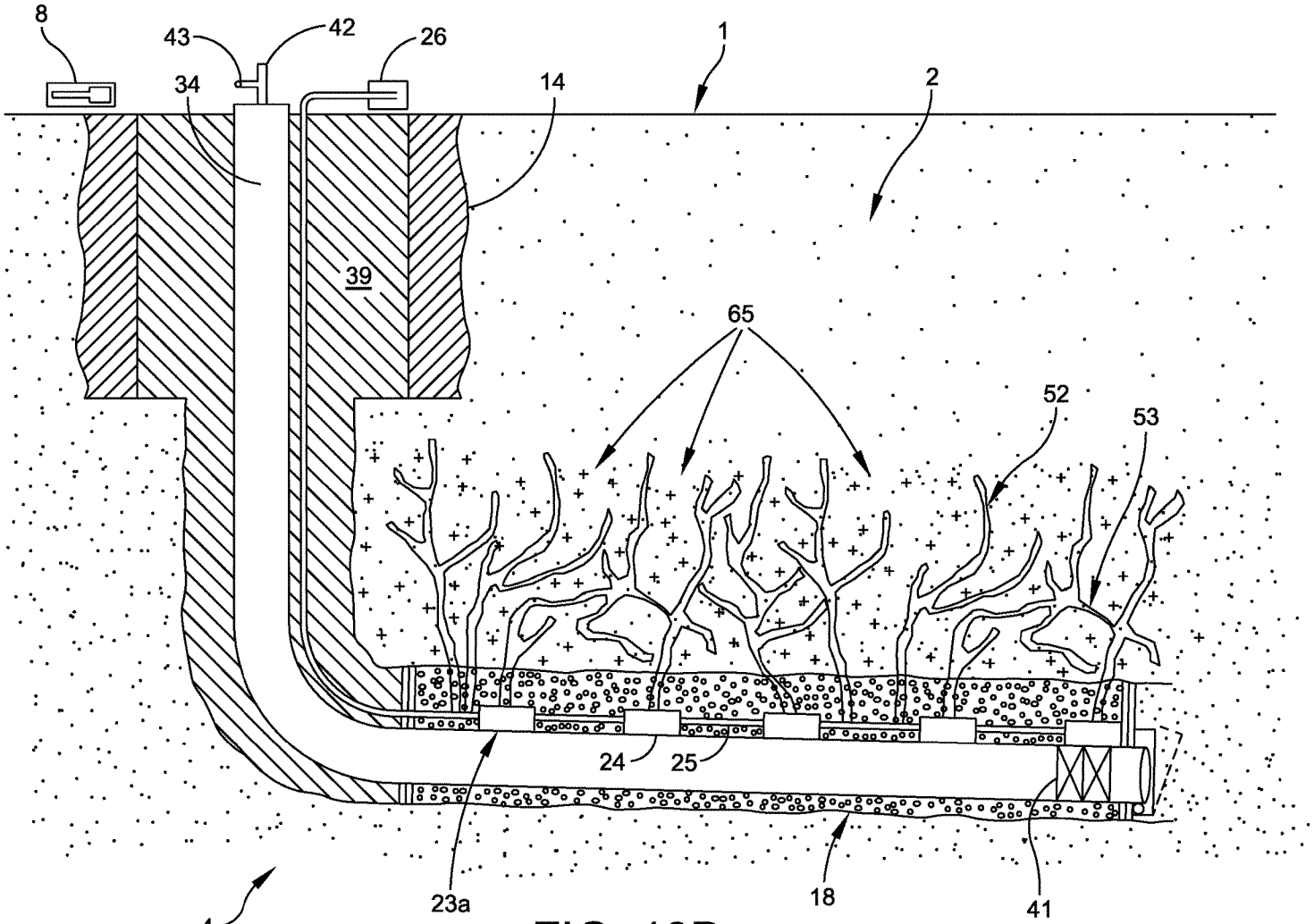
FIG. 19B is a cross-sectional view of the well bore of FIG. 19A after detonation of the low explosive.

As shown in FIG. 19B, a first string 23*a* of detonators 24 is detonated, detonating the first explosive 64. The detonation of the first explosive creates a low velocity compression wave front 65, which creates cracks 52 and crack patterns 53 as shown in FIG. 19B. The tubing protectors 30*a*, 30*b* are configured so that detonation of the first explosive by detonator string 23*b* directs explosive gasses into the annulus and towards the subterranean formation 3 without detonating or damaging the second string 23*b* of detonators. In an alternative embodiment, the casing has a single protector 30 covering the second string of detonators 23*b*, the first string 23*a* of detonators is exposed to the first explosive.

Figure 19C:
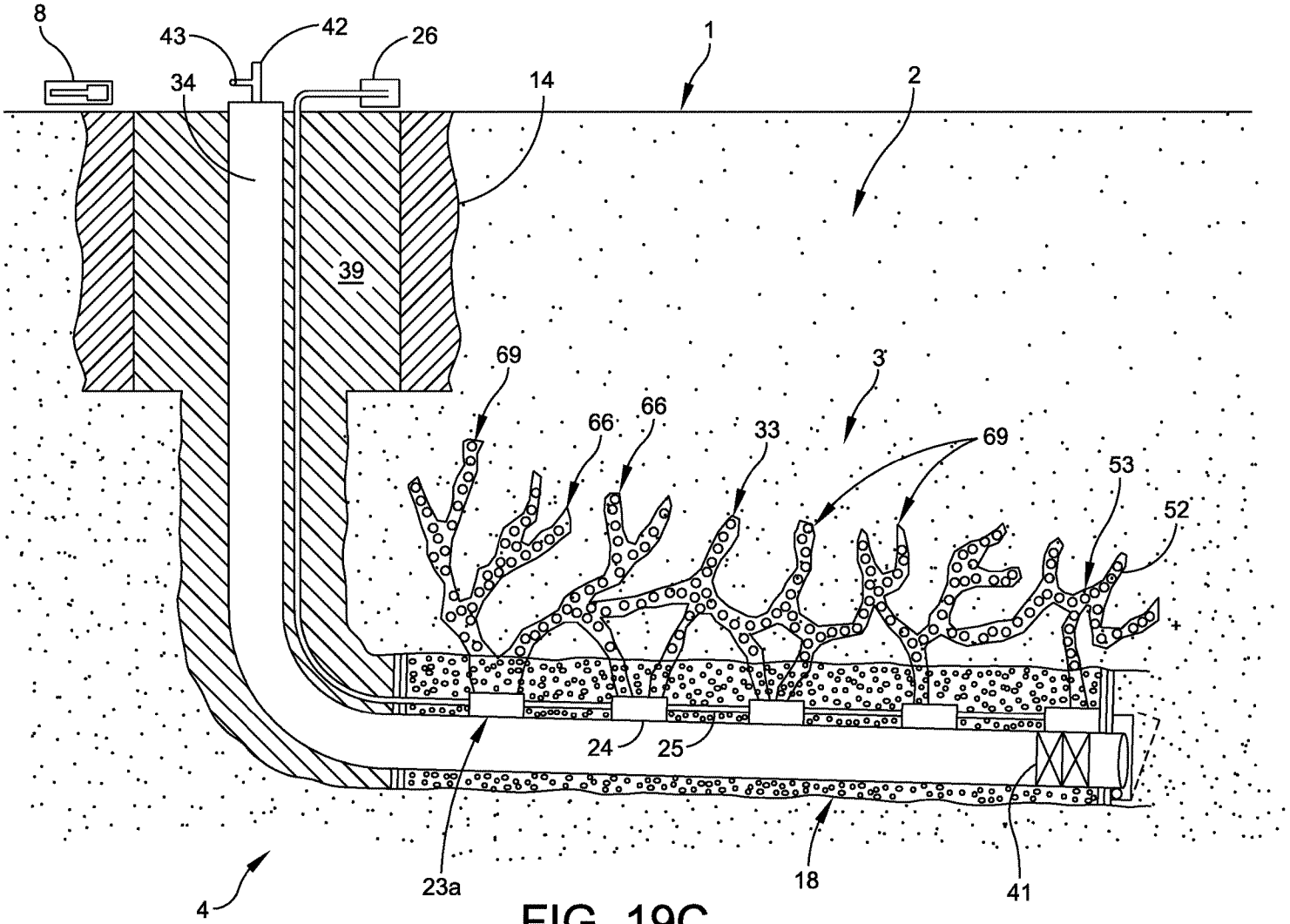
FIG. 19C is a cross-sectional view of the well bore of FIG. 19B after inserting a high explosive into the well bore for the second detonation stage of the two stage method.

As shown in FIG. 19C, the bridge plug 41 is removed, and a second fluid containing a predetermined amount of a high (second) explosive is inserted in the casing 22. The second explosive has a higher explosion pressure than the first explosive. Drilling fluid is pumped into the casing, to push the second explosive out through the check valve 27 at the distal end 21 of the casing 22 and into the annulus 18, filling the cracks of FIG. 19B. The second fluid and the second explosive of FIG. 19C can be the same as any the fluid described above with respect to the first fluid and first explosive 33 described above with reference to FIGS. 1-9.

Figure 19D:
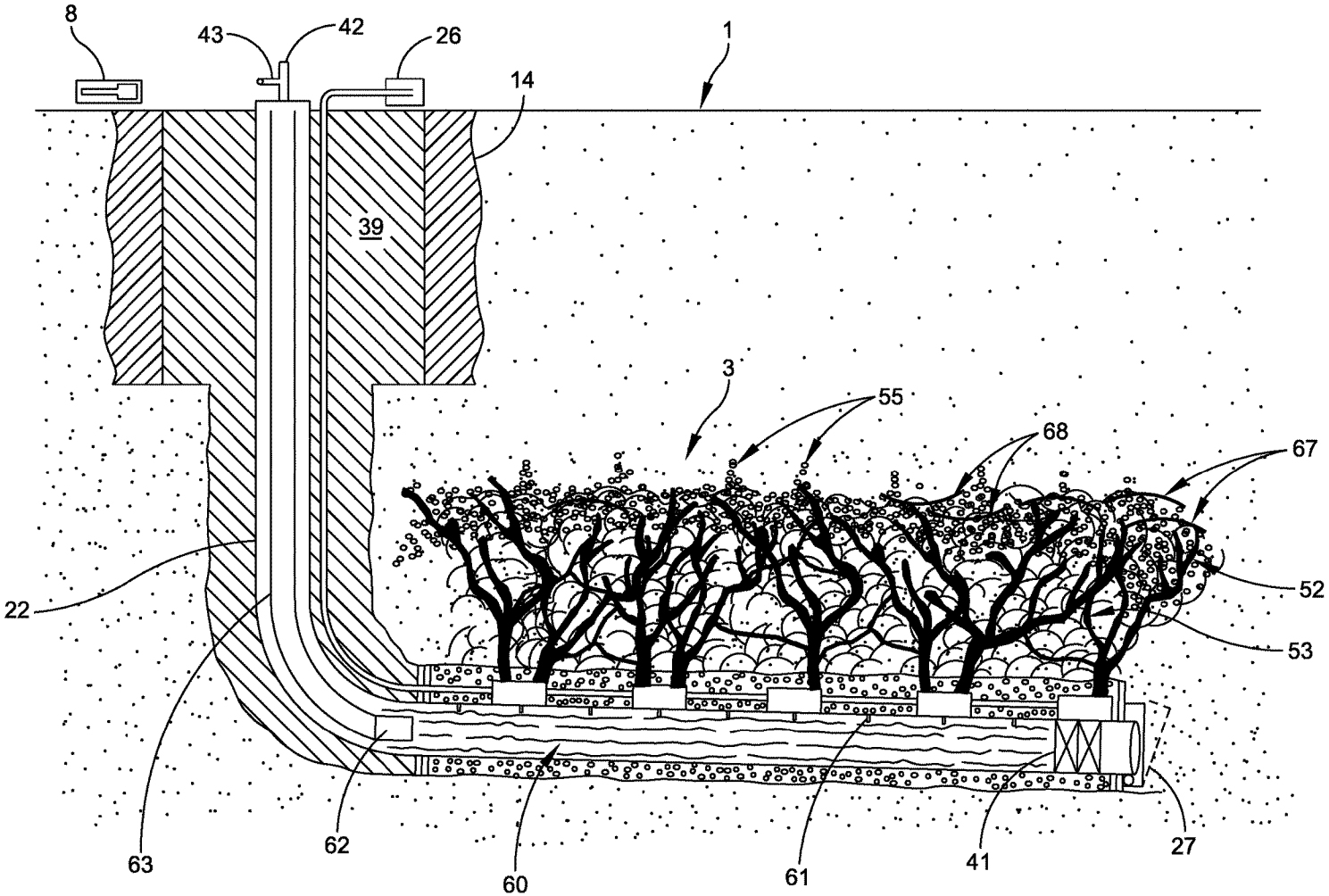
FIG. 19D is a cross-sectional view of the well bore of FIG. 19C after the second detonation stage of the two stage method.

As shown in FIG. 19D, detonation of the second detonator string 19*b* creates a compressive, high velocity wave front that fractures and increases the surface area of the subterranean formation 3. Also, a perforating tool 47 (e.g., a perforating gun, as discussed above with respect to FIG. 8) is used to perforate a portion of the casing 22 to establish communication with the free hydrocarbon, water, superheated water, or steam. A pump 62 and production tubing 63 can be inserted into the casing 22, and the hydrocarbon, water superheated water, or steam is pumped to the surface 1.

Selective Fracturing Before Detonation

In one embodiment, shown in FIGS. 20-26, the operator can perform hydraulic fracturing in multiple stages prior to detonating an explosive in the cracks and interstices formed by the hydraulic fracturing. The hydraulic fracturing is performed using a first fluid containing a first fluid containing a first explosive and a proppant.

Figure 20:
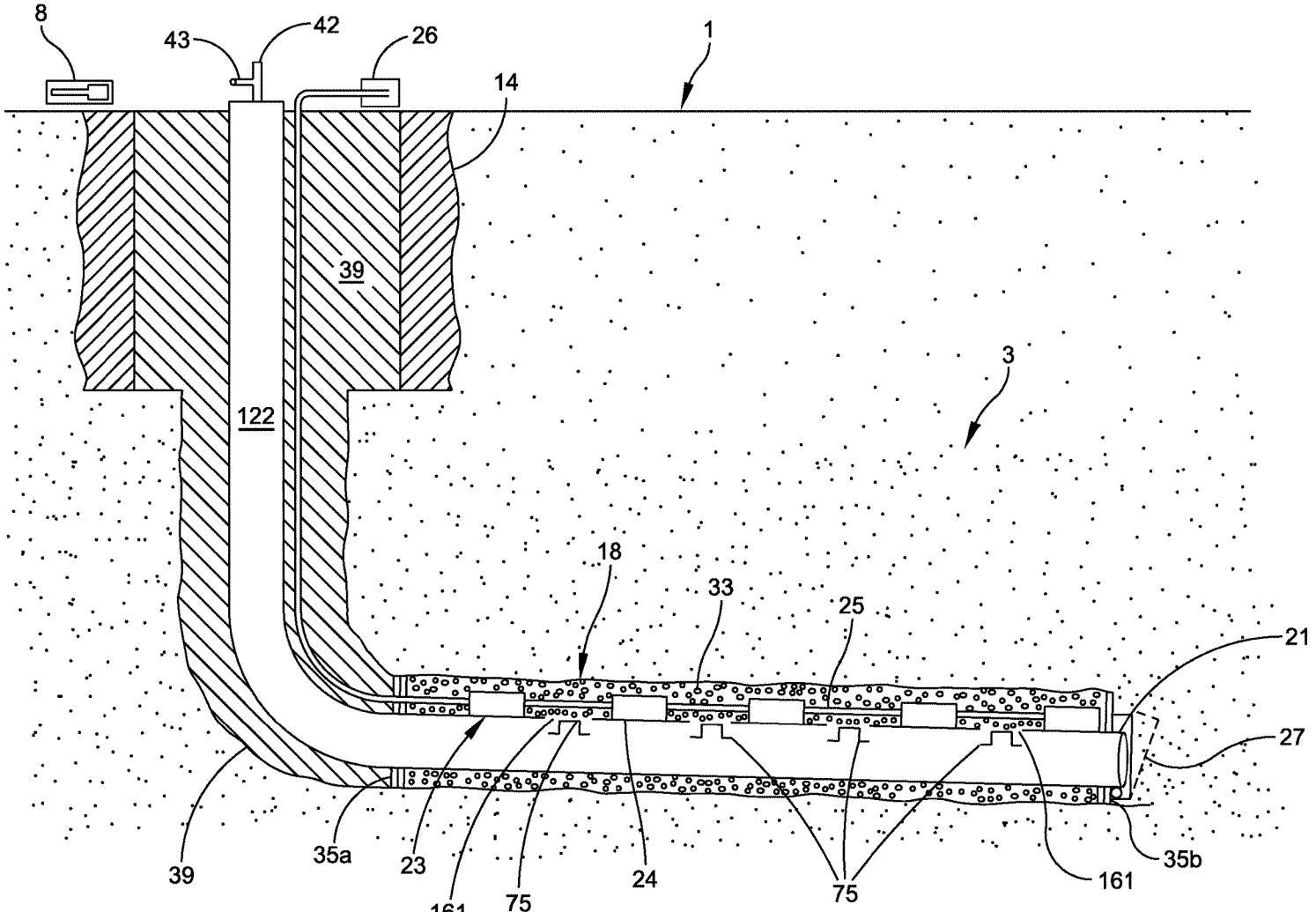
FIG. 20 shows a pre-perforated production casing disposed in a horizontal well, the production casing including insert caps configured to seal the perforations.

FIG. 20 shows a pre-perforated casing with perforations 161. In some embodiments, insert caps 75 may be placed within the perforations to seal the perforations 161 and prevent contamination of the drilling fluid during insertion of the casing 122 into the well bore, and ensure proper sealing of fracking balls in the perforations, as discussed below. The insert caps 75 are configured to rupture or become dislodged from the perforations when there is a predetermined pressure difference between the annulus 18 and the casing bore of the casing 122, exposing the perforations. As shown in FIG. 20, prior to pumping of the first fluid including the first explosive 33 into the annulus 18, isolation material 39 is positioned from the spacer 35*b* at the proximal end of the first fluid to the surface 1 to encapsulate the casing. A diverter tool 38 can be used to place the isolation material 39, as described above in the description of FIG. 5. The first fluid having the first explosive 33 can be pumped through the casing 122 and out through the distal end 21 of the casing into the annulus 18, as described with reference to the embodiment of FIGS. 1-9.

The drilling rig 5, tools 6, pump 8, drill pipe 9, motor 10, drill bit assembly 11, detonators 24, electrical cables 25, control 26, check valve 27, spacers 35*a*, 35*b*, diverter tool 38, isolation material 39, bridge plug 41, well head 42, valve 43, and other components and features can be substantially similar in function and operation to the corresponding elements described above with respect to the embodiment of FIGS. 1-9. Additionally, casings 122 can include bull plugs and tubing protectors as shown in FIGS. 3A-3B and can be constructed from individual casing sections connected together at fittings as described with reference to those figures. For the purpose of brevity, a detailed description of each of these components and features is not repeated with respect to FIGS. 21-26.

Figure 21:
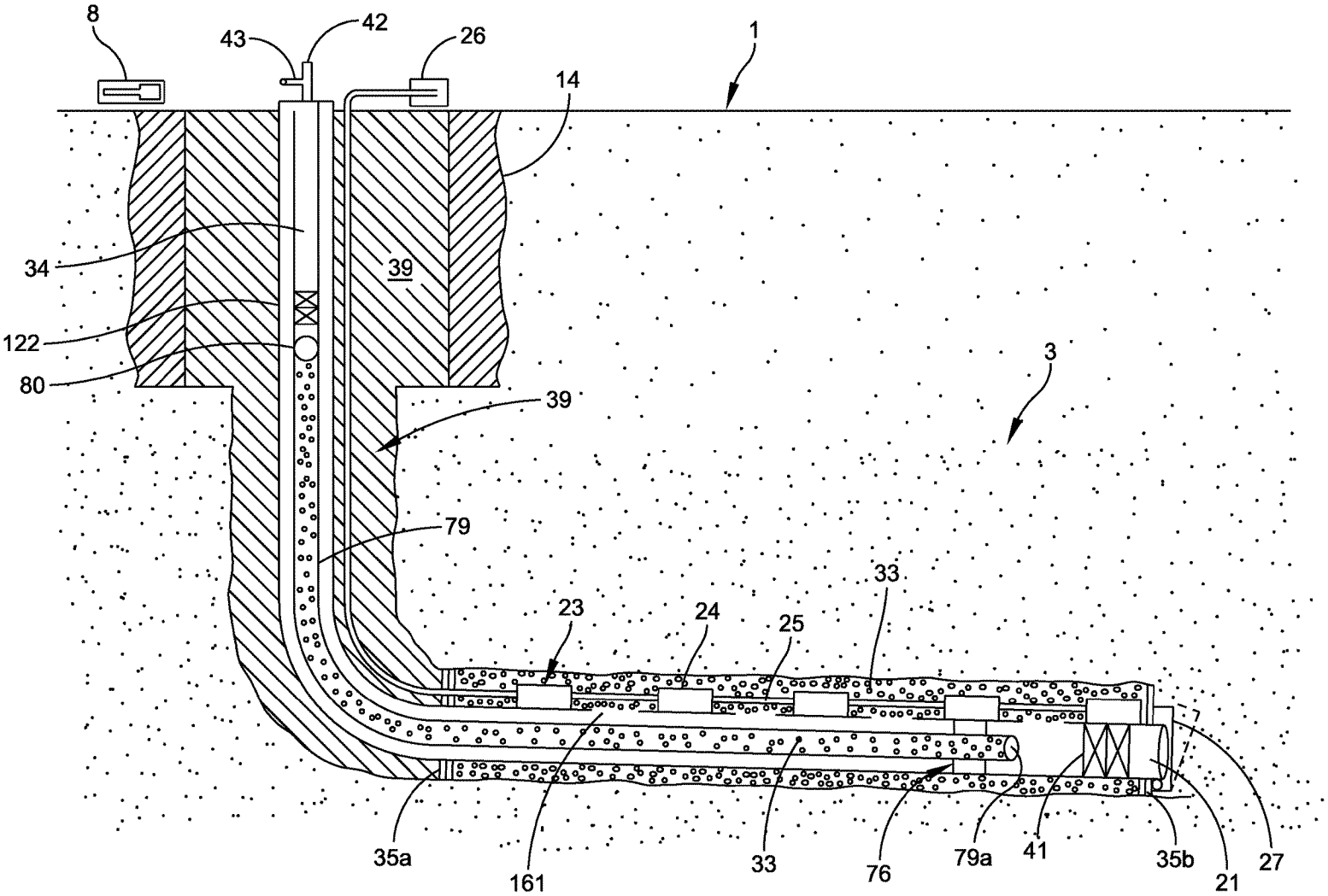
FIG. 21 is a longitudinal cross-section of a horizontal well with a production casing disposed therein and a blasting material disposed within a tube.
Figure 22:
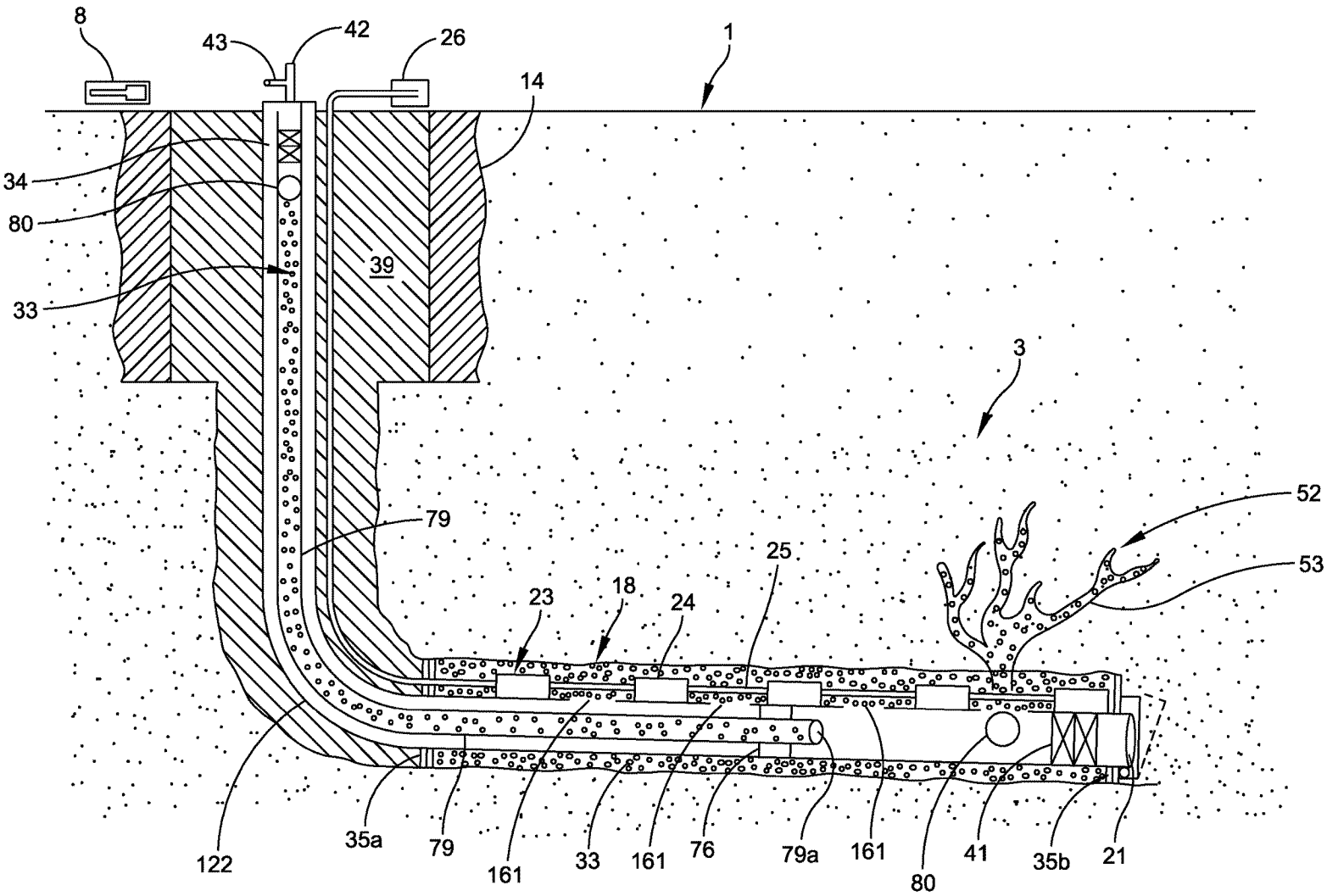
FIG. 22 is a longitudinal cross-section of the well and production casing of FIG. 21 after injection of blasting material through a first perforation and first stage of hydraulic fracturing of the hydrocarbon bearing formation with the slurried blasting material.

As shown in FIG. 21-22, a tubular, such as a work string tubing 79, is disposed within the pre-perforated casing 122. The work string tubing 79 is positioned within the casing bore such that a distal end of the work string tubing 79 is located adjacent to a first set of perforations 161 formed in the casing 122. The perforations 161 are located in the first annular zone (between the spacer 35*b* and the distal end 21 of the casing 122). The work string tubing 79 can be inserted, moved, and removed using a wire line or a slickline. A retrievable packer 76 provides a means for forming a reliable hydraulic seal to isolate the inside of the casing 122 from the annulus 18. The packer 76 can be a seat/release packer, for example. In the example of FIGS. 21 and 22, the packer 76 is used to seal one of the perforations by means of an expandable elastomeric element.

As shown in FIGS. 21-22, a sealant tool, such as a ball 80 can be delivered to the location of one or more perforations to be sealed by placing the ball 80 in the work string tubing 79, placing a spacer or wiper tool 35 behind the fracking ball, and pushing the spacer 35 and fracking ball down the work string tubing 79 by pumping drilling fluid 34 behind the spacer 35. Balls 80 seat themselves in any open perforation between the position of the packer 76 and the distal end of the casing 122.

A seat/release packer 76 is disposed at the open distal end of the tube 79. The seat/release packer 76 seals against the casing 122 to prevent the flow of the first fluid from the distal end 79*a* of the work string tube 79 through the casing 122 in the proximal direction 52 during subsequent hydraulic fracturing. The seat/release packer 76 is positioned in the proximal direction relative to the perforation(s) through which the first fluid is to be delivered for hydraulic fracturing of the adjacent portion of the subterranean formation 3. As shown in FIG. 21, the work string tube 79 can be inserted such that the distal end 79*a* is between the most distal perforation and the most proximal perforation to select one or more of the perforations as hydraulic fracturing locations. In the position of FIG. 21, the distal end 79*a* of the work string tubing is positioned so that the first fluid is only delivered to a single perforation.

FIG. 22 shows the system at a subsequent time after pressurized drilling fluid from the distal end 79*a* of the work string tubing 79 hydraulically fractures the subterranean formation 3 at the location of the most distal perforation 161.

As shown in FIG. 22, the first fluid (including the explosive and proppant) is pumped out through the tube 79 and through any open perforation 161 in the casing 122 between the end of the casing 122 and the seat/release packer 76. The first fluid hydraulically fractures the subterranean formation around the open perforation 161. After pumping of the first explosive through the perforations 161, a ball 80 or sealant tool 80 seals the perforations to isolate the explosive material in the formation. The ball or sealant tool 80 can be in the form of a ball or plug configured to engage the perforations 161 and prevent the flow of material therethrough. The ball can comprise metal or an elastomer. When the fracturing of the most distal perforation 161 is completed, a self-seating ball 80 is fed through the work string tubing 79 and seats in the perforation 161, forming a seal. For example, the balls 80 can be "DCM™" degradable composite metal frac balls, manufactured by Bubbletight, LLC of Needville, Tex. If the operator only wishes to hydraulically fracture at the location of one perforation, the work string tubing 79 can be removed at this point, to prepare for detonation.

Figure 23:
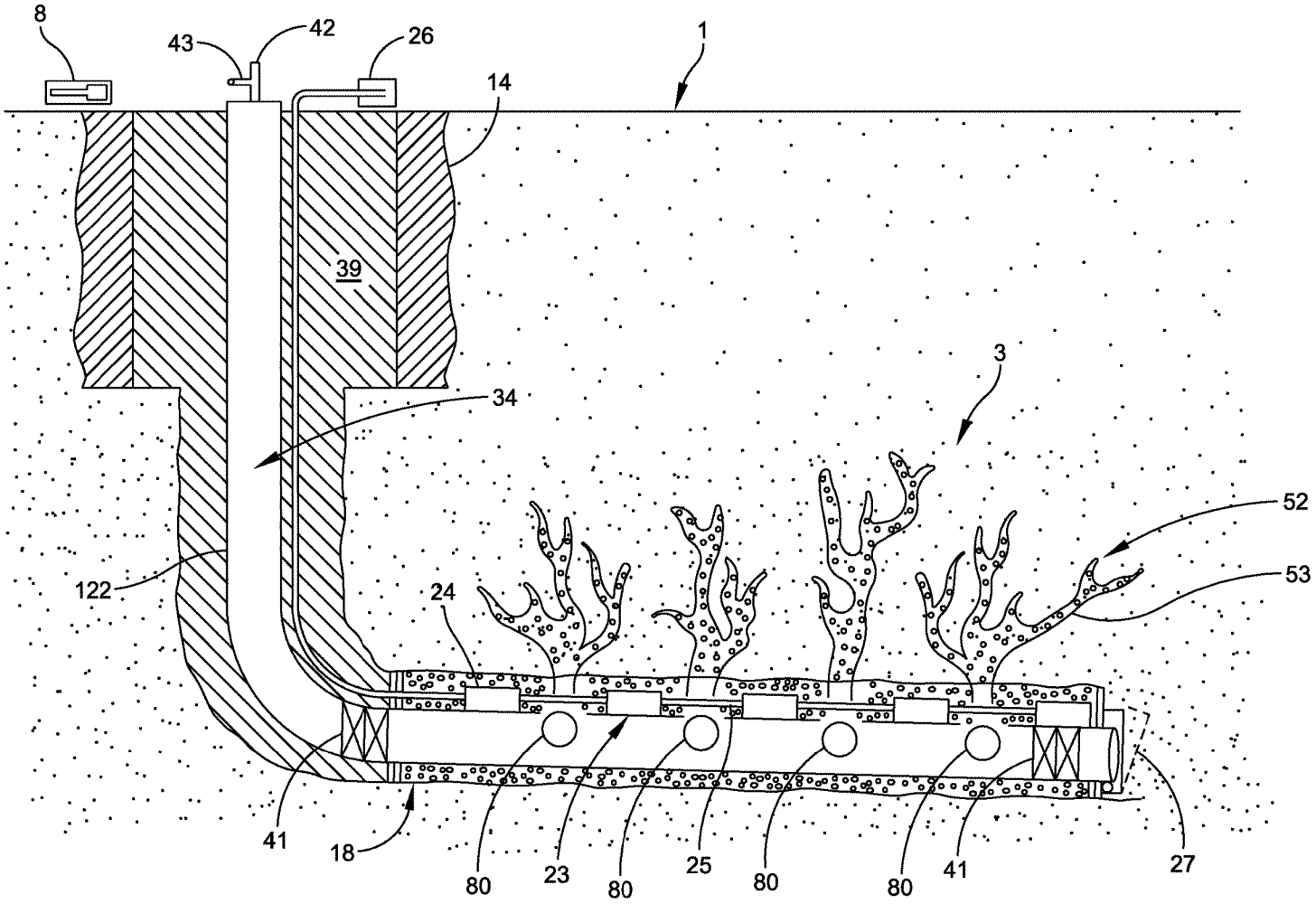
FIG. 23 is a longitudinal cross-section of the well and production casing of FIG. 21 after injection of the blasting material in additional stages of hydraulic fracturing of the hydrocarbon bearing formation with the slurried blasting material.

Alternatively, hydraulic fracturing can be performed at the locations of one or more additional perforations. FIG. 23 shows the subterranean formation 3 after hydraulic fracturing has been performed at the locations of four perforations with the first fluid, and balls 80 have seated in each of the perforations. In this step, fracturing at the locations of the three perforations can be performed individually, the first and second followed by the third, the first followed by the second, or the first, second and third simultaneously.

As shown in FIG. 23, after substantially all of the explosive material 33 has been pumped into the formation 3 in a selected number of stages, a second bridge plug 41 is inserted into the casing 122 to isolate the portion of the casing 122 near the explosive material 33.

Figure 24:
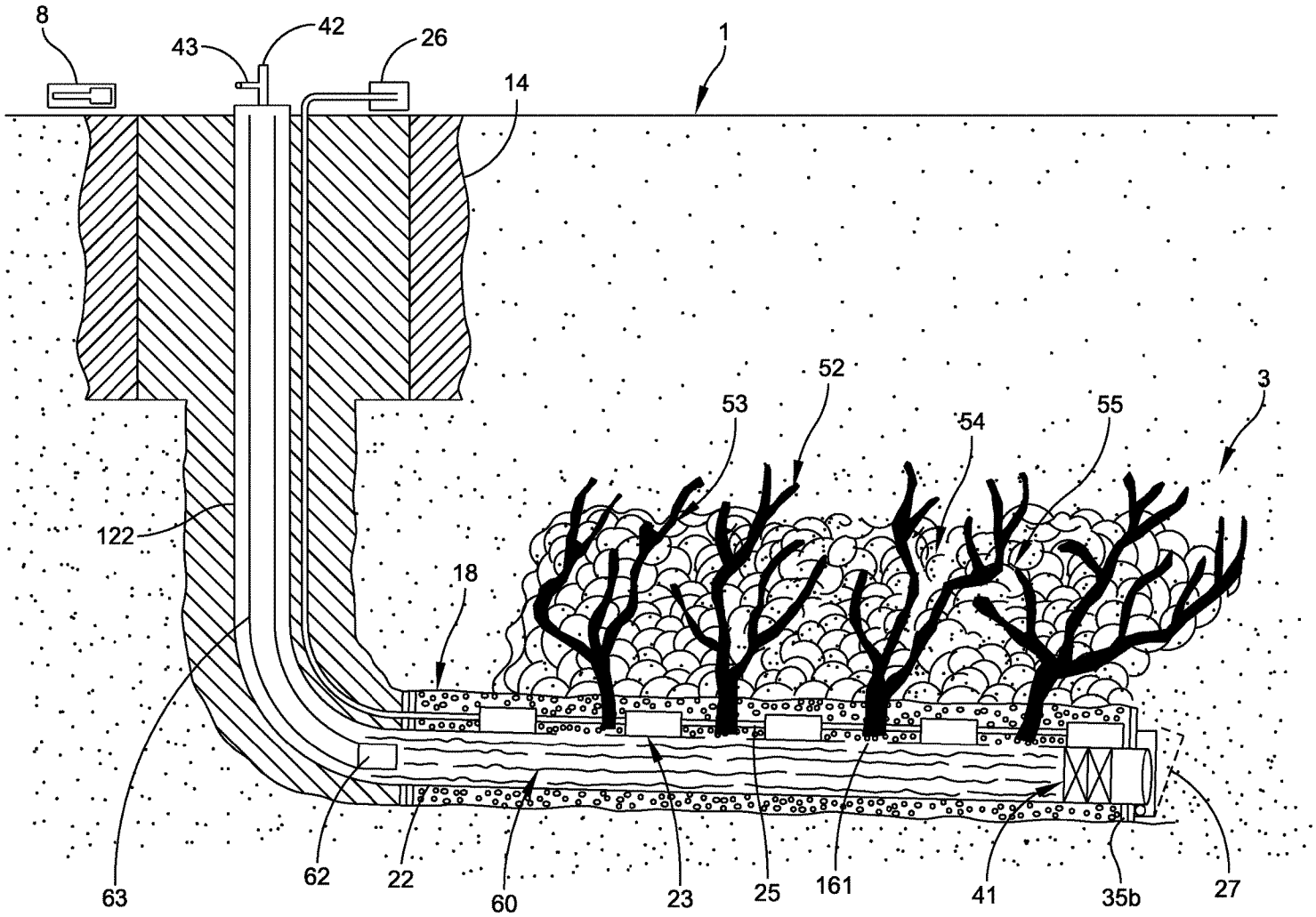
FIG. 24 is a longitudinal cross-section of the well and production casing of FIG. 21 after detonation of the blasting material, placement of a submersible pump and production of the freed hydrocarbon reserves.

Subsequently, the first explosive 33 is detonated using the detonators 24, as described above, to create cracks 52 and crack patterns 53 in the formation 3 to increase the effective surface area thereof. The hydrocarbon, water, superheated water, or steam can then be extracted using pump 62, as shown in FIG. 24. With the explosive material 33 disposed in the annulus 18, the detonators 24 can be detonated in any sequence, as described above. The detonation of the explosive material 33 causes additional fracturing of the subterranean formation 3. As a result, the freed hydrocarbon, water, superheated water, or steam is able to pass into the tubular bore 22*a* of the casing 122 for extraction by a pump, as described above.

Fracturing at Weakest Point in Formation

Figure 25:
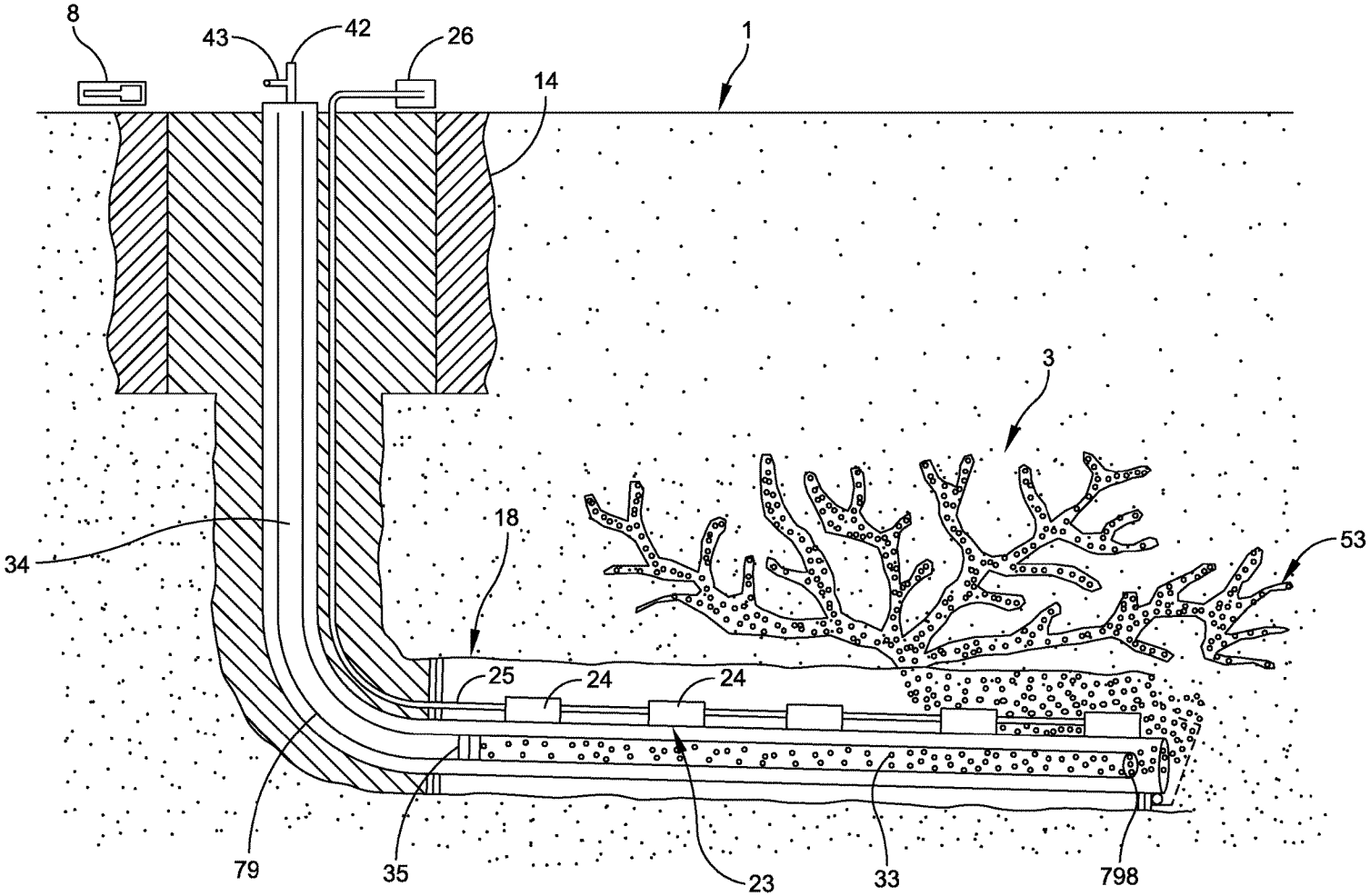
FIG. 25 is a longitudinal cross-section of a horizontal well and production casing with a well bore disposed therein and injection of the blasting material and hydraulic fracturing of the sedimentary formation with the slurried blasting material.
Figure 26:
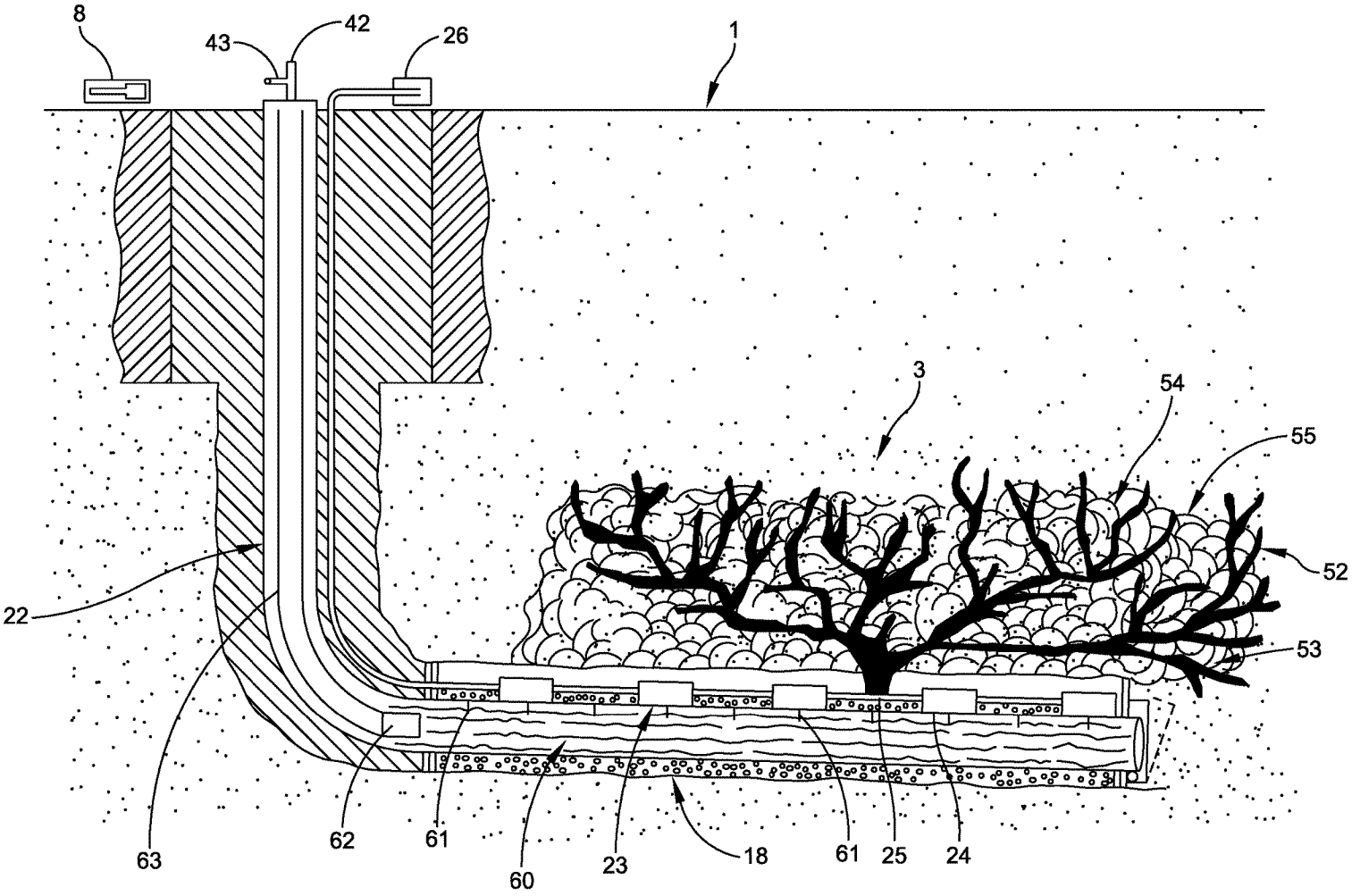
FIG. 26 is a longitudinal cross-section of the well and production casing of FIG. 25 after detonation of the blasting material.

In another embodiment, shown in FIGS. 25 and 26, the first fluid including the first explosive 33 and proppant hydraulically fractures the weakest areas of the subterranean formation 3 when the explosive material is pumped through the distal end 21 of the tubular 22. The hydraulic fracturing occurs when the pressure of the first fluid including the explosive material 33 exceeds the fracture gradient of the subterranean formation 3. The size and orientation of the hydraulic fractures is dependent on the amount of first fluid material placed in the subterranean formation 3.

FIG. 25 shows the system configuration during the hydraulic fracturing. The drilling rig 5, tools 6, pump 8, drill pipe 9, motor 10, drill bit assembly 11, detonators 24, electrical cables 25, control 26, check valve 27, spacers 35*a*, 35*b*, diverter tool 38, isolation material 39, well head 42, valve 43, and other components and features can be substantially similar in function and operation to the corresponding elements described above with respect to the embodiment of FIGS. 1-9.

Figure 25A:
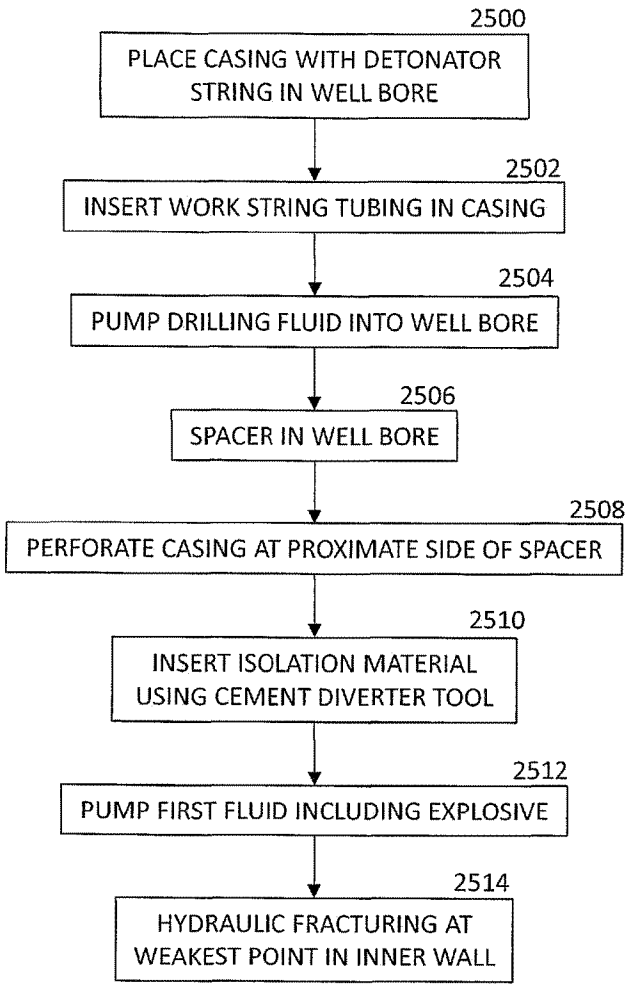
FIG. 25A is a flow chart of the method used in the well of FIG. 25.

As shown in FIG. 25A, at step 2500, prior to the hydraulic fracturing step of FIG. 25, the production casing 22 with the string 23 of detonators 24 is placed in the well bore 16. At step 2502, a work string tubing 79 is inserted in the casing. At step 2504, drilling fluid 7 is pumped into the well bore 16, followed by a spacer 35*a* at step 2506. At step 2508, the casing 22 is perforated at the proximate side of the spacer, and at step 2510, the isolation material 39 is inserted using the cement diverter tool (not shown in FIG. 25). FIG. 25 shows the hydraulic fractures formed by the first fluid including the first explosive 33 as it is pumped (step 2512) through the distal end 798 of work string tubing 79 into the distal end of casing 22 (which may have a check valve 27 permitting one-way flow) into the annulus 18 of the wellbore 16. At step 2514, as the pump 8 increases the pressure of the first fluid, the first fluid causes hydraulic fracturing at the weakest point in the inner wall of the well bore 16. In this example, the location of the fracturing may not be a predetermined location, as there is no need to know in advance the location of weakest point, where fracturing occurs first.

FIG. 26 shows the cracks 52, crack patterns 53, fragments 54 and fragment patterns 55 formed by the detonation of the first explosive 33 in the first fluid. After the detonation of the explosive 33 by the detonators 24, perforations 61 can be formed in the sidewall of the casing 22 using a perforating gun as described above. After perforation of the casing 22, a production pump 62 can be used to extract the hydrocarbon and pump the hydrocarbon, water, superheated water, or steam through the work string tubing 79 to the wellhead 42.

Prefabricated Housing

Figure 27:
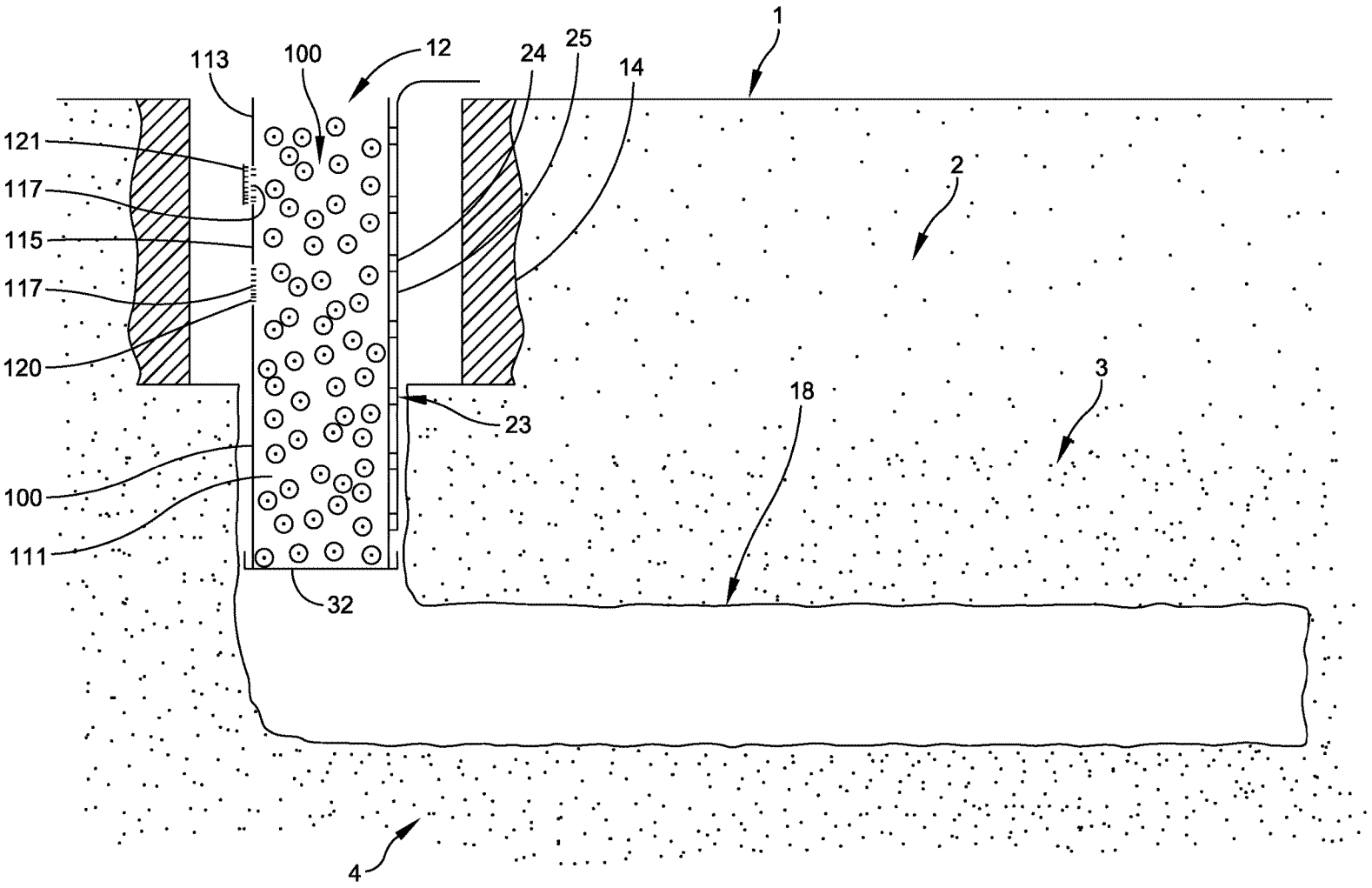
FIG. 27 is a cross sectional view of a well and a pre-fabricated housing or sleeve containing an explosive.
Figure 28:
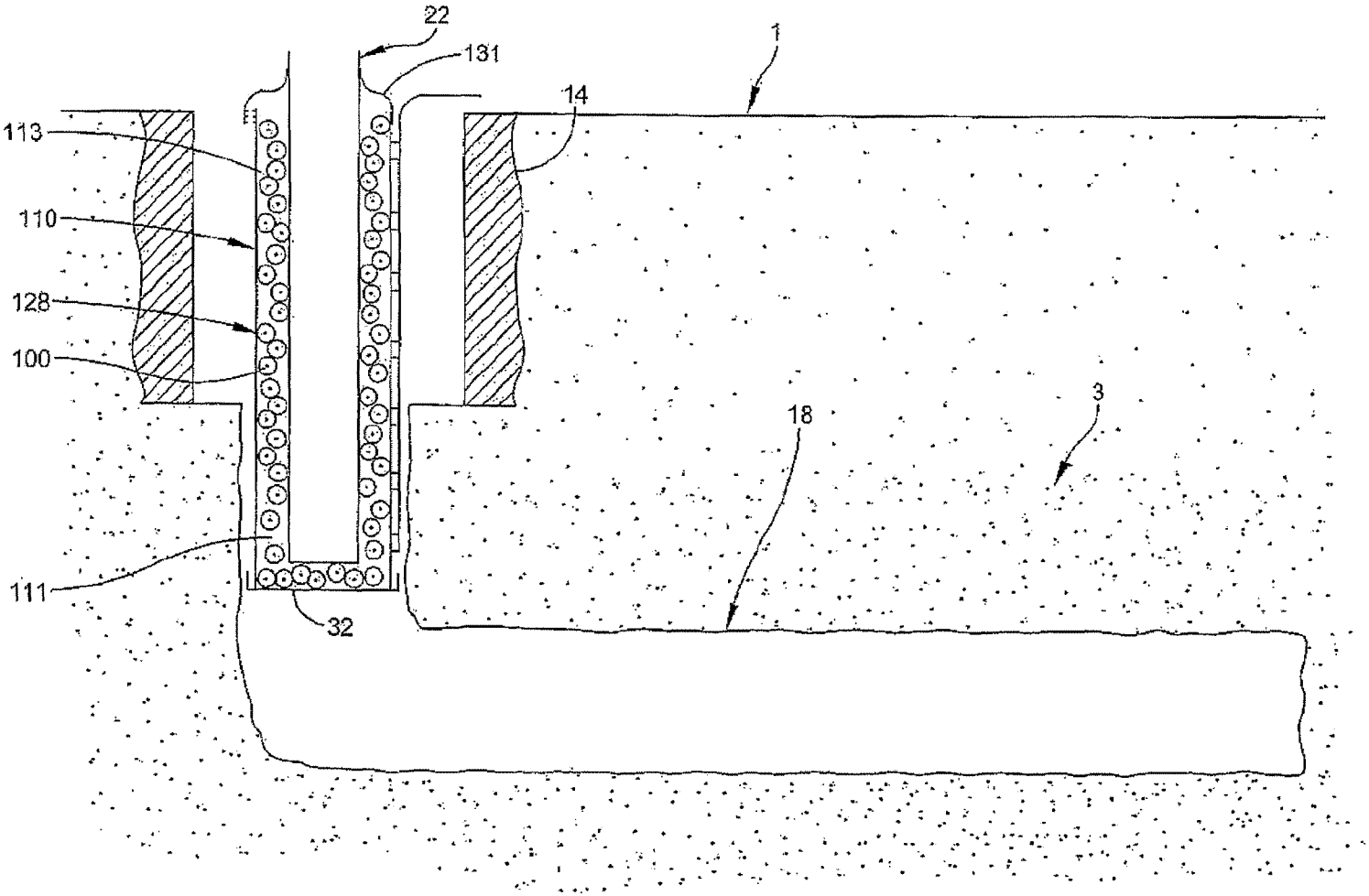
FIG. 28 is a cross sectional view of the well and pre-fabricated housing of FIG. 27, with the housing attached to a production casing.

FIG. 27 and FIG. 28 show a first system configuration for extracting hydrocarbon, water, superheated water, or steam from a subterranean formation using a module 128 comprising a housing 110 having a cavity 111 therein, the cavity 111 containing a first material having a first explosive 100 or material capable of an exothermic oxidation-reduction reaction. FIG. 27 illustrates a surface 1 above a subterranean geologic formation 2. The subterranean geologic formation 2 overlies a hydrocarbon, water, superheated water, or steam bearing formation 3, which can contain petroleum and/or natural gas, for example. The subterranean formation 3 is bounded by at least one non-hydrocarbon bearing ("non-bearing") formation 4. The drilling rig with associated tools (e.g., pump, drill pipe, motor, and drill bit assembly) are omitted from FIG. 27 for brevity.

The housing 110 can be assembled from a plurality of lengths of oil field metal casing 113, 115, connected to each other using threaded sleeves or sockets 117 with collar type threads 121. Alternatively, the lengths of oil field metal casing 113, 115 can have seamless type threads 120. The lengths of oil field metal casing 113, 115 can comprise steel or plastic material. The lengths of oil field metal casing 113, 115 can be assembled to form a module 128 of any desired length. Additional connecting elements, such as wiring, external pipes, fittings, valves, sealing elements, fasteners and the like are omitted for brevity.

To set up the configuration of FIG. 27, a surface hole having a selected well bore diameter and depth is drilled. A surface casing 12 is formed by pumping surface casing cement 14 in the surface hole. The surface casing 12 is then drilled to form a vertical well bore having a desired total depth. A horizontal well bore 16 is drilled. the housing 110 can be assembled from one or more sections of casing, such as threaded casing sections 115, which can be connected by threads. The threads can be seamless threads 120 or threaded sleeves 121 can be used. The use of multiple sections of casing 113, 115 allows for the fabrication of a housing 110 of any desired size. In some embodiments, a detonating means includes a detonator string 23 having detonators 24 and insulated electrical cables 25 attached disposed in the one or more cavities. For example, the detonation string 23 can be attached to or near the outer cylindrical surface at the perimeter of the housing 110. The housing can be pre-filled with a material having an explosive 100.

In some embodiments, the material having an explosive is a first fluid including a first explosive 33. In other embodiments, the material is an aggregate or in a pre-cast solid form having a cylindrical central bore (not shown) extending along its longitudinal axis. The cylindrical central bore (not shown) allows subsequent insertion of a production casing 22 into the housing 110 having a solid material containing the explosive 100 33. Alternatively, the housing 110 can comprise a plastic casing. The diameter of the housing 110 can be in the range of 3 inches to 36 inches and the length. In at least one embodiment, the sections 115 are approximately 40 feet long, but the sections 115 can be any appropriate length. The housing 110 can be placed in the well bore 12.

FIG. 28 shows the casing 22 engaging the housing 110. The casing 22 is inserted into the housing 110 such that the material (if in fluid, slurry, gel, or granular form) including the first explosive 100 is displaced into the annular volume between the sidewall of the casing 22 and the inner wall of the housing 110. Alternatively, if the material containing the explosive 100 is a unitary solid mass, the material containing the explosive 100 can be formed in the shape of a right circular hollow cylinder (i.e., a volume bounded by two concentric cylindrical surfaces and two parallel annular bases perpendicular to the axis of the housing 110). The right circular hollow cylinder shape has a bore to receive the casing 22.

In one embodiment, the material containing the explosive is ammonium nitrate/fuel oil (ANFO) including 94% porous prilled ammonium nitrate ($NH_4NO_3$) (AN), which acts as the oxidizing agent and absorbent for the fuel, and 6% number 2 fuel oil (FO). ANFO is a tertiary explosive, meaning that it is not easily detonated using the small quantity of primary explosive in a typical blasting cap. A secondary explosive, known as a booster, is included in the detonators 24.

In another embodiment, the explosive can be triacetone triperoxide (TATP), which can be combined with a desensitizing material.

In some embodiments, the housing 110 contains a material 100 capable of undergoing an exothermic chemical reaction. For example, the material can be a material capable of undergoing an exothermic oxidation-reduction reaction. In some examples, the material is a thermite composition of metal powder, which serves as fuel, and metal oxide. The thermite can include aluminum, magnesium, titanium, zinc, silicon, or boron. The oxidizer can include bismuth(III) oxide, boron(III) oxide, silicon(IV) oxide, chromium(III) oxide, manganese(IV) oxide, iron(III) oxide, iron(II,III) oxide, copper(II) oxide, lead(II,IV) oxide, or combinations thereof. The material 100 also includes an inorganic or organic liquid to produce a high energy gas from the heat of the thermitic reaction.

In one embodiment, the thermite undergoes the following reaction:

$$Fe_3O_4+Al \rightarrow Fe+Al_3O_8+heat$$

In another embodiment, the thermite undergoes the following reaction:

$$Fe_2O_3+2Al \rightarrow 2Fe+Al_2O_3+heat$$

In another embodiment, the thermite undergoes the following reaction:

$$3CuO+2Al \rightarrow 3Cu+Al_2O_3+heat$$

In other embodiments, the housing 110 contains a primary explosive 100, which is also capable of undergoing an exothermic chemical reaction to produce high explosion velocity gasses.

The proximal end and distal end of the housing 110 may include a crossover sub adapter 131 configured to engage the casing 22 and ensure the material containing the first explosive 100 is retained within the housing 110. The crossover sub adapter 131 can be a threaded, swaged crossover sub-assembly or a welded swaged crossover sub-assembly, for example. The casing 22 acts as a carrier for the housing 110. The casing 22 with the housing 110 attached thereto is inserted into the wellbore 16 such that it extends to the full depth of the wellbore. As the casing is inserted, the housing 110 travels along with it.

The volume of explosive material contained within housing 110 can be calculated based on the diameter of the housing 110 and casing 22 as well as the desired weight or mass of explosive material to be used. In one example, the housing 110 is ten inches in diameter and 5,000 feet long. With a 5.5 inch production casing 22, the housing 110 can hold 320 barrels of the material including 105,000 pounds of explosive 100.

In a second example, the housing 110 is 12 inches in diameter and 5,000 feet long. With a 5.5 inch production casing 22, the housing 110 can hold 570 barrels of the material including 171,000 pounds of explosive 100.

In a third example, the housing 110 is 14 inches in diameter and 5,000 feet long. With a 5.5 inch production casing 22, the housing 110 can hold 830 barrels of the material including 249,000 pounds of explosive 100.

Figure 29:
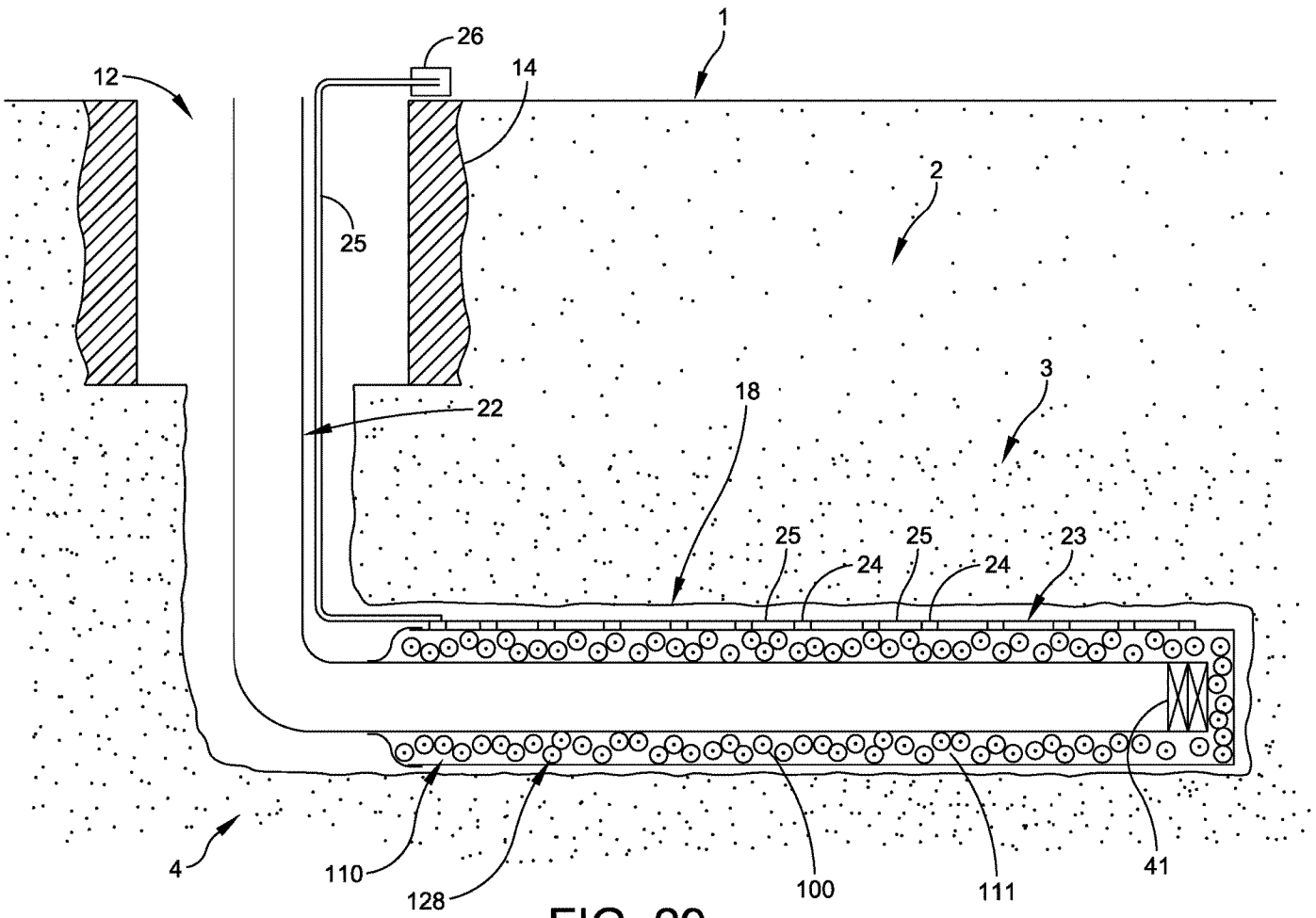
FIG. 29 is a cross sectional view of the well, production casing, and housing of FIG. 28 with the casing and housing inserted within the subterranean formation.

FIG. 29 shows the configuration after the casing 22 with the module 128 (including housing 110 and the explosive 100) attached thereto has been deployed in the horizontal well bore with the module 128 in the annulus 18. The cable 25 can be run to the using a wire line or slickline. After placement of the casing 22 and housing 110 into the wellbore, a cement diverter tool 38 is placed within the casing 22. Perforations are made in the casing and the isolation material 39 (e.g., cement) can be inserted through the proximal portion of the casing 22 and into the annulus 18. An electrical cable 25 connects the master control 26 to the detonator string 23.

Figure 30:
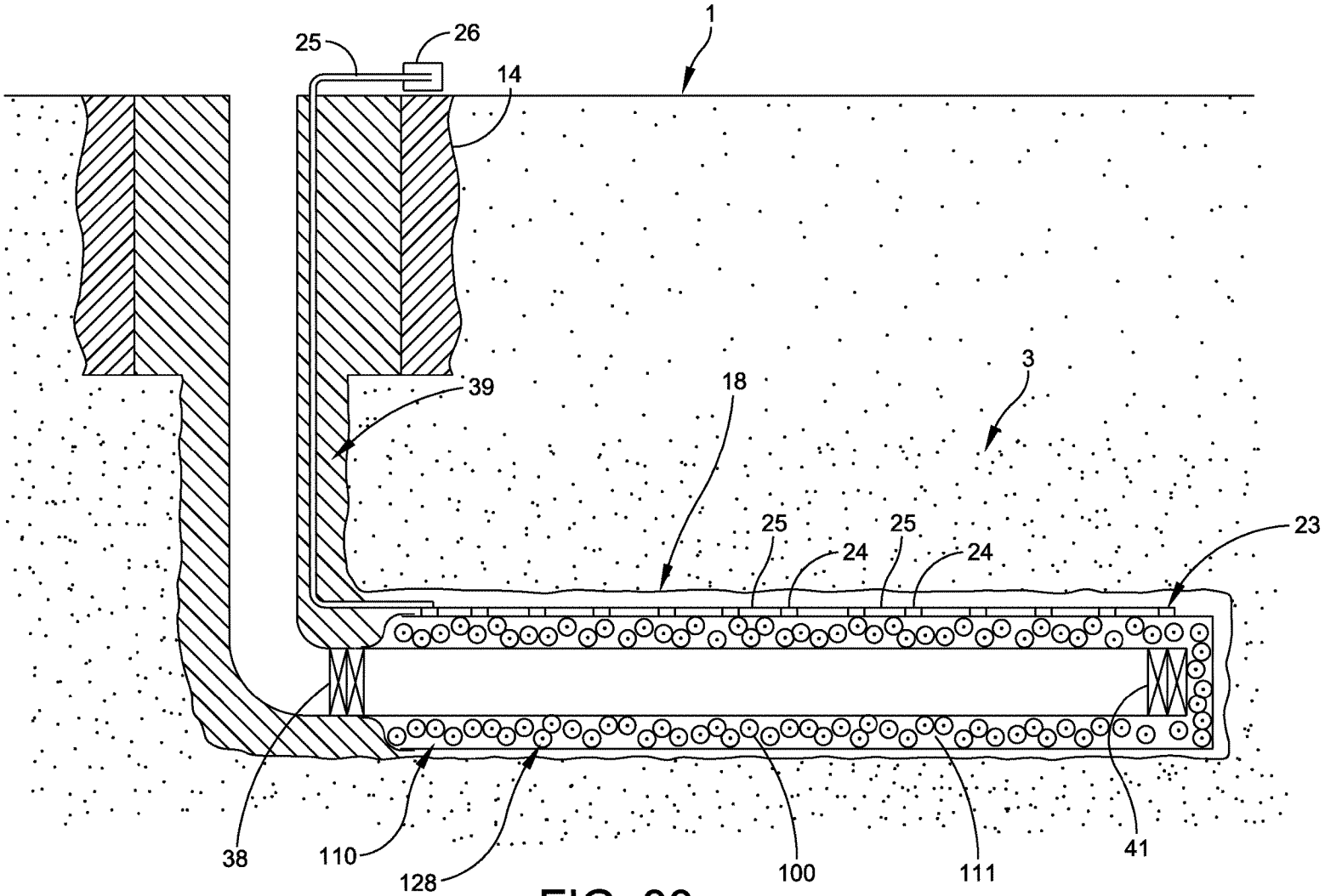
FIG. 30 is a cross sectional view of the well, production casing, and housing of FIG. 29 with the casing encapsulated in isolation material.

FIG. 30 shows the configuration after the casing 22 is encased with isolation material 39. To reach this configuration, the cement diverter tool 38 can be placed proximate the location of the crossover sub adapter 131. Isolation material 39 is then inserted into the in the annulus outside of the casing 22, between the crossover sub adapter 131 and the surface 1 In this embodiment, the casing 22 has a closed distal end 21 (e.g., having a bull plug 32 or bridge plug 41), so the explosive material 100 is isolated in the annulus 18 between the isolation material 39 and the distal end 21 of casing 22, and in the volume on the distal side of the bull plug 32 or bridge plug 41. Subsequently, detonators 24 are used to detonate the first explosive 100, thereby releasing the high energy gases and causing cracking and fracturing of the hydrocarbon, water, superheated water, or steam bearing formation, as described above. The detonators can be used in any appropriate sequence, also as described above.

Figure 31:
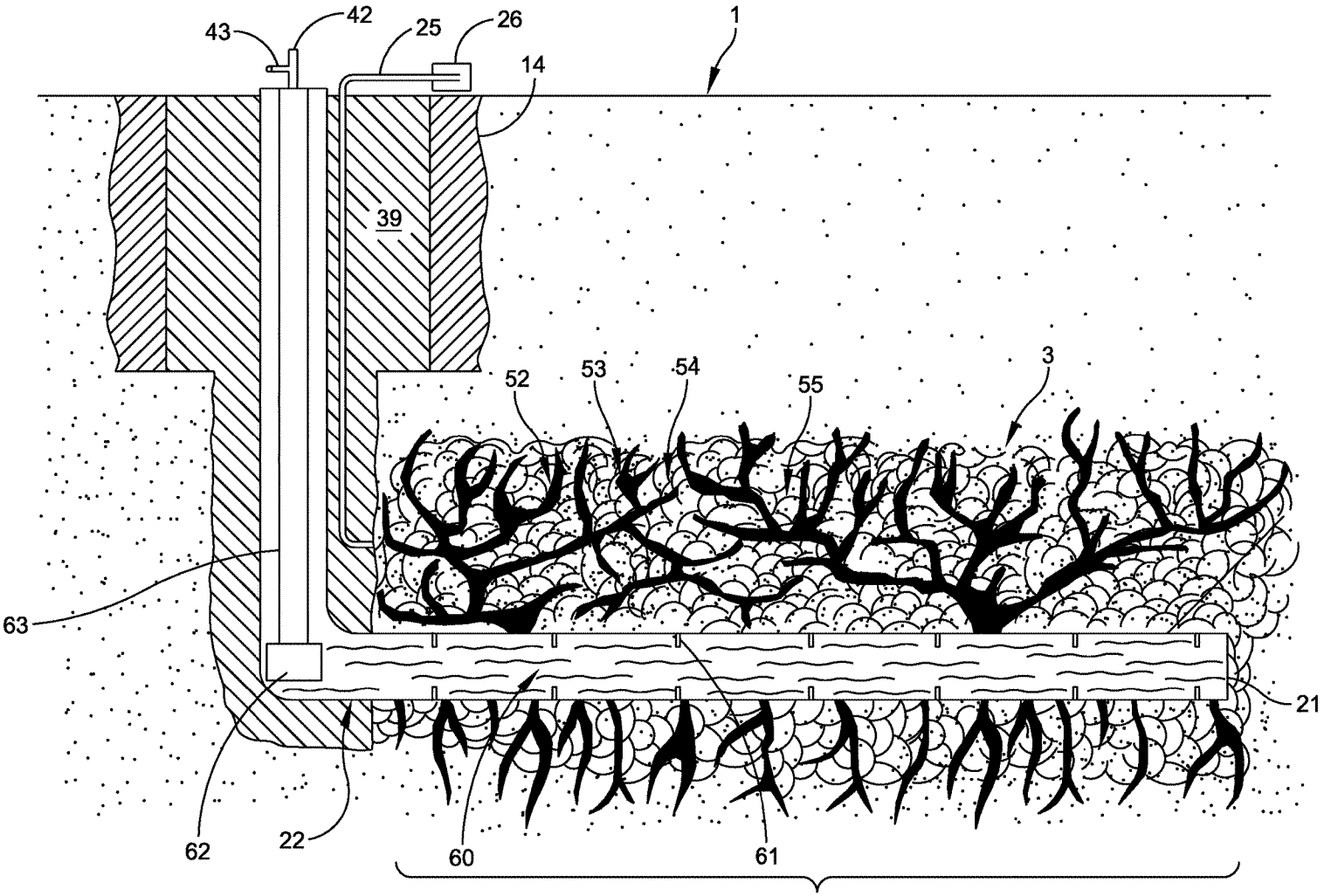
FIG. 31 is a cross sectional view of the well, production casing, and housing of FIG. 30, after detonating the explosive in the housing.

As shown in FIG. 31, after detonation of the explosive 100 and cracking and fragmentation of the hydrocarbon bearing formation, the casing 22 can be perforated using a perforating gun to introduce perforations 61 and allow freed hydrocarbon, water, superheated water, or steam to enter the casing 22. A production tubing string 63 having a pump 62 at its distal end is introduced into the casing 22. The pump 62 can then be used to extract the hydrocarbon, water, superheated water, or steam via production tubing string 63 to wellhead, including the valve 43 and Christmas tree 42.

The use of the housing 110, as shown in FIGS. 27-31, allows for the use of explosive material which is in the form of an aggregate or in a pre-cast form (or a liquid form, as discussed above with reference to FIGS. 1-26). If an aggregate or pre-cast form is used, the explosive material is not pumped, and the explosive material is not in a slurried or liquid form. The explosive pumping step can be skipped. In some embodiments, the entire module 128 is pre-fabricated and can be stored or sold as an article of manufacture, eliminating the need for assembly and reducing process time.

FIGS. 32-36 show a configuration using a pre-formed housing 110 in a vertical well bore 18. At least one housing 110 radially encircles the tubular sidewall of the casing 22.

Figure 32:
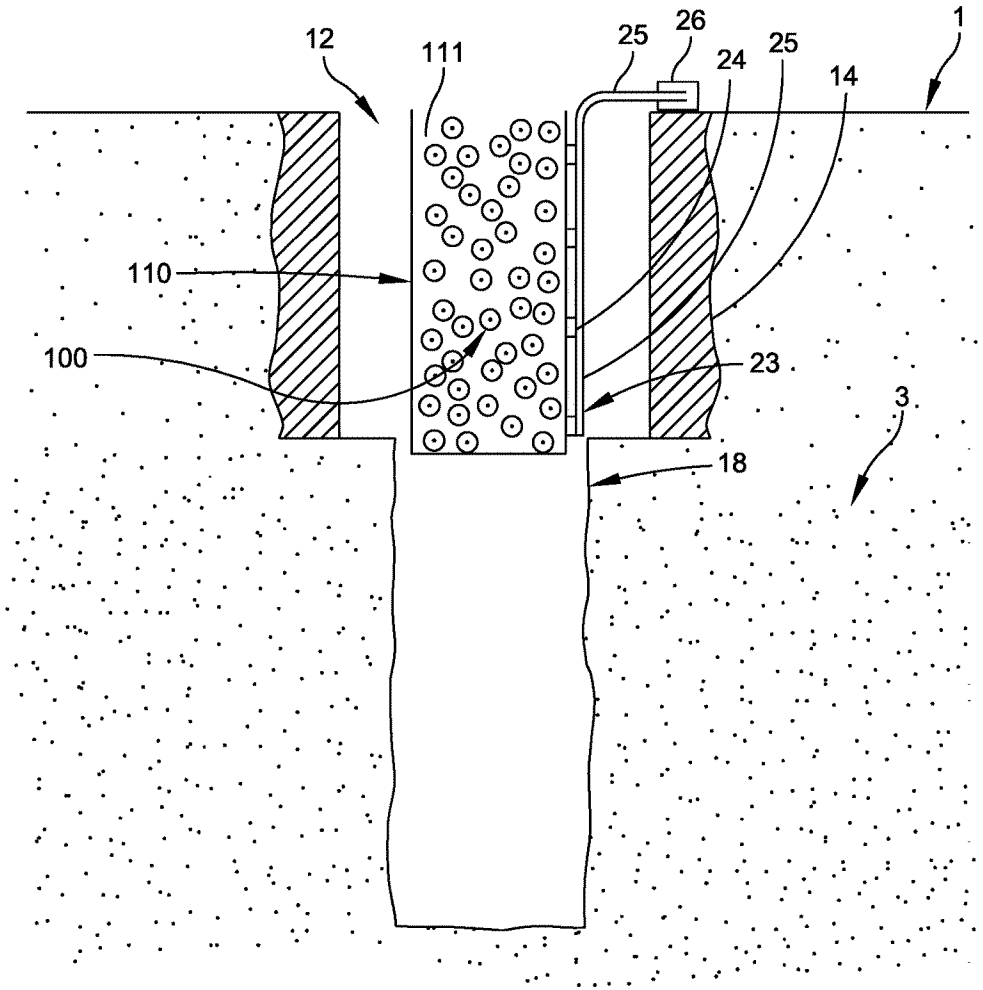
FIGS. 32-36 show the method steps of FIGS. 27-31, respectively, applied in a vertical well bore.

Except as noted below, the configuration in FIG. 32 is the same as shown in FIG. 27, and the description of the configuration and, for brevity, the method of FIG. 27 is not repeated. The well bore 12 in FIG. 32 is vertical, and does not have a horizontal bore. In FIG. 32, the detonator string 23 has a cable 25 connecting the detonators to the master control 26 before insertion of the casing 22 into the well bore 18. In various examples, the cable 25 can be attached before or after deploying the casing 22 in the well bore.

Figure 33:
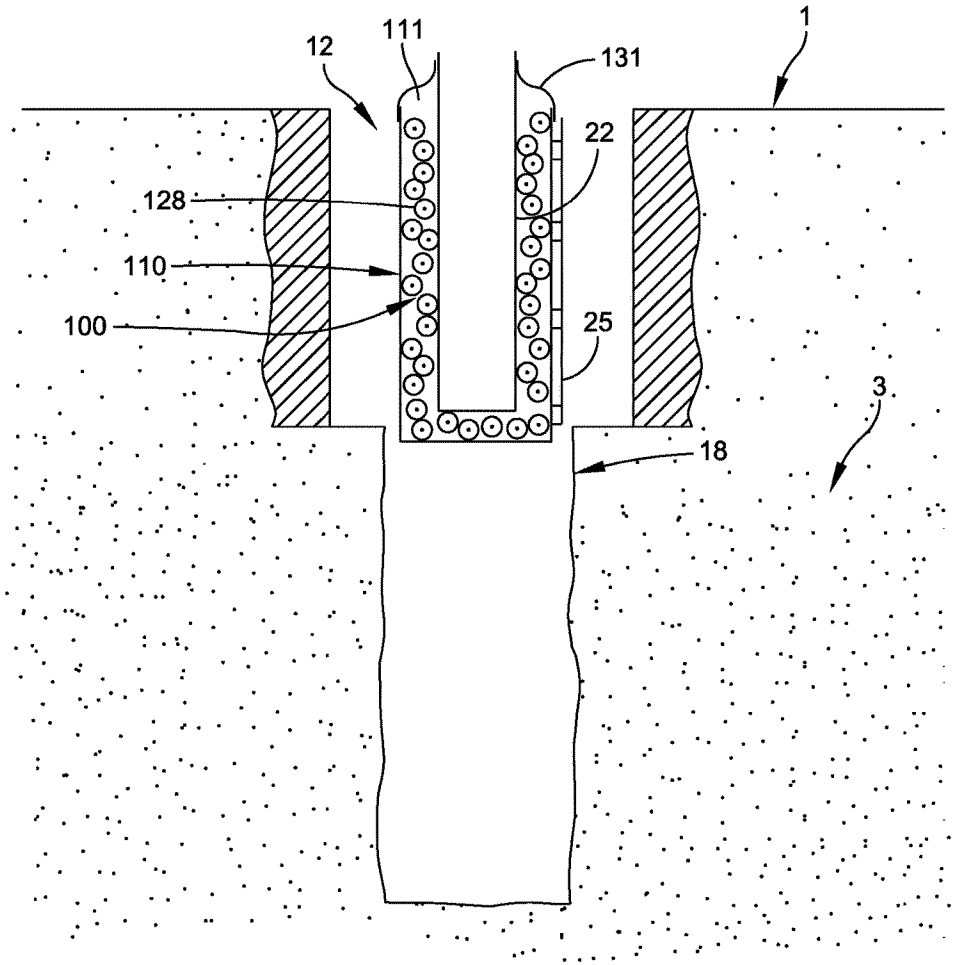

FIG. 33 shows the configuration with the casing 22 inserted into the housing 110 and joined to the housing 110 by the crossover sub adapter 131. The configuration and method are the same as described above with reference to FIG. 28, except for the configuration of the well bore 18 and, for brevity, the method of FIG. 28 is not repeated.

Figure 34:
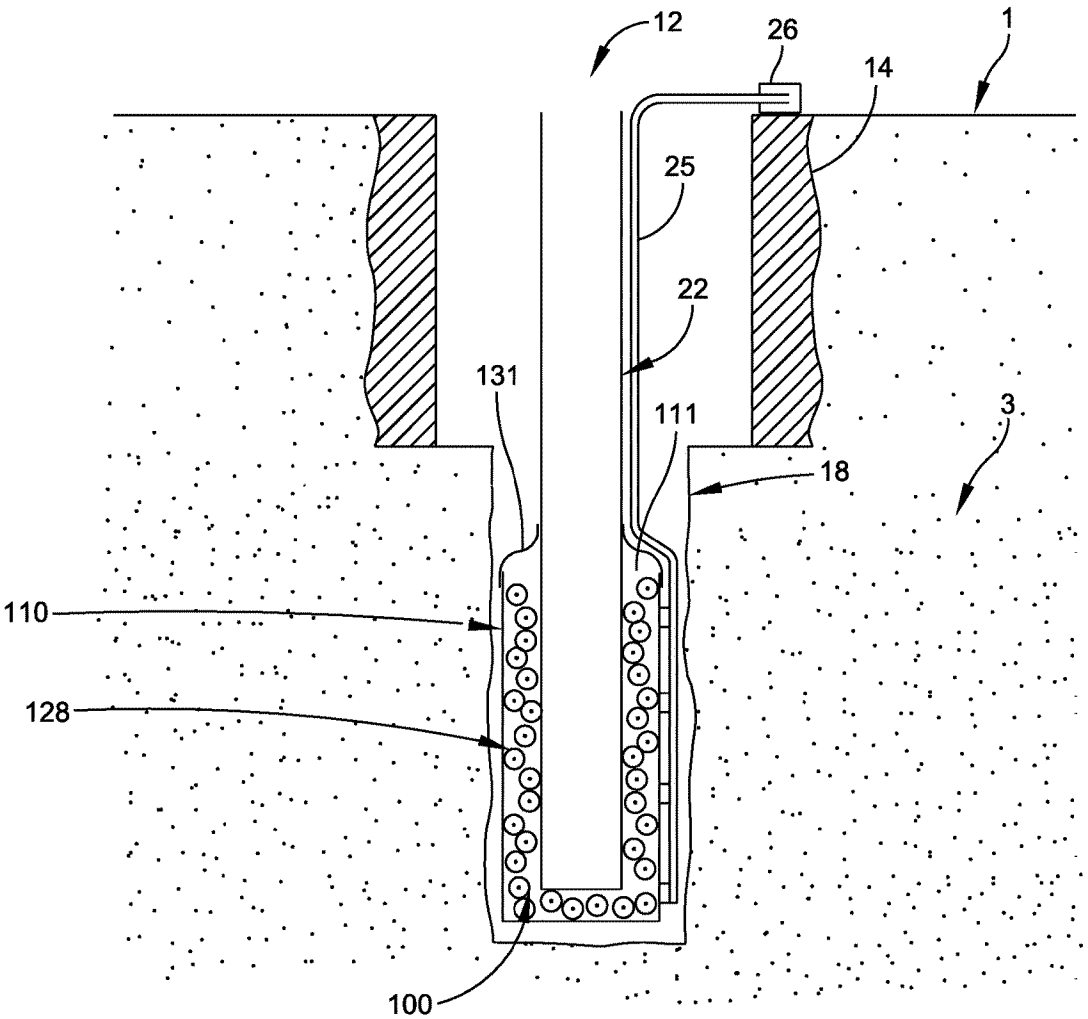

FIG. 34 shows the configuration with the casing 22 supporting the housing 110 and inserted in the well bore 18. The configuration and method are the same as described above with reference to FIG. 29, except for the configuration of the well bore 18 and, for brevity, the method of FIG. 29 is not repeated.

Figure 35:
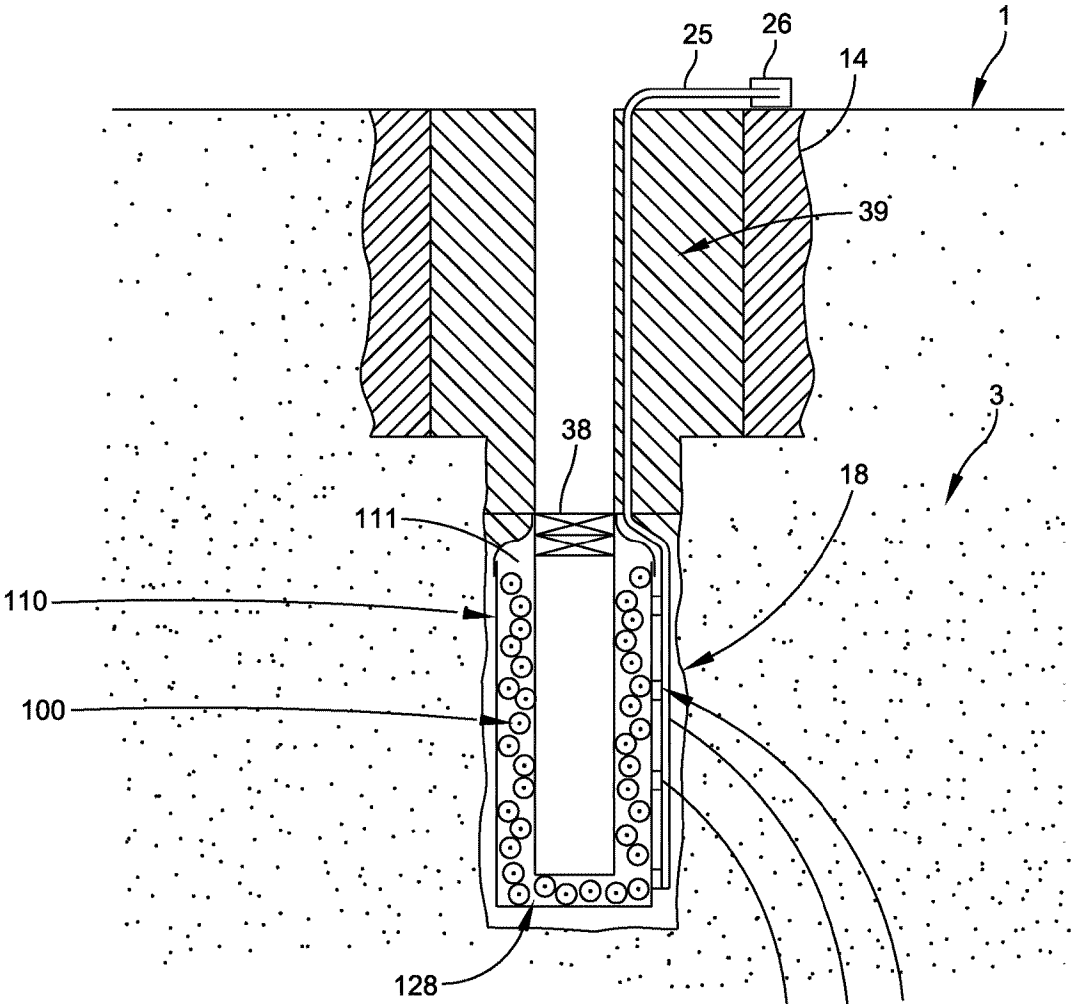

FIG. 35 shows the configuration after insertion of the cement diverter tool 38 and introduction of cement into the annulus via the casing 22. The configuration and method are the same as described above with reference to FIG. 30, except for the configuration of the well bore 18 and, for brevity, the method of FIG. 30 is not repeated.

Figure 36:
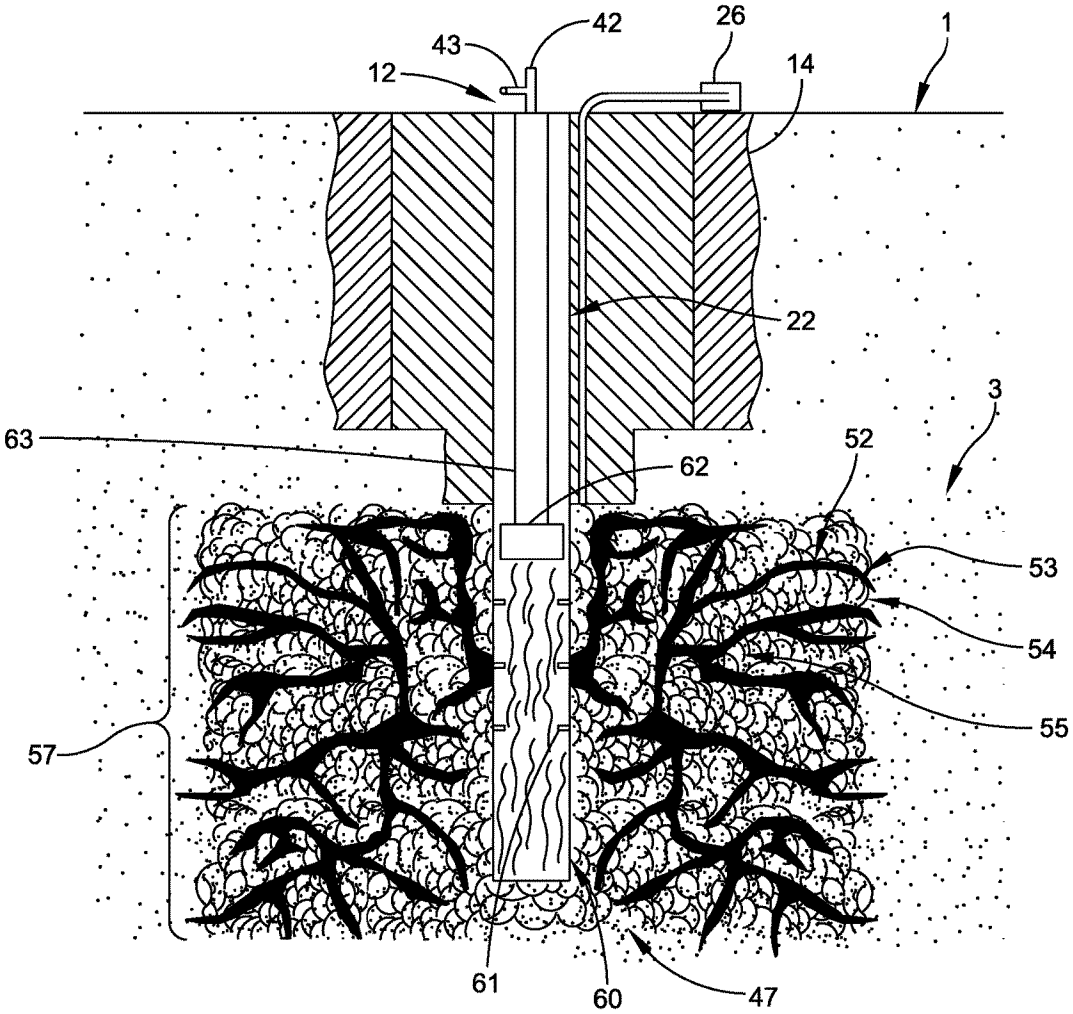

FIG. 36 shows the configuration after completion of detonation of the explosive 100, perforation of the casing 22, and introduction of a production tubing string 63 with a pump 62 connected thereto. The detonation of the explosive 100 fractures the subterranean formation 3, increasing the surface area for increased production.

Prefabricated Explosive Modules

In some embodiments, as described below, a housing (sleeve) 110 is inserted into a wellbore 12 in a given formation 3, where the wellbore defines an entrance and a terminus. The housing/sleeve 110 includes a sidewall and defines an inner bore and a longitudinal axis therethrough, with a cavity 111 between the inner bore an outer perimeter of the housing/sleeve 110. The sleeve has an explosive 100 therein. The sleeve has one or more means 123*a*-123*c* to detonate the explosive 100 proximate the sleeve so as to enable detonation of the explosive 100. The explosive 100 can be in a solid carrier, an aggregate carrier, or a fluid carrier. In some embodiments, the carrier is a solid or aggregate, and the tubular is at least partially inserted axially into the housing/sleeve 110. The tubular includes a sidewall defining an inner and outer surface and a tubular bore. The outer surface of the sidewall and the sleeve define an annulus 18 therebetween. An isolation material is placed between the wellbore entrance 1 and the explosive 100 within the annulus 18.

In some embodiments, a first volume of explosive 100, a second volume of explosive 100 and an inert material separating the first volume of explosive 100 from the second volume of explosive 100. Some embodiments (as shown in FIG. 39B) have a pre-fabricated housing 110 containing a plurality of charges 33*a*-33*c* of explosive material, with respective (same or different) explosive charges 33*a*-33*c* disposed in corresponding housing portions of the housing 110. At least one of the module housings (sleeves) 110 radially encircle the tubular sidewall of casing 22. For example, in some embodiments, the housing 110 can be similar to the housing 110 of FIG. 29, except an explosive material in solid or aggregate form is partitioned into discrete segments 33*a*-33*c* within the housing 110, with an isolation material 135*a*, 135*b* (e.g., an inert material such as sand or a proppant) between each pair of adjacent explosive charges 33*a*/33*b* and 33*b*/33*c*. The housing 110 has a respective independently controllable detonator or detonator string 123*a*-123*c* positioned adjacent to each of the isolated explosive charges 33*a*-33*c*. The spacing between the one or more portions of the housing can be determined based on the speed of a wave front caused by the detonation of the explosive in a predetermined environment.

An arrangement having a plurality of isolated explosive charges 33*a*-33*c* with separate, independently controlled detonators 23*a*-23*c* can limit the size of each individual blast to avoid seismic disturbances and provide greater control over the sequence of detonation of the explosive material 33*a*-33*c*. For example, each of the charges of explosive material 33*a*-33*c* can be detonated individually in a predetermined sequence. Thus, the vibration or displacement at the surface, caused by the detonation, can be controlled. By separating the explosive material into individual charges 33*a*-33*c*, the magnitude of the vibration and/or displacement felt at the surface 1 is reduced. Although the example of FIG. 39B shows three explosive charges 33*a*-33*c* and three detonator strings 23*a*-23*c*, any desired number of explosive charges and corresponding detonators can be used.

FIGS. 37, 38, 39, 40, 41, 42, 43 and 44 show an embodiment in which the housing 110 has a plurality of individual modules 129*a*-129*c* (also referred to herein as sleeves). Each module 129*a*-129*c* has a module housing 110, with a cavity 111 therein, and an independently controllable detonator string 23*a*-23*c* for each respective module 129*a*-129*c*. The modules 129*a*-129*c* (sleeves) can have the same type of explosive as each other, or different types of explosives from each other. Each of the modules 129*a*-129*c* can have the same shape and dimensions or, alternatively, the modules 129*a*-129*c* can have different shapes and/or dimensions from each other. Additionally, each module can contain the same amount of explosive material or, alternatively, the modules can contain different amounts of explosive material from each other. The modules 129*a*-129*c* can be connected to each other using threaded sleeves (not shown), for example. The casing 22 penetrates the central bore of each of the modules 129*a*-129*c*, and the modules 129*a*-129*c* are distributed along the length of the casing 22.

The modular construction allows manufacture and purchase of standardized modules 129*a*-129*c*, and assembling a housing 110 from any desired number of modules 129*a*-129*c* in any desired sequence. The modular design provides isolation for independently controlling detonation of each module 129*a*-129*c*.

If additional isolation is desired, modules 129*a*-129*c* containing explosives 100 can be separated from each other by elongated spacers (not shown) of an inert material. Spacers can be shaped as right circular hollow cylinders, for example. Alternatively, the explosive modules 129*a*-129*c* can be separated by non-explosive modules comprising a housing 110 having the cavity 111 thereof filled with sand or a proppant. This allows re-use of the design of housing 110 for both explosive modules 129*a*-129*c* and non-explosive isolation modules. The spacing between the one or more module housings 111 having explosive material 100 therein can be determined based on the speed of a wave front caused by the detonation of the explosive 100 in a predetermined environment. For example, the wave front velocity can be defined for a given well bore size and subterranean material type.

Figure 37:
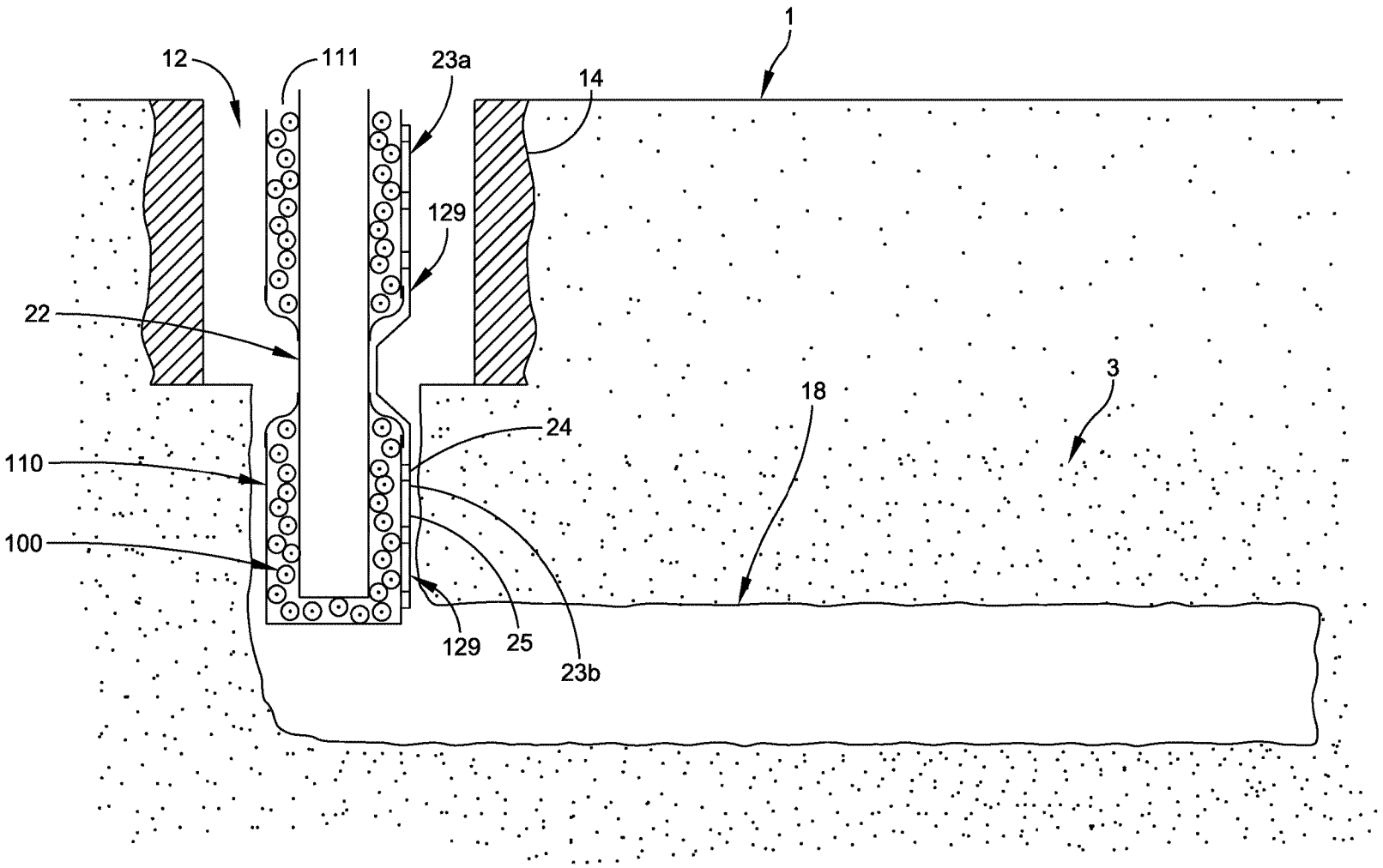
FIG. 37 is a cross sectional view of a well bore and production casing with a plurality of pre-fabricated explosive modules attached to the casing.

FIG. 37 shows the casing 22 extending through or into a plurality of modules 129*a*-129*c*. The casing 22 supports the modules 129*a*-129*c* and is used to insert the modules 129*a*-129*c* into the well bore.

Figure 38:
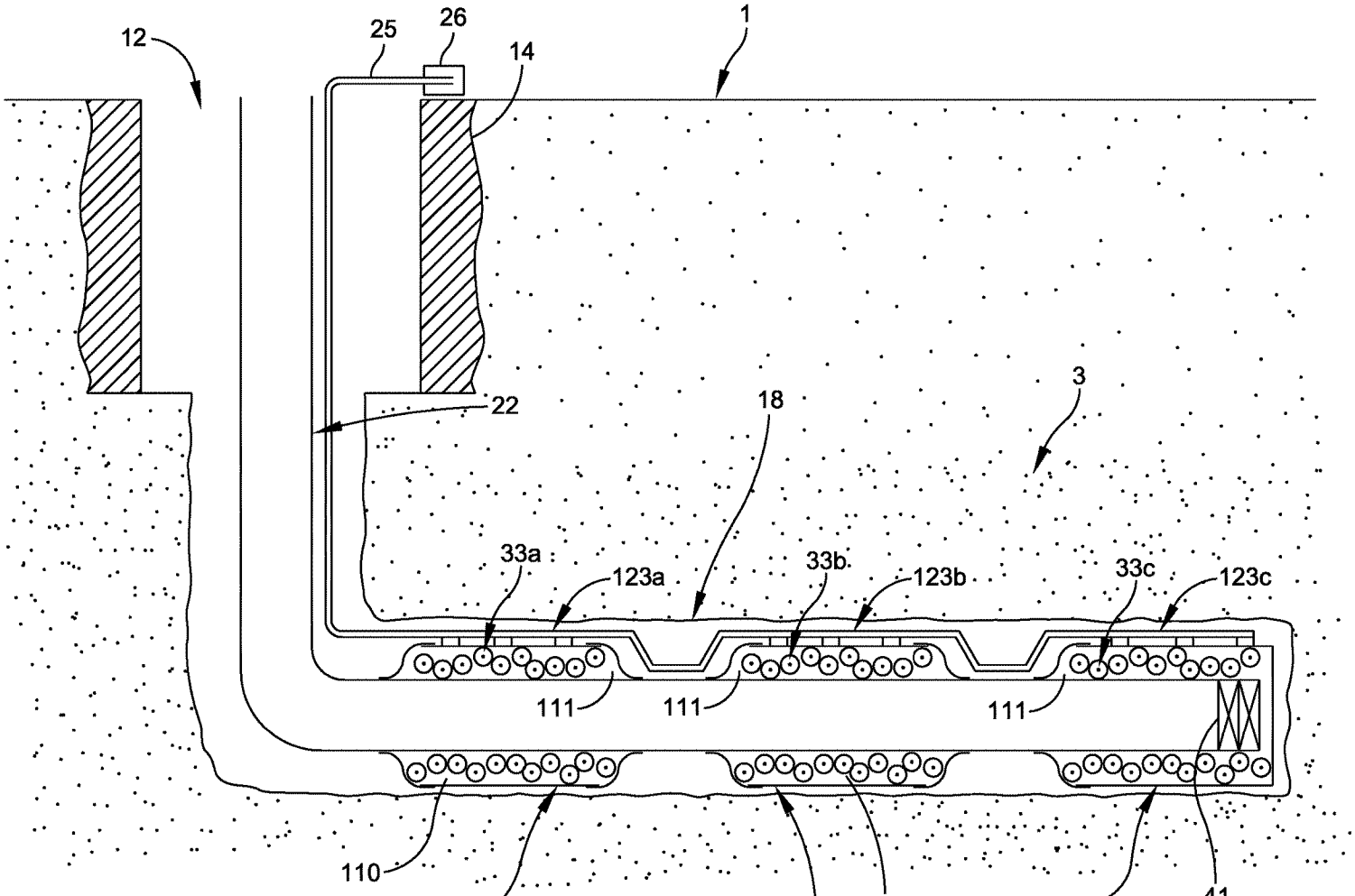
FIG. 38 is a cross sectional view of the well, production casing, and housing of FIG. 37 with the casing and explosive modules inserted within the subterranean formation.

FIG. 38 shows the casing 22 with a plurality of explosive modules 129 deployed inside the well bore 18. Each module 129*a*-129*c* has a respective detonator string 123 connected by cabling to the master control 26. The modules can all be the same as each other, or the modules can have different types or amounts of explosive material from each other.

Figure 39:
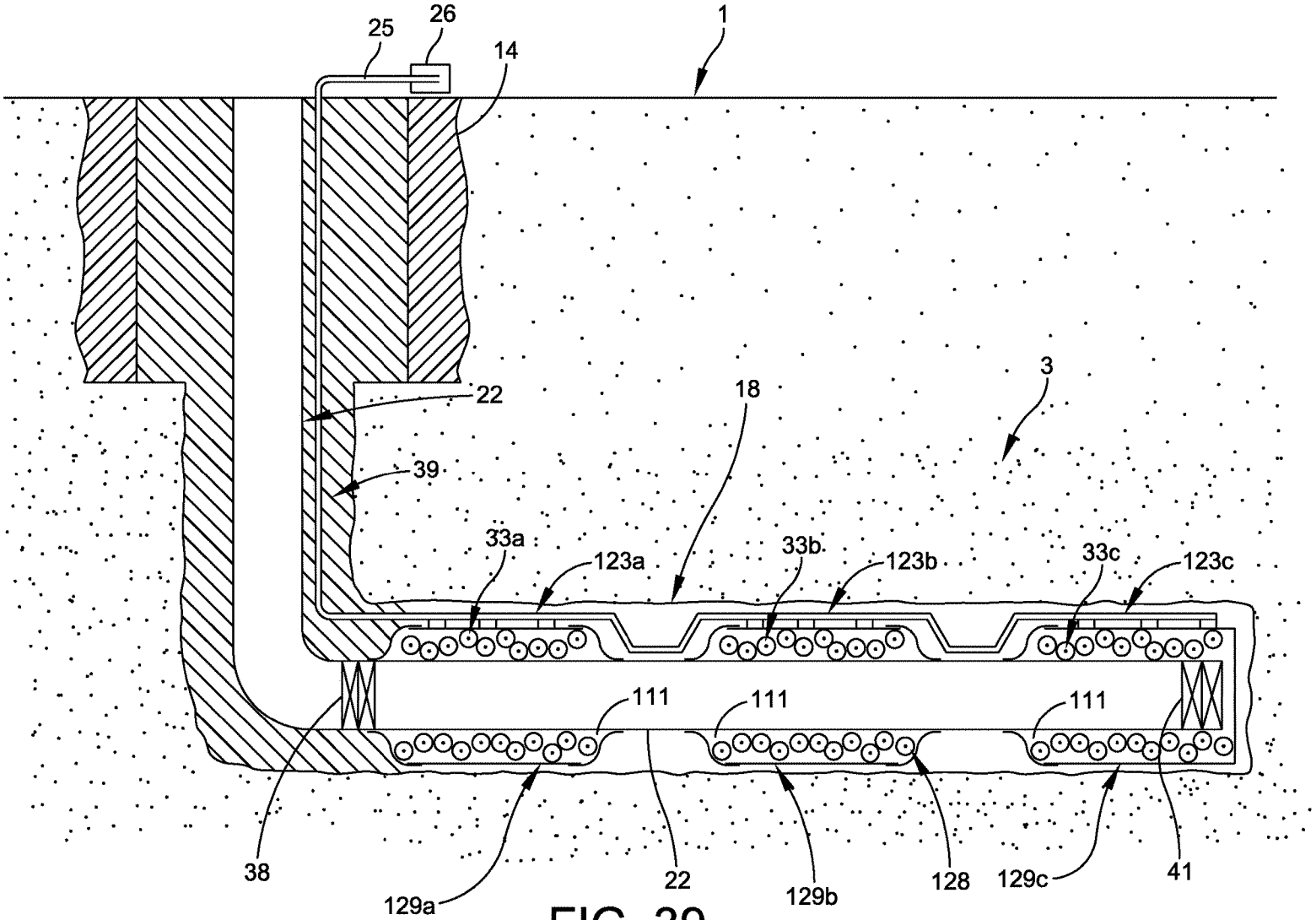
FIG. 39 is a cross sectional view of the well, production casing, and housing of FIG. 38 with the casing encapsulated in isolation material.
Figure 39B:
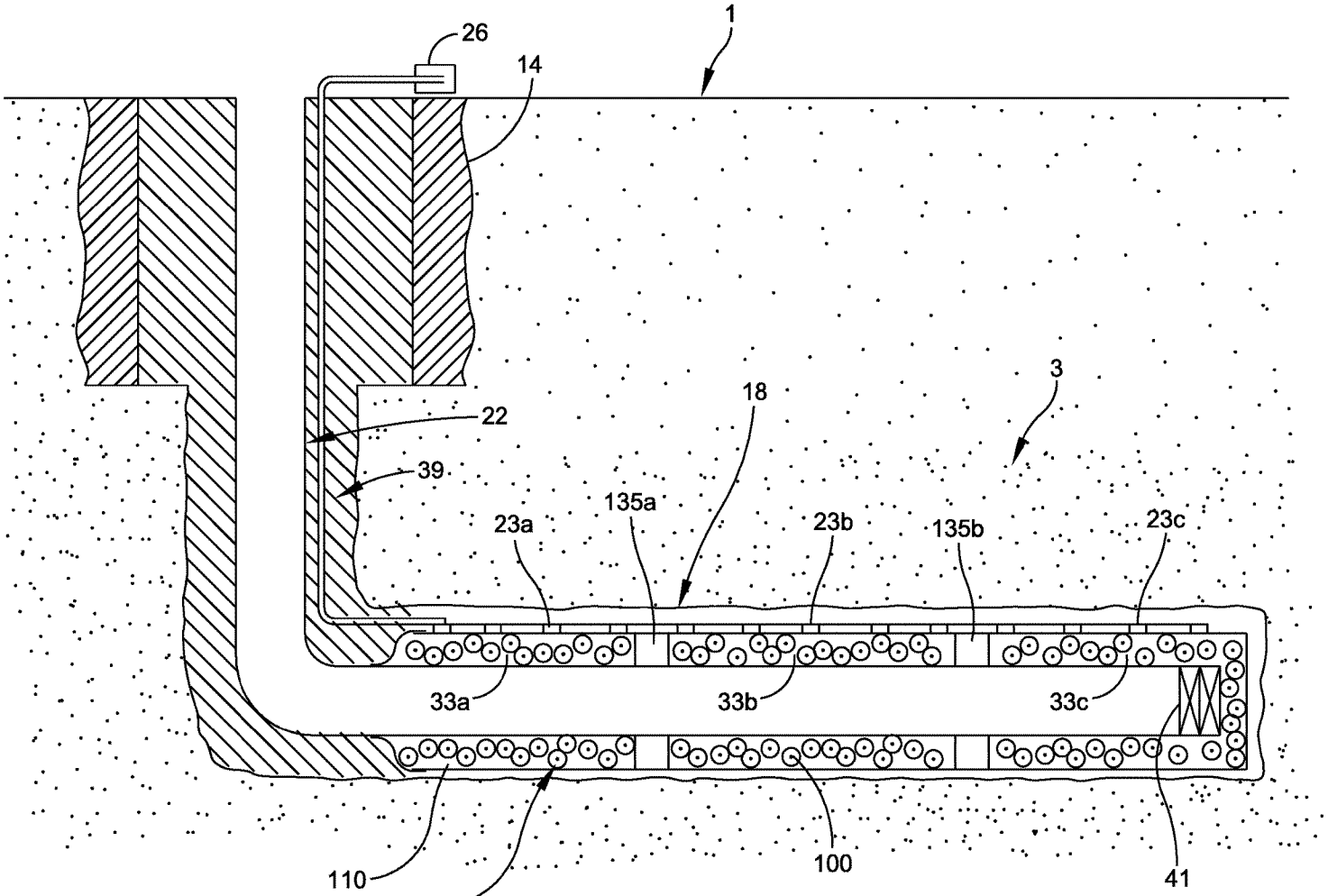
FIG. 39B is an alternative configuration having a plurality of explosive charges capable of independent detonation, in a single housing separated by an isolation material.

FIG. 39 shows a cement diverter tool 38 inserted on the proximal side of the first module 129*a* (the most proximal module) in the plurality of modules. The cement diverter tool 38 is used to channel isolation material 39 (e.g., cement) into the annulus 18, encapsulating the portion of the casing 22 between the surface 1 and the first module 129*a*.

Figure 40:
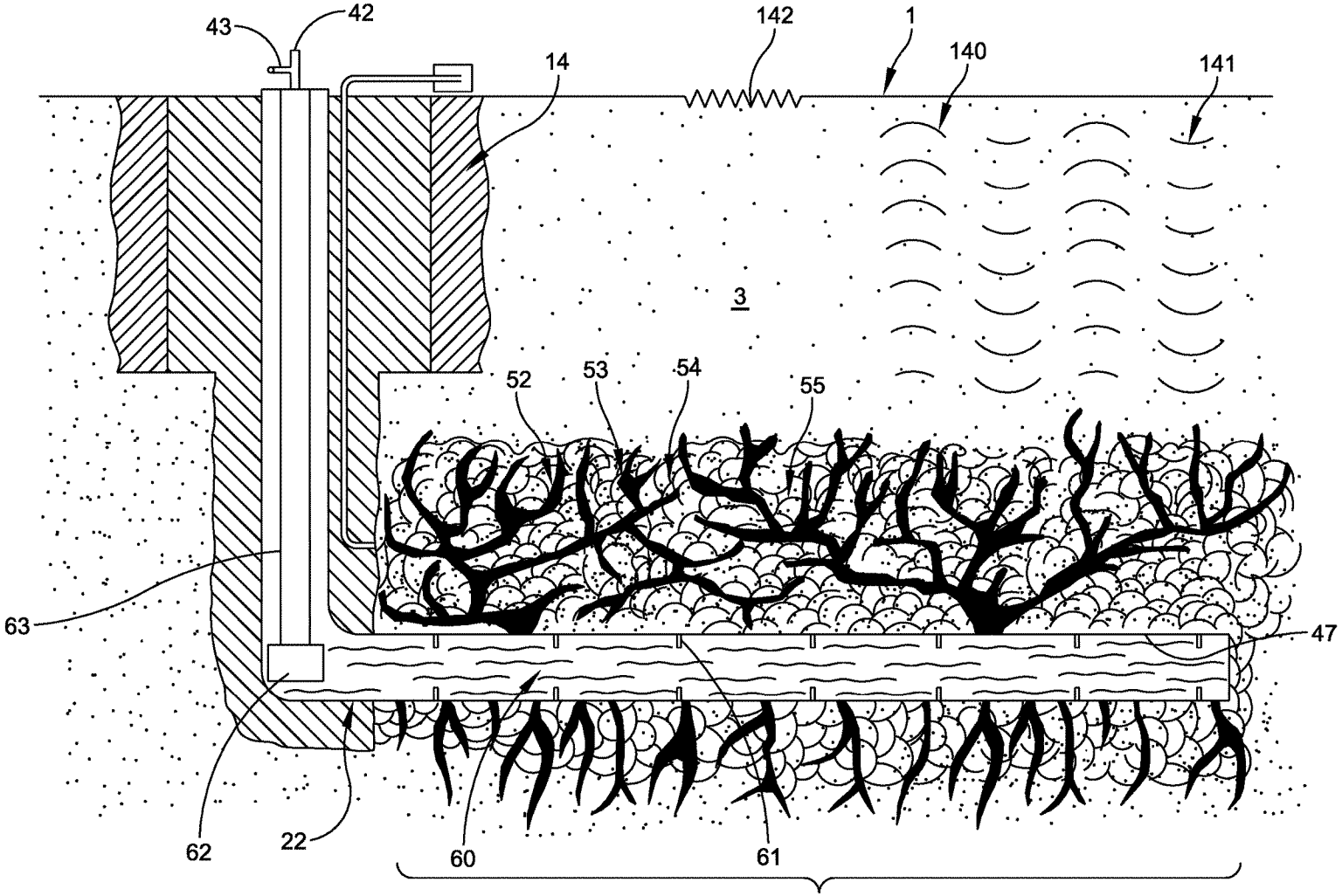
FIG. 40 is a cross sectional view of the well, production casing, and housing of FIG. 39, after detonating the explosives in the module, perforating the casing, and deploying a production pump in the casing.

FIG. 40 shows the system of FIG. 39, after detonating the explosives in each of the modules 129*a*-129*c*, to fracture the subterranean formation 3. The detonation of explosives creates primary seismic waves 140 and secondary seismic waves 141. Upon reaching the surface 1, the primary seismic waves 140 and secondary seismic waves 141 create vibrations/displacements 142. The detonations can be simultaneous, or the modules can be detonated independently of each other, in any desired sequence. Following detonation, the perforating tool (not shown) is inserted to perforate the side walls of the casing 22 to permit hydrocarbon, water, superheated water, or steam to enter the casing 22. The production tubing string 63 with a production pump 62 is deployed inside the casing 22, to deliver the hydrocarbon, water, superheated water, or steam to the surface 1.

Using independently detonatable modules 129*a*-129*c* the magnitude of the vibration/displacement 142 can be controlled.

Figure 41:
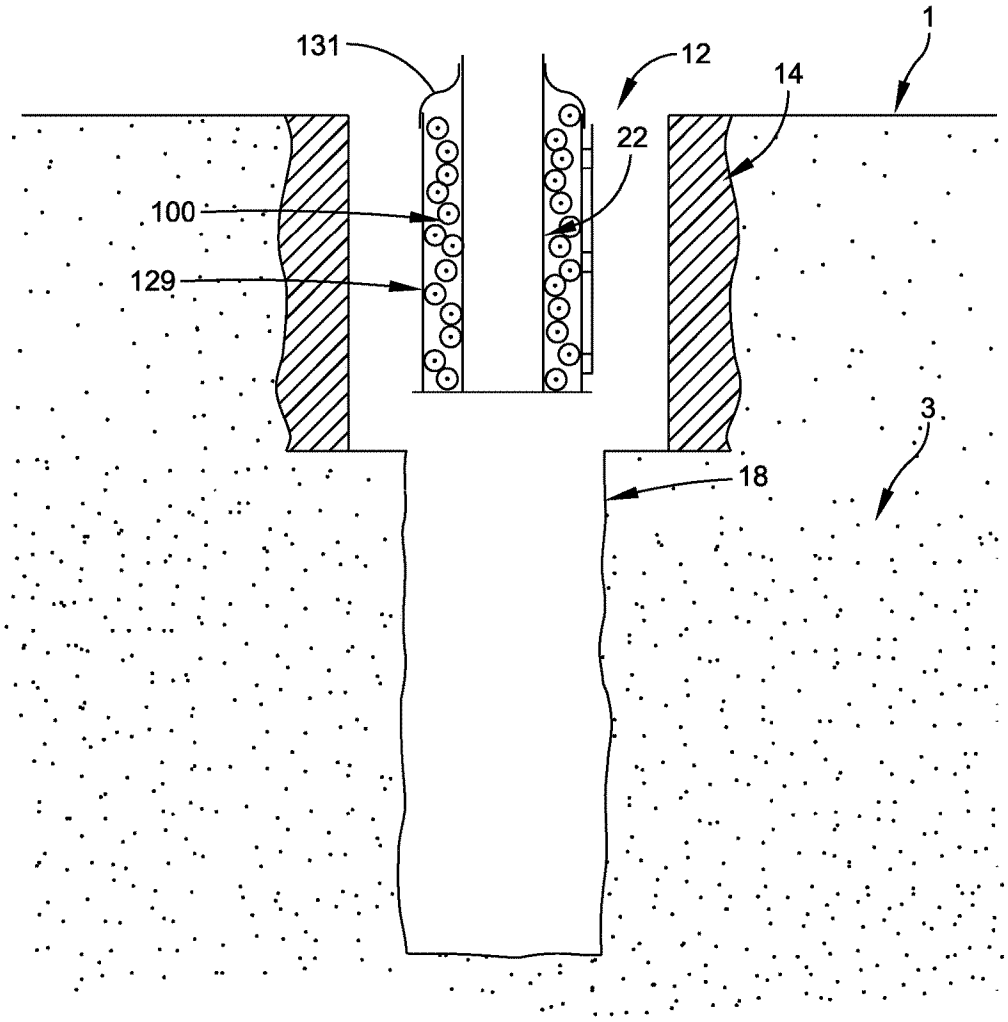
FIGS. 41-44 show the method steps of FIGS. 37, 38, 39 and 40, respectively, applied in a vertical well bore.

FIGS. 41-44 show the method of FIGS. 37, 38, 39 and 40, respectively, as applied in a vertical well. FIG. 41 shows the casing 22 carrying a plurality of explosive modules 129, as shown in FIG. 37, and applied to a vertical well. For brevity, a description of the individual components and steps is not repeated.

Figure 42:
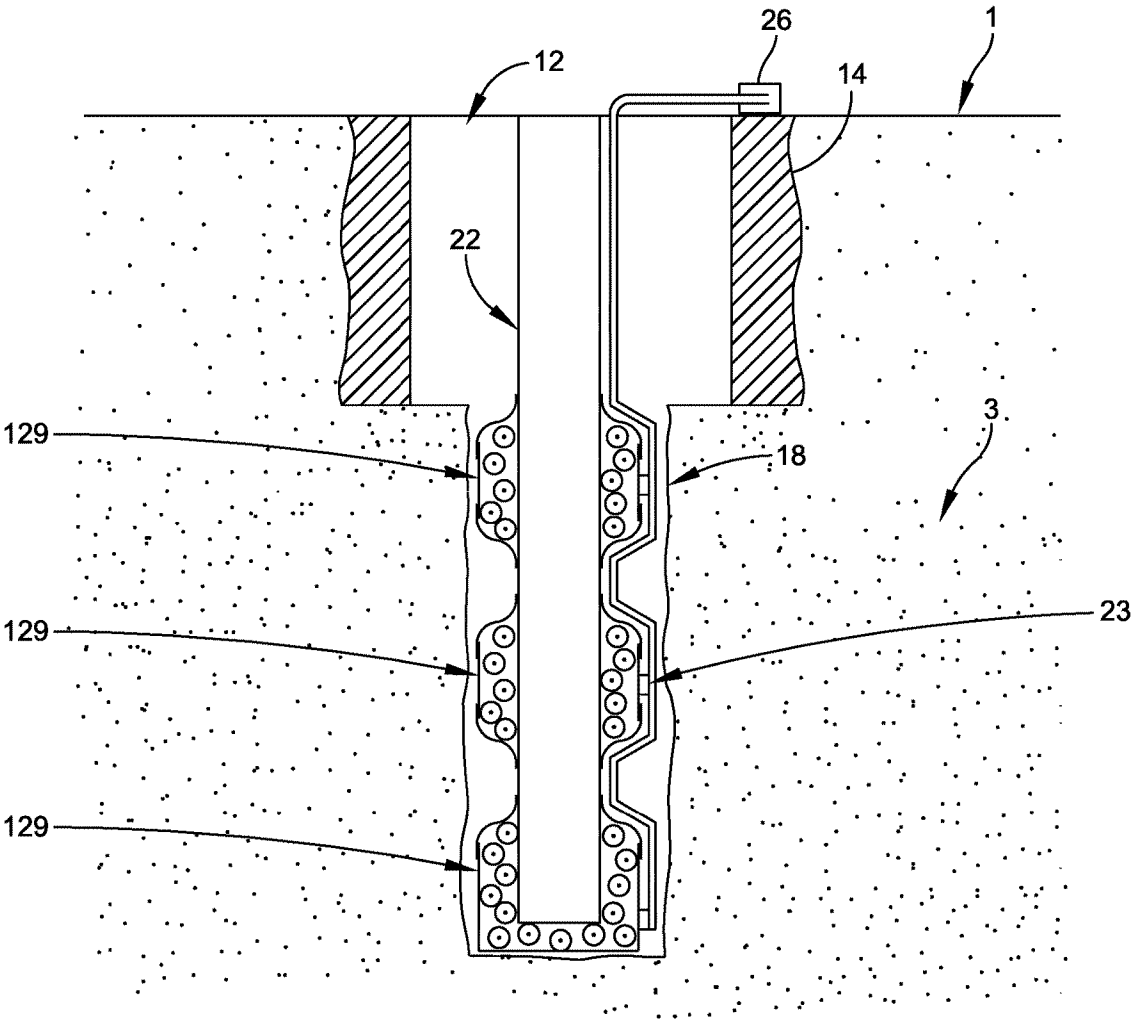

FIG. 42 shows the casing 22 fully deployed in the well, as shown in FIG. 38, and applied to a vertical well. For brevity, a description of the individual components and steps is not repeated.

Figure 43:
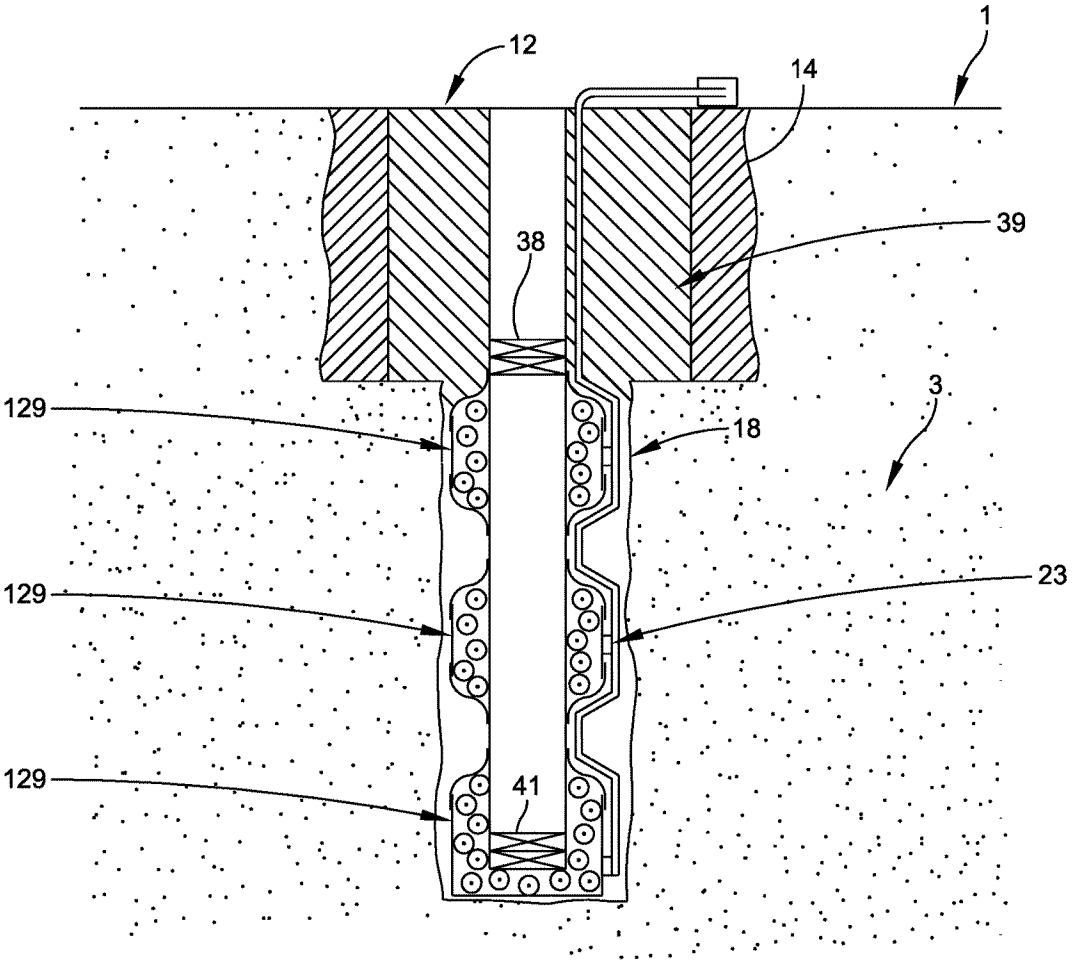

FIG. 43 shows the casing 22 encapsulated with isolation material 39, as shown in FIG. 39, and applied to a vertical well. For brevity, a description of the individual components and steps is not repeated.

Figure 44:
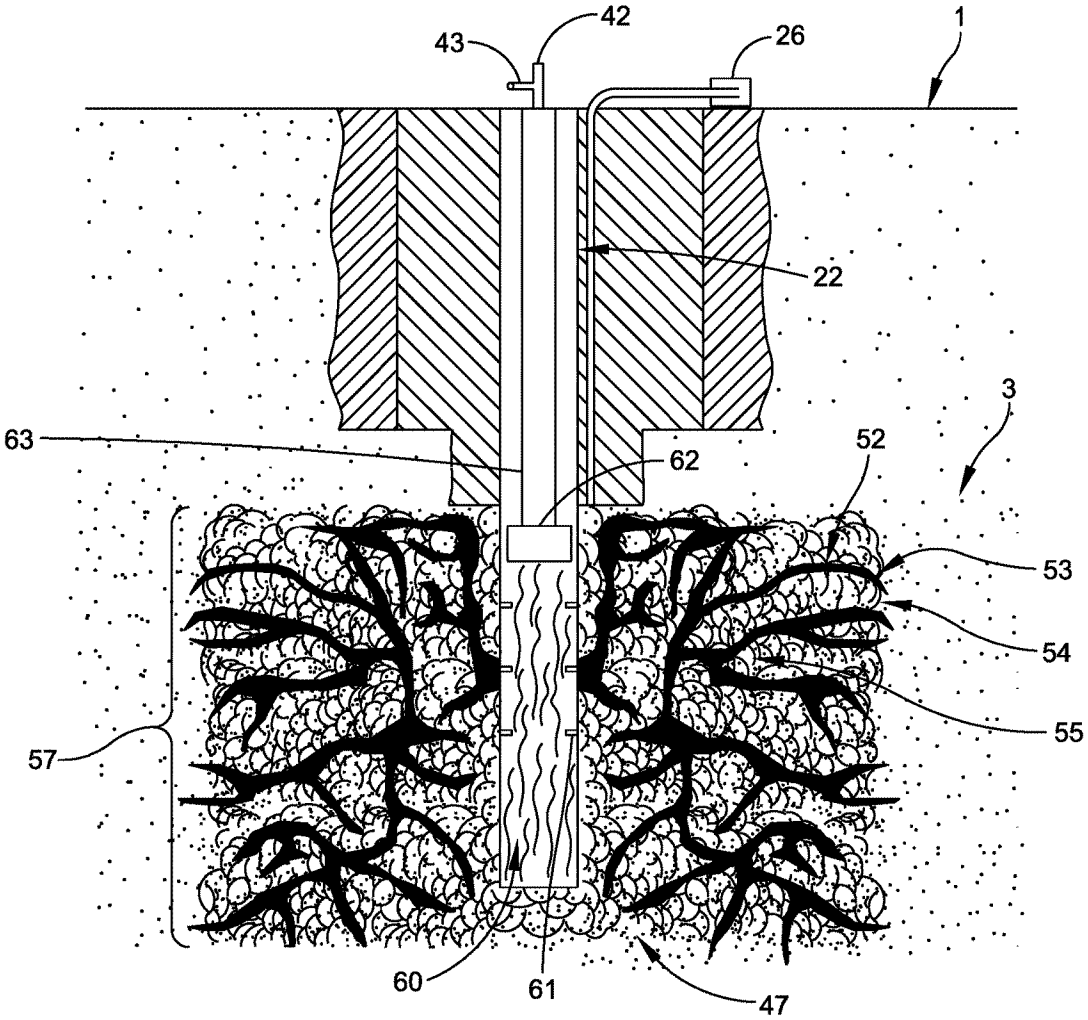

FIG. 44 shows the casing 22 after detonation of the explosives in each module 129*a*-129*c*, perforation of the casing 22, and insertion of the production pump 62, as shown in FIG. 40, and applied to a vertical well. For brevity, a description of the individual components and steps is not repeated.

In the embodiments described above, detonation of the explosive material produces high energy gases which form a compressive high velocity wave front and an accompanying reflected high velocity wave front that extends to a periphery of the reserve-bearing formation. The compressive high velocity wave front creates primarily cracks and crack patterns. The accompanying reflected high velocity wave front creates areas of tension forces in the hydrocarbon bearing formation where the phenomenon of spalling occurs creating fragments and fragment patterns and an increase in the surface area within the reserve-bearing formation. The surface area created in the hydrocarbon bearing formation by the detonation of the explosive material is dependent on the composition of the explosive material, the amount of the explosive material, the placement of the explosive material in the hydrocarbon bearing formation, and the placement of the isolation material. It is estimated that the surface area of a hydrocarbon bearing formation can be increased to a value on the order of 3600 times that of a non-fractured formation and on the order of 100 to 1000 (e.g., 360) times that of a formation which has been hydraulically fractured without an explosive material. Further, it is estimated that a two-stage detonation process as shown in FIG. 29, increases the surface area of a hydrocarbon bearing formation to on the order of 14,000 times that of a non-fractured well and on the order of 1,400 times that of a well fractured using hydraulic fracturing methods without an explosive material. This increase in surface area allows for more efficient extraction of the hydrocarbon from the hydrocarbon bearing formation.

The methods and devices described herein can be used to extract any type of material from a hydrocarbon bearing formation. For example, the methods and devices can be used to extract oil or gas from a hydrocarbon bearing formation. Alternatively, the methods and devices can be used to extract water or other substances.

Although the subject matter has been described in terms of exemplary embodiments, it is not limited thereto. Rather, the appended claims should be construed broadly, to include other variants and embodiments, which may be made by those skilled in the art.

What is claimed is:

1. A method for treating a hydrocarbon bearing formation bounded by at least one nonbearing formation comprising the steps of:

inserting a tubular into a wellbore formed in the hydrocarbon bearing formation, the tubular defining proximal and distal ends and further having a sidewall defining inner and outer surfaces and a tubular bore, where an annulus is defined between the outer surface of the sidewall and the inner surface of the wellbore;

disposing a detonation means in the annulus through at least a portion of the hydrocarbon bearing formation;

pumping a first explosive fluid including a first explosive through the tubular bore into a selected portion of the annulus;

pressurizing the tubular bore using a drilling fluid;

inserting an isolation material in the annulus between an entrance of the wellbore and the first explosive fluid; and detonating the first explosive fluid with the detonation means.

2. The method of claim 1 wherein the isolation material is pumped through the distal end of the tubular into the annulus.

3. The method of claim 1 wherein the isolation material includes cement.

4. The method of claim 1 further including the step of perforating the tubular along at least a portion of that length which extends through the hydrocarbon bearing formation where said perforation is made subsequent to the detonation of the explosive fluid.

5. The method of claim 1, further comprising the step of pressurizing the tubular bore prior to detonating the first explosive fluid.

6. The method of claim 1, wherein the first explosive fluid is a slurry.

7. The method of claim 1, wherein the first explosive fluid is a gel.

8. The method of claim 1 wherein the detonation means includes one or more detonators.

9. The method of claim 1 wherein the detonation means is secured to the outer surface of the tubular sidewall.

10. The method of claim 1 wherein the detonation means includes a plurality of detonators which are axially spaced in said annulus along at least a portion of the hydrocarbon bearing formation.

11. The method of claim 10 wherein the detonators are sequentially detonated.

12. The method of claim 11 further including the step of first detonating the detonators disposed toward the distal and proximal ends of the hydrocarbon bearing formation.

13. The method of claim 1, wherein the first explosive fluid is pumped at a pressure sufficient to cause hydraulic fracturing of the hydrocarbon bearing formation prior to detonation.

14. The method of claim 13 wherein the first explosive fluid further includes a proppant material.

15. The method of claim 1 wherein the first explosive fluid includes ammonium nitrate and a carrier fluid.

16. The method of claim 1, further comprising, after the detonating step:

pumping a second explosive fluid including a second explosive into the annulus along the hydrocarbon bearing formation and then detonating the second explosive fluid.

17. The method of claim 16 wherein the first explosive fluid when detonated produces a first wave front speed of less than 6500 ft/sec, and the first wave front speed is less than a second wave front speed produced by detonation of the second explosive fluid.

18. The method of claim 1, wherein the wellbore includes a substantially vertical portion and a substantially horizontal portion, and the detonation means is disposed in the substantially horizontal portion.

19. A method for treating a hydrocarbon bearing formation bounded by at least one nonbearing formation comprising the steps of:

inserting a tubular into a wellbore formed in the hydrocarbon bearing formation, the tubular defining proximal and distal ends and further having a sidewall defining inner and outer surfaces and a tubular bore, where an annulus is defined between the outer surface of the sidewall and the inner surface of the wellbore;

disposing a detonation means in the annulus through at least a portion of the hydrocarbon bearing formation;

placing a diverter tool in the tubular bore at a position proximate the boundary between the hydrocarbon bearing and non-bearing formations, forming a seal in the annulus proximate this boundary, perforating the sidewall of the tubular at an area proximate this boundary along the non-bearing formation, and then injecting the isolation material through the perforations into the annulus using the diverter tool;

pumping a first explosive fluid including a first explosive through the tubular bore into a selected portion of the annulus;

inserting an isolation material in the annulus between an entrance of the wellbore and the first explosive fluid; and detonating the first explosive fluid with the detonation means.

20. A method for treating a hydrocarbon bearing formation bounded by at least one nonbearing formation comprising the steps of:

inserting a tubular into a wellbore formed in the hydrocarbon bearing formation, wherein the tubular is a production casing, the tubular defining proximal and distal ends and further having a sidewall defining inner and outer surfaces and a tubular bore, where an annulus is defined between the outer surface of the sidewall and the inner surface of the wellbore;

disposing a detonation means in the annulus through at least a portion of the hydrocarbon bearing formation;

pumping a first explosive fluid including a first explosive through the tubular bore into a selected portion of the annulus;

inserting an isolation material in the annulus between an entrance of the wellbore and the first explosive fluid; and detonating the first explosive fluid with the detonation means.

21. A method for treating a hydrocarbon bearing formation bounded by at least one nonbearing formation comprising the steps of:

inserting a tubular into a wellbore formed in the hydrocarbon bearing formation, the tubular defining proximal and distal ends and further having a sidewall defining inner and outer surfaces and a tubular bore, where an annulus is defined between the outer surface of the sidewall and the inner surface of the wellbore;

disposing a detonation means in the annulus through at least a portion of the hydrocarbon bearing formation;

pumping a first explosive fluid including a first explosive through the tubular bore into a selected portion of the annulus;

inserting an isolation material in the annulus between an entrance of the wellbore and the first explosive fluid; and detonating the first explosive fluid with the detonation means, further comprising, after the detonating step:

pumping a second explosive fluid including a second explosive into the annulus along the hydrocarbon bearing formation and then detonating the second explosive fluid, wherein the second explosive fluid when detonated produces a higher explosion pressure than the first explosive.

22. A method for treating a selected subterranean formation comprising the steps of:

inserting a tubular into a wellbore formed in said selected formation, where the tubular includes a sidewall defining an inner and outer surface and an axial bore such that an annulus is formed between the outer surface of the sidewall and an inner surface of the wellbore;

placing a plurality of detonators in the annulus along at least a portion of the subterranean formation;

isolating a first explosive fluid in the annulus using cement along at least a portion of the selected formation; and detonating the first explosive fluid using one or more of the plurality of detonators.

23. The method of claim 22 further including the step of introducing the first explosive fluid through the tubular bore into the annulus along at least a portion of the selected formation at a sufficient pressure so that the fluid hydraulically fractures said formation.

24. The method of claim 22 wherein the first explosive fluid is isolated in the annulus by forming a seal over the first explosive fluid and then injecting the cement into the annulus up to said seal.

25. The method of claim 22 further comprising, after the detonating step, introducing a second explosive fluid into the annulus along at least a portion of the selected formation and detonating this second explosive fluid.

26. The method of claim 25 wherein the second explosive fluid creates a higher explosion pressure than the first explosive fluid.

27. The method of claim 26 wherein the first explosive when detonated produces a first wave front speed of less than 6500 ft/sec, and the first wave front speed is less than a second wave front speed produced by detonation of the second explosive.

28. The method of claim 22, wherein the wellbore includes a substantially vertical portion and a substantially horizontal portion, and the plurality of detonators are located in the substantially horizontal portion.

29. The method of claim 22 wherein, in the detonating step, the detonators are detonated sequentially.

30. The method of claim 22 wherein the detonators are axially spaced in the annulus along at least a portion of the selected formation.

31. The method of claim 22 wherein the first explosive fluid is a slurry.

32. The method of claim 22 wherein the first explosive fluid includes a proppant.

33. The method of claim 22 further comprising selecting the viscosity of the first explosive fluid is determined as a function of the depth of the formation and the wellbore temperature of that formation.

34. The method of claim 22 further comprising securing the detonators to the outer surface of the sidewall along at least a portion of its a length of the sidewall.

35. A method for treating a hydrocarbon bearing formation comprising the steps of:

inserting a casing into a wellbore formed in said hydrocarbon bearing formation, the casing having a sidewall having an inner and an outer surface and defining a casing bore, said outer surface of the sidewall and the inner surface of the wellbore defining an annulus;

where said outer surface of said casing includes a plurality of detonators disposed along a selected portion of a length of said casing;

forming a fluid seal in said annulus so as to define a first and second annular zone, where said first annular zone is located substantially adjacent the hydrocarbon bearing formation;

inserting an isolation material in the second annular zone;

positioning a tubular in the casing bore such that a distal end of the tubular is located adjacent to a first set of perforations formed in the casing, where said perforations are located in the first annular zone;

pumping a first fluid including a first explosive through the tubular to enable said fluid to be injected through the one or more first sets of perforations such that the explosive fluid hydraulically fractures the hydrocarbon bearing formation in the first annular zone; and detonating the first explosive fluid using the plurality of detonators.

36. The method of claim 35 further comprising, after pumping the first explosive fluid through the first set of perforations so as to cause fracturing of the formation, repositioning the tubular such that its a distal end of the tubular is adjacent to a second set of perforations formed in the casing and then pumping the first explosive fluid through the tubular such that said fluid is injected out through the second set of perforations such that the first explosive fluid again hydraulically fractures the hydrocarbon bearing formation.

37. The method of claim 36, wherein after the first fracturing step, a sealant tool is positioned in the bore to block fluid flow through the first set of perforations.

38. The method of claim 35, wherein the explosive includes ammonium nitrate.

39. The method of claim 35, further comprising the step of placing a bridge plug adjacent the distal end of the casing bore of the casing.

40. The method of claim 35, further comprising the step of pressurizing a drilling fluid within the casing bore prior to detonating the first explosive fluid.

41. The method of claim 35, wherein the isolation material is cement.

42. The method of claim 35, wherein the first explosive fluid is a slurry.

43. The method of claim 35 further comprising, after the detonating step:

pumping a second explosive fluid including a second explosive into the first annular zone and then detonating the second explosive fluid.

44. The method of claim 43 wherein the second explosive fluid, when detonated, produces a higher explosion pressure than the first explosive fluid.

45. A method for treating a selected subterranean formation comprising the steps of:

inserting a tubular into a bore hole formed in said formation so as to define an annulus around said tubular;

providing a flow boundary in said annulus proximate the selected formation;

perforating the tubular at a proximal end of the tubular located at the proximal end of the flow boundary and placing a diverter tool in a bore in the tubular, and then inserting an isolation material into the annulus at the proximal end of the flow boundary using the diverter tool;

pumping a first fluid including a first explosive into the annulus proximate the selected subterranean formation at the distal end of the flow boundary;

detonating the first explosive; and perforating the tubular at a distal end of the tubular, where the tubular extends through the selected formation.

46. The method of claim 45, further including the step of placing a bridge plug at the distal end of the tubular prior to detonating the first explosive.

47. The method of claim 45, wherein the selected formation includes hydrocarbons.

48. The method of claim 45 further including the step of extracting hydrocarbons through the perforations subsequent to detonating the first explosive.

49. The method of claim 45, wherein the tubular is pre perforated along a proximal portion of a length of the tubular before being placed in the well bore.

50. The method of claim 45, further including the step of injecting a second fluid containing a second explosive into the annulus formed distally from the flow boundary and detonating said second explosive prior to perforating the sidewall of the casing.

51. The method of claim 50, wherein the second explosive fluid is a slurry.

52. The method of claim 50, wherein the first and second explosives include ammonium nitrate.

53. The method of claim 45, wherein the first explosive fluid is a slurry.

54. The method of claim 45, wherein the first explosive fluid is detonated using detonation means placed in an axial direction along a selected length of the tubular.

55. The method of claim 54, wherein the detonating means comprise a series of axially spaced detonators.

56. The method of claim 54 wherein the explosive fluid includes a proppant.

57. The method of claim 45 further including the step of pressurizing the first explosive fluid prior to detonation, such that the pressurizing induces hydraulic fracturing of the formation.

58. The method of claim 45 further including the step of placing a bridge plug at the distal end of the tubular prior to detonating the first explosive.

59. The method of claim 45 wherein the first explosive fluid is detonated using a detonation means.

60. A method of improving the extraction of a fluid or gas from a given subterranean formation by increasing the surface area of the portion of that formation accessible from a borehole formed in said subterranean formation, comprising the steps of:

from the borehole, injecting a first fluid including a first explosive under pressure into said formation to result in a hydraulic fracturing of that formation;

detonating the first explosive;

injecting a second fluid including a second explosive into the formation after the first detonation to fragment the formation, where the second explosive has more explosive energy than the first explosive; and extracting the fluid or gas through the borehole after injecting the second fluid.

61. The method of claim 60 wherein the fluid is extracted through a tubular disposed in said borehole.

62. The method of claim 61, wherein:

the tubular is run in the borehole prior to injecting the first explosive fluid, the first explosive fluid is pumped through said tubular into an annulus formed between the tubular and the borehole so as to contact the formation and, subsequent to the detonation of the first explosive fluid, hydrocarbon, or hydrogen oxide ($H_2O$) is extracted from the formation through said tubular.

63. The method of claim 60 wherein the fluid to be extracted includes hydrogen oxide ($H_2O$) or a hydrocarbon.

64. The method of claim 60 wherein the first explosive includes a carrier fluid and one of a group consisting of RDX, nitrocellulose or ammonium nitrate fluid.

65. The method of claim 60 wherein the first explosive fluid includes a proppant.

66. A method for treating a selected subterranean formation comprising the steps of:

inserting a tubular into a wellbore formed in said selected formation, where the tubular includes a sidewall defining an inner and outer surface and an axial bore such that an annulus is formed between the outer surface of the sidewall and an inner surface of the wellbore;

placing a plurality of detonators in the annulus along at least a portion of the subterranean formation;

isolating a first explosive fluid in the annulus using an isolation material along at least a portion of the selected formation, wherein the isolation material is injected in the annulus through one or more perforations formed in the sidewall of the tubular; and detonating the first explosive fluid using one or more of the plurality of detonators.

* * * * *